US011857137B2

(12) United States Patent
Conrad

(10) Patent No.: US 11,857,137 B2
(45) Date of Patent: Jan. 2, 2024

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 17/715,430

(22) Filed: Apr. 7, 2022

(65) Prior Publication Data

US 2022/0225850 A1 Jul. 21, 2022

Related U.S. Application Data

(60) Continuation of application No. 17/351,707, filed on Jun. 18, 2021, now Pat. No. 11,357,369, which is a (Continued)

(51) Int. Cl.
*A47L 5/36* (2006.01)
*A47L 5/22* (2006.01)
(Continued)

(52) U.S. Cl.
CPC ..... *A47L 5/225* (2013.01); *A47L 5/24* (2013.01); *A47L 5/28* (2013.01); *A47L 5/362* (2013.01);
(Continued)

(58) Field of Classification Search
CPC ... A47L 5/225; A47L 5/24; A47L 5/28; A47L 5/362; A47L 9/16; A47L 9/1608; A47L 9/1625; A47L 9/1641; A47L 9/1683; A47L 9/1691; A47L 9/322; A47L 9/325; A47L 9/0477; A47L 9/122; A47L 9/1666; A47L 9/327
See application file for complete search history.

(56) References Cited

U.S. PATENT DOCUMENTS 3,621,640 A 11/1971 Hiroshi
7,445,655 B2 11/2008 Bock
(Continued)

FOREIGN PATENT DOCUMENTS

CN 110934533 A 3/2020
DE 102010043159 A1 5/2012
(Continued)

OTHER PUBLICATIONS

International Search Report and Written Opinion, received in connection to International Patent Application No. PCT/CA2022/050902, dated Sep. 16, 2022.
(Continued)

*Primary Examiner* — David Redding
(74) *Attorney, Agent, or Firm* — Philip C. Mendes da Costa; BERESKIN & PARR LLP/S.E.N.C.R.L., s.r.l.

(57) ABSTRACT

A canister surface cleaning apparatus comprising a canister body having a recess. The recess comprises a wall and sidewalls that extend away from the wall to define a volume. An air treatment assembly is removably mountable to the canister body. When the air treatment assembly is mounted to the canister body and the canister body is positioned with on the floor, the wall extends generally vertically and one of the sides of the air treatment assembly faces the wall and is positioned in the recess.

20 Claims, 47 Drawing Sheets

Related U.S. Application Data continuation-in-part of application No. 16/590,972, filed on Oct. 2, 2019, now Pat. No. 11,389,038, which is a division of application No. 16/156,006, filed on Oct. 10, 2018, now Pat. No. 10,478,030, which is a continuation of application No. 15/088,876, filed on Apr. 1, 2016, now Pat. No. 10,219,662, which is a continuation of application No. 14/822,211, filed on Aug. 10, 2015, now Pat. No. 9,888,817.

(60) Provisional application No. 62/093,189, filed on Dec. 17, 2014.

(51) Int. Cl.

| | |
|---|---|
| ***A47L 5/24*** | (2006.01) |
| ***A47L 9/16*** | (2006.01) |
| ***A47L 9/32*** | (2006.01) |
| ***A47L 5/28*** | (2006.01) |

(52) U.S. Cl.

CPC ..... *A47L 9/16* (2013.01); *A47L 9/1608* (2013.01); *A47L 9/1625* (2013.01); *A47L 9/1641* (2013.01); *A47L 9/1683* (2013.01); *A47L 9/1691* (2013.01); *A47L 9/322* (2013.01); *A47L 9/325* (2013.01)

(56) References Cited

U.S. PATENT DOCUMENTS

| | | | |
|---|---|---|---|
| 7,472,453 | B2 | 1/2009 | Mersmann |
| 9,204,773 | B2 | 12/2015 | Conrad |
| 2010/0115727 | A1 | 5/2010 | Oh |
| 2010/0263161 | A1 | 10/2010 | Lee |
| 2014/0237764 | A1 | 8/2014 | Conrad |
| 2017/0265697 | A1 | 9/2017 | Conrad |
| 2020/0129025 | A1 | 4/2020 | Zhong et al. |
| 2020/0230617 | A1 | 7/2020 | Conrad |
| 2020/0237170 | A1 | 7/2020 | Henderson |
| 2020/0253437 | A1 | 8/2020 | Conrad et al. |
| 2020/0268224 | A1 | 8/2020 | Conrad et al. |
| 2021/0307574 | A1 | 10/2021 | Conrad |

FOREIGN PATENT DOCUMENTS

| | | | |
|---|---|---|---|
| EP | 1136028 | B1 | 7/2006 |
| EP | 2002775 | A1 | 12/2008 |
| EP | 2104447 | A2 | 9/2009 |
| EP | 1674022 | B1 | 12/2010 |
| EP | 1969988 | B1 | 3/2011 |
| EP | 1825798 | B1 | 11/2011 |
| EP | 1867267 | B1 | 6/2012 |
| EP | 3653096 | A1 | 5/2020 |
| EP | 3453298 | B1 | 12/2020 |
| EP | 3865038 | A1 | 8/2021 |
| GB | 2388307 | B | 10/2004 |
| GB | 2400309 | B | 2/2005 |
| JP | 2006296812 | A | 11/2006 |
| JP | 2013220168 | A | 10/2013 |
| WO | 2017083497 | A1 | 5/2017 |

OTHER PUBLICATIONS

English machine translation of JP2013220168, published on Oct. 28, 2013.

English machine translation of JP2006296812, published on Nov. 2, 2006.

English machine translation of CN110934533, published on Mar. 31, 2020.

English machine translation of DE102010043159, published on May 16, 2012.

English machine translation of EP2104447, published on Sep. 30, 2009.

SURFACE CLEANING APPARATUS

CROSS REFERENCE

This application is a continuation of U.S. patent application Ser. No. 17/351,707, filed on Jun. 18, 2021, now allowed, which itself is a continuation-in-part of co-pending U.S. patent application Ser. No. 16/590,972 filed on Oct. 2, 2019, which is a divisional of U.S. patent application Ser. No. 16/156,006 filed on Oct. 10, 2018 and issued as U.S. Pat. No. 10,478,030 on Nov. 19, 2019, which itself is a continuation of U.S. patent application Ser. No. 15/088,876 filed on Apr. 1, 2016 and issued as U.S. Pat. No. 10,219,662 on Mar. 5, 2019, which is a continuation of U.S. patent application Ser. No. 14/822,211, filed Aug. 10, 2015 and issued as U.S. Pat. No. 9,888,817 on Feb. 13, 2018, which claimed priority from U.S. Provisional Patent Application No. 62/093,189, filed Dec. 17, 2014, the entirety of each of which is hereby incorporated by reference.

FIELD

This application relates to the field of surface cleaning apparatus, preferably a canister vacuum cleaner, and air treatment assemblies for the same.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums.

Canister vacuum cleaners are known which have a canister body that houses a removable cyclone bin assembly. The cyclone bin assembly is typically removed to enable a user to empty the cyclone bin assembly. Several mechanisms are known for enable a cyclone bin assembly to be emptied.

Surface cleaning apparatus are also known which utilize one or more cyclones. A cyclone has a dirt collection region. The dirt collection region may be internal of the cyclone chamber (e.g., the dirt collection region may be a lower end of the cyclone chamber. Alternately, the dirt collection region may be a separate dirt collection chamber that is external to the cyclone chamber and in communication with the cyclone chamber via a dirt outlet. The dirt outlet may be a slot formed in the sidewall of a cyclone chamber or a gap provided between the end of the cyclone wall and an end of the cyclone chamber.

SUMMARY

In accordance with one aspect of this disclosure, there is provided an air treatment assembly, which may be a cyclone bin assembly, wherein a cyclone is nested internal of a dirt collection chamber. The air treatment assembly may be removably mounted, such as to a canister body of a canister vacuum cleaner. A handle having a handle portion is provided on a front face of the air treatment assembly. Accordingly, when the air treatment assembly is mounted on the canister body and the canister body is positioned with the lower end on a floor, the handle portion extends generally vertically. The handle may be positioned on any side, (front side, rear side, or the right or left opposed sides) that is opposed to an openable side of the air treatment assembly. Positioning the handle opposed to an emptying side of the air treatment apparatus enables the air treatment assembly to have an ergonomic handle that is useable to empty the cyclone bin assembly. The handle may provide a comfortable surface for the user to lift the surface cleaning apparatus and/or the air treatment assembly. The handle may also provide the user with greater control to aim the dirt being emptied from the dirt collection chamber. Accordingly, the user is less likely to spill dirt being emptied from the dirt collection chamber, thereby improving the cleaning process. Positioning the handle on the front side of the air treatment assembly provides facilitates a user manipulating the air treatment assembly.

In accordance with another aspect of this disclosure, there is provided a surface cleaning apparatus that has a body on which an air treatment assembly is removably mountable. The upper surface of the body houses a pre-motor filter, such as in a recess in the upper surface of the body. The air treatment assembly may therefore seal an upper side of a pre-motor filter housing. At least a portion and optionally, 50%, 60%, 70%, 80%, 90% or all of the pre-motor filter is recessed inwardly from the sides of the upper surface. For example, the surface cleaning apparatus may be a canister vacuum cleaner and the body may be a canister body with a recess having sidewalls extending upwardly from a platform. The pre-motor filter housing may therefore be located below the air treatment assembly and the bottom of the recess. The pre-motor filter housing houses a pre-motor filter that is recessed inwardly from the sidewall of the recess. An advantage of this aspect is that size of the surface cleaning apparatus may be reduced. Recessing the pre-motor filter inwardly from the sidewalls of the recess may allow other components of the surface cleaning apparatus to be positioned around the pre-motor filter housing, without impacting the air flow path, thereby reducing the profile of the surface cleaning apparatus. Additionally, the pre-motor filter may be more easily removable from the pre-motor filter housing.

In accordance with another aspect of this disclosure, a surface cleaning apparatus is provided that has a body on which an air treatment assembly is removably mountable. The upper surface of the body may house a pre-motor filter, such as in a recess in the upper surface of the body. The air treatment assembly may therefore seal an upper side of a pre-motor filter housing. An air inlet conduit that extends to an air treatment assembly air inlet may be located radially inwardly from the sides of the upper surface. For example, the surface cleaning apparatus may be a canister vacuum cleaner and the body may be a canister body with a recess having sidewalls extending upwardly from a platform. An air treatment assembly may be removably mountable to the canister body, the canister body having an inlet conduit with an outlet port wherein the outlet port is recessed inwardly from an outer surface of a sidewalls of a recess in the canister body. An advantage of this aspect is the air treatment assembly may be more easily mounted to the canister body while ensuring that the air flow passage is properly maintained. Additionally, the inlet conduit may be a single part that passes from exterior of the surface cleaning apparatus to interior of the surface cleaning apparatus without having one or more seals therein. Accordingly, leakage of the air flow passageway may be reduced.

In accordance with another aspect of this disclosure, a surface cleaning apparatus is provided that has a body on which an air treatment assembly is removably mountable. The upper surface of the body may house a pre-motor filter, such as in a recess in the upper surface of the body. The air treatment assembly may therefore seal an upper side of a pre-motor filter housing. The upper surface of the body may have a recess (e.g., with sidewalls, a rear wall and an upper wall) into which a portion of the air treatment assembly is seated when the air treatment assembly is mounted to the body. For example, the surface cleaning apparatus may be a canister vacuum cleaner and the body may be a canister body with a first recess having a wall with sidewalls that extend away from (e.g., forwardly from) the wall to define a volume that includes the first recess. When an air treatment assembly is mounted to the canister body and the canister body is positioned on the floor, the wall extends generally vertically and one of the sides of the air treatment assembly faces the wall is positioned within the wall recess. An advantage of this aspect is the recess may act as a guide for the user to mount the air treatment assembly to the canister body, thereby making it easier for the user to remount the air treatment assembly after its removal. Another advantage is that the walls of the recess may provide structural stability during the mounting of the air treatment assembly and the operation of the surface cleaning apparatus, thereby reducing the likelihood of the air treatment assembly being moved during use and reducing the likelihood of air leaks caused by improperly sealed airflow passages.

In accordance with another aspect of this disclosure, a surface cleaning apparatus is provided having an air treatment assembly with a first end and second opposed end and sides extending between the first and second ends and one of the sides is an openable side. An advantage of this aspect is that the openable side of the air treatment assembly may be used to facilitate emptying of the air treatment assembly. For example, the openable side may form a part of the dirt collection chamber and opening the openable side may allow a user to empty the dirt collected in the dirt collection chamber. Optionally, an air treatment chamber, such as a cyclone chamber, may be positioned internal of the dirt collection chamber. In such an embodiment, the air treatment chamber may be separately emptyable, such as by removing the air treatment chamber from the dirt collection chamber.

In accordance with another aspect of this disclosure, a surface cleaning apparatus is provided with an air treatment member that is removably mounted in an air treatment assembly. An advantage of this aspect is that the air treatment member and air treatment member assembly may be more easily cleaned. The user may empty the air treatment assembly, such as by opening a side of the air treatment assembly. When it is desired to empty the air treatment member, e.g., a cyclone chamber, to remove, e.g., hair and/or other debris that may have built up around the air treatment member over time, the air treatment member may be removed from the air treatment member assembly to more easily remove the built-up hair.

It will be appreciated that a surface cleaning apparatus and/or an air treatment assembly for a surface cleaning apparatus may incorporate any one of more of these aspects and that any such surface cleaning apparatus and/or air treatment assembly may use any one or more features of each such aspect.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
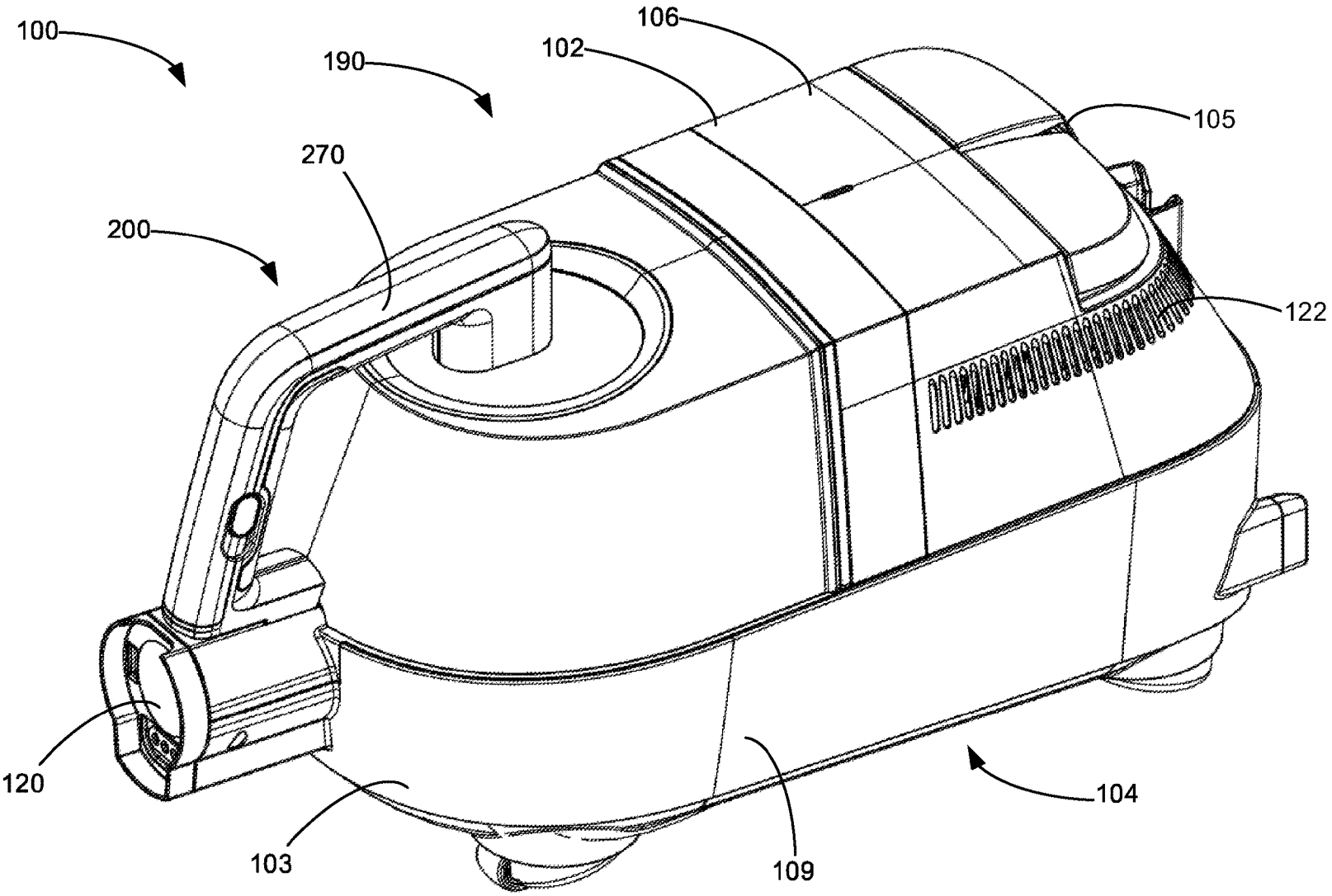
FIG. 1 is a front perspective view of a surface cleaning apparatus in accordance with an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

As used herein and in the claims, two elements are said to be "parallel" where those elements are parallel and spaced apart, or where those elements are collinear.

General Description of a Surface Cleaning Apparatus

Referring to FIGS. 1-40, an exemplary embodiment of a surface cleaning apparatus is shown generally as 100. The following is a general discussion of apparatus 100, which provides a basis for understanding several of the features that are discussed herein. As discussed subsequently, each of the features may be used individually or in any particular combination or sub-combination in this or in other embodiments disclosed herein. Surface cleaning apparatus 100 may be any type of surface cleaning apparatus, including for example a hand vacuum cleaner, a stick vacuum cleaner, an upright vacuum cleaner, a canister vacuum cleaner (as shown), an extractor, or a wet/dry type vacuum cleaner. For example, any of the features of an air treatment assembly disclosed herein may be used in any such type of surface cleaning apparatus, any feature of a body on which the air treatment assembly is removably mounted may be used in any such type of surface cleaning apparatus, and any feature of the wiring or controls disclosed herein may be used in any such type of surface cleaning apparatus.

FIG. 1 exemplifies a canister surface cleaning apparatus 100 having a rollable, canister body 102 having a front end 103 and a rear end 105. As exemplified, the canister body has a lower side 104 having floor travelling members 108 and an upper side 106 having a recess 110, the upper side 106 being spaced from the lower side 104 in a vertical direction when the canister body 102 is placed on a floor. The recess 110 has sidewalls 112 extending upwardly from a platform 114. The surface cleaning apparatus 100 includes an air treatment assembly 200 removably mountable to the canister body 102. The air treatment assembly 200 seats on the recess 110 when the air treatment assembly 200 is mounted to the canister body 102. The air treatment assembly 200 has an air treatment member 202. The canister body 102 has a dirty air inlet 120, a clean air outlet 122, and an air flow path extending between the dirty air inlet 120 and the clean air outlet 122. It will be appreciated that dirty air inlet 120 and clean air outlet 122 may be positioned in different locations of apparatus 100.

A suction motor 124 is provided to generate vacuum suction through the air flow path, and is positioned within a motor housing 126. The suction motor 124 may be a fan-motor assembly including an electric motor and impeller blade(s). In the illustrated embodiments, the suction motor 124 is positioned in the air flow path downstream of the air treatment assembly 200. In this configuration, the suction motor 124 may be referred to as a "clean air motor". Alternatively, the suction motor 124 may be positioned upstream of air treatment assembly 200, and referred to as a "dirty air motor" and may be at any position in the canister body 102.

The air treatment assembly 200 is configured to remove particles of dirt and other debris from the air flow and may be of any design known in the art. As exemplified, the air treatment assembly 200 is a cyclone assembly (also referred to as a "cyclone bin assembly") having a single cyclonic cleaning stage with a single cyclone 202 and a dirt collection chamber 206 (also referred to as a "dirt collection region", "dirt collection bin", "dirt bin", or "dirt chamber"). The cyclone 202 has a cyclone chamber 204. The dirt collection chamber 206 may be external to the cyclone chamber 204 (i.e., dirt collection chamber 206 may have a discrete volume from that of cyclone chamber 204). The cyclone 202 and the dirt collection chamber 206 may be of any configuration suitable for separating dirt from an air stream and collecting the separated dirt respectively, and may be in communication with one or more dirt outlet(s) 212 of the cyclone chamber 204. As exemplified, the cyclone 202 is nested in the dirt collection chamber 206.

In alternate embodiments, air treatment assembly 200 may include a cyclone assembly having two or more cyclonic cleaning stages arranged in series with each other. Each cyclonic cleaning stage may include one or more cyclones arranged in parallel with each other and one or more dirt collection chambers, of any suitable configuration. The dirt collection chamber(s) 206 may be external to the cyclone chambers 204 of the cyclones 202. Each cyclone 202 may have its own dirt collection chamber 206 or two or more cyclones 202 fluidically connected in parallel may have a single common dirt collection chamber 206. However, in some embodiments, it will be appreciated that the air treatment assembly 200 may comprise a cyclone wherein a dirt collection region is provided internal of the cyclone chamber or the air treatment assembly 200 may use a non-cyclonic momentum separator, one or more filter media which may be downstream of a non-cyclonic momentum separator, a bag or any combination thereof.

Figure 9:
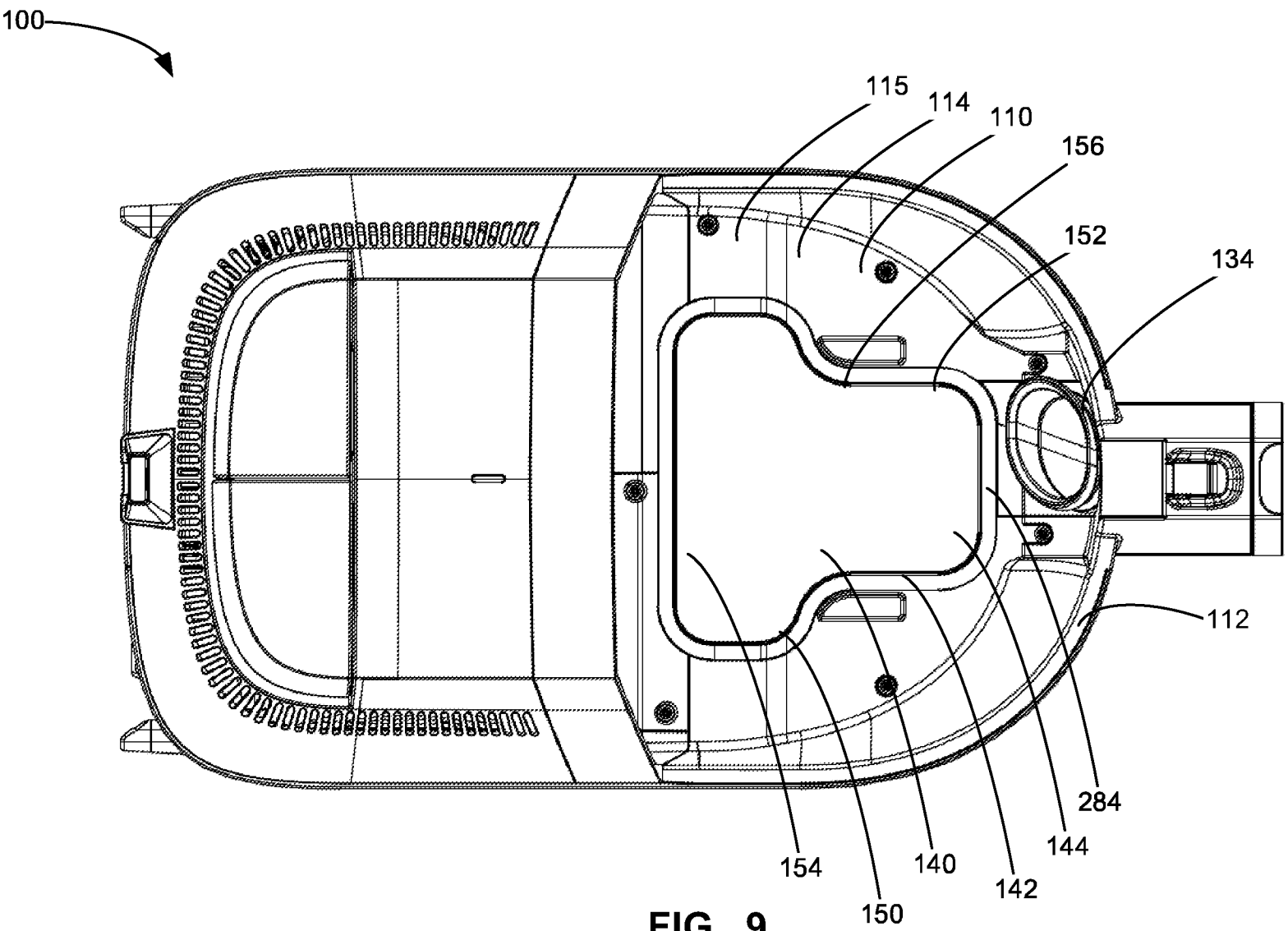
FIG. 9 is a top view of the surface cleaning apparatus of FIG. 1 with an air treatment assembly removed.
Figure 10:
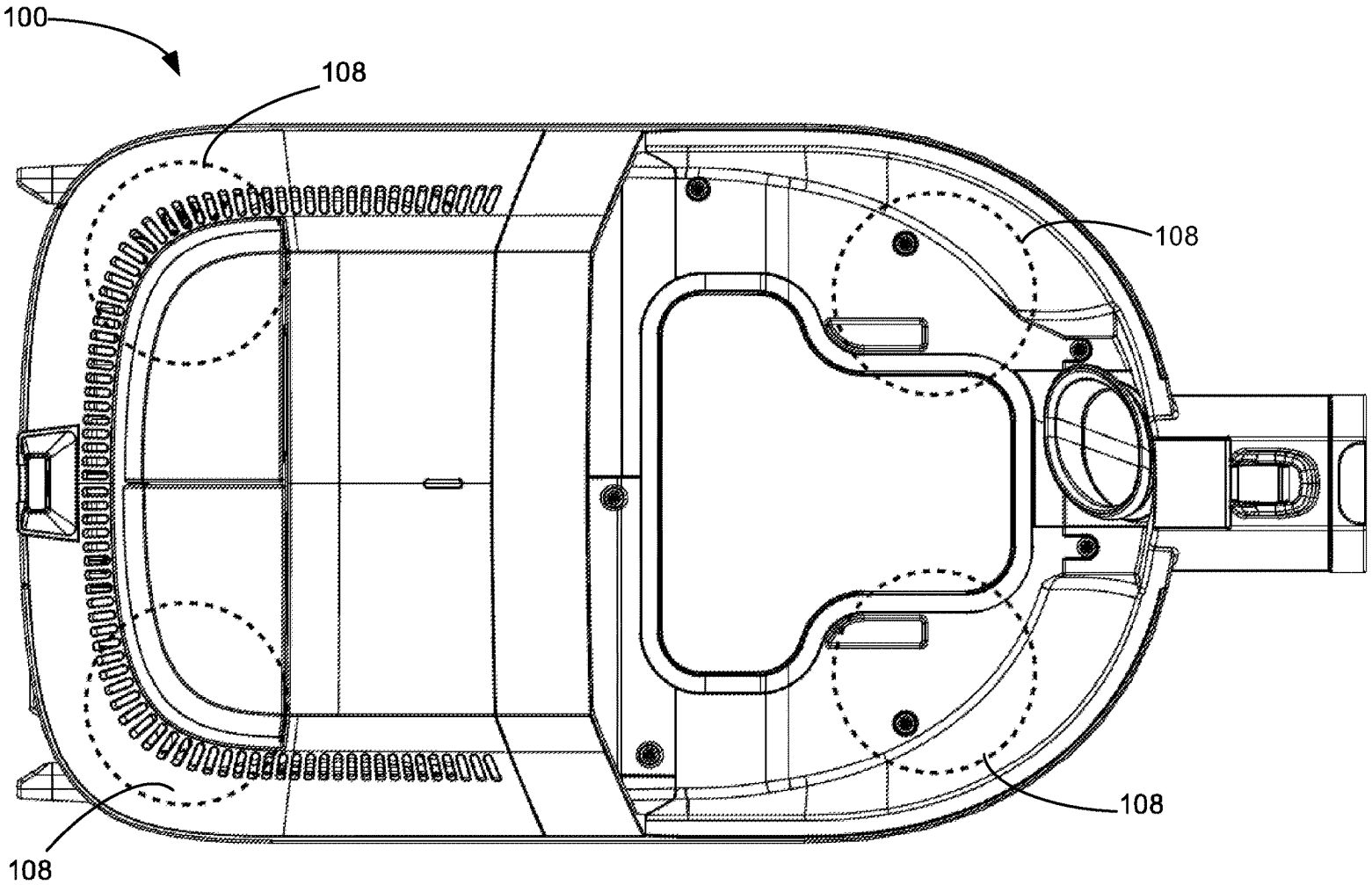
FIG. 10 is a top view of the surface cleaning apparatus of FIG. 1 with the air treatment assembly removed and wheel positions indicated in dashed lines.
Figure 11:
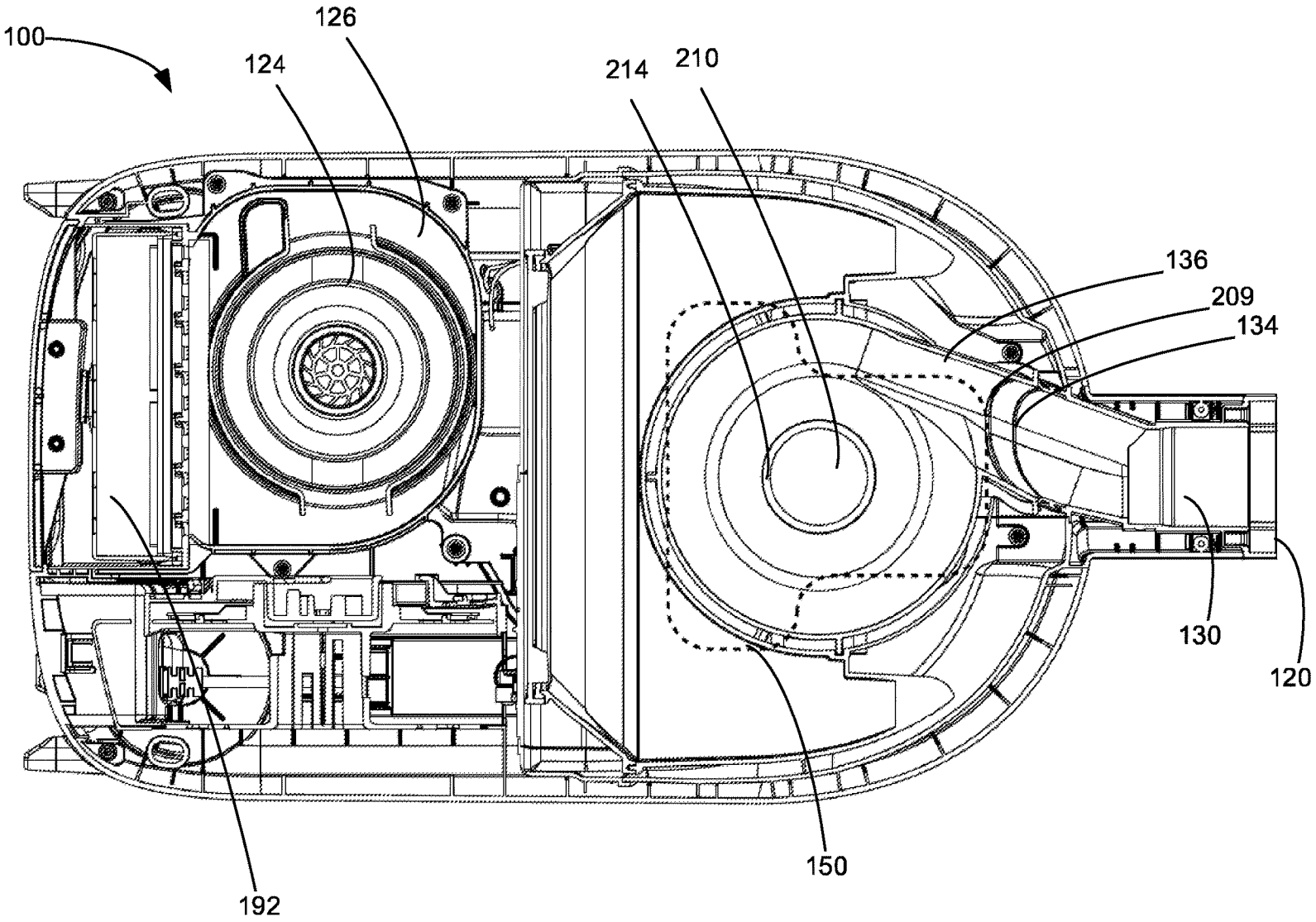
FIG. 11 is a cross-sectional view of the surface cleaning apparatus of FIG. 1 along the line 11-11 in FIG. 5 with a pre-motor filter position indicated in dashed lines.
Figure 12:
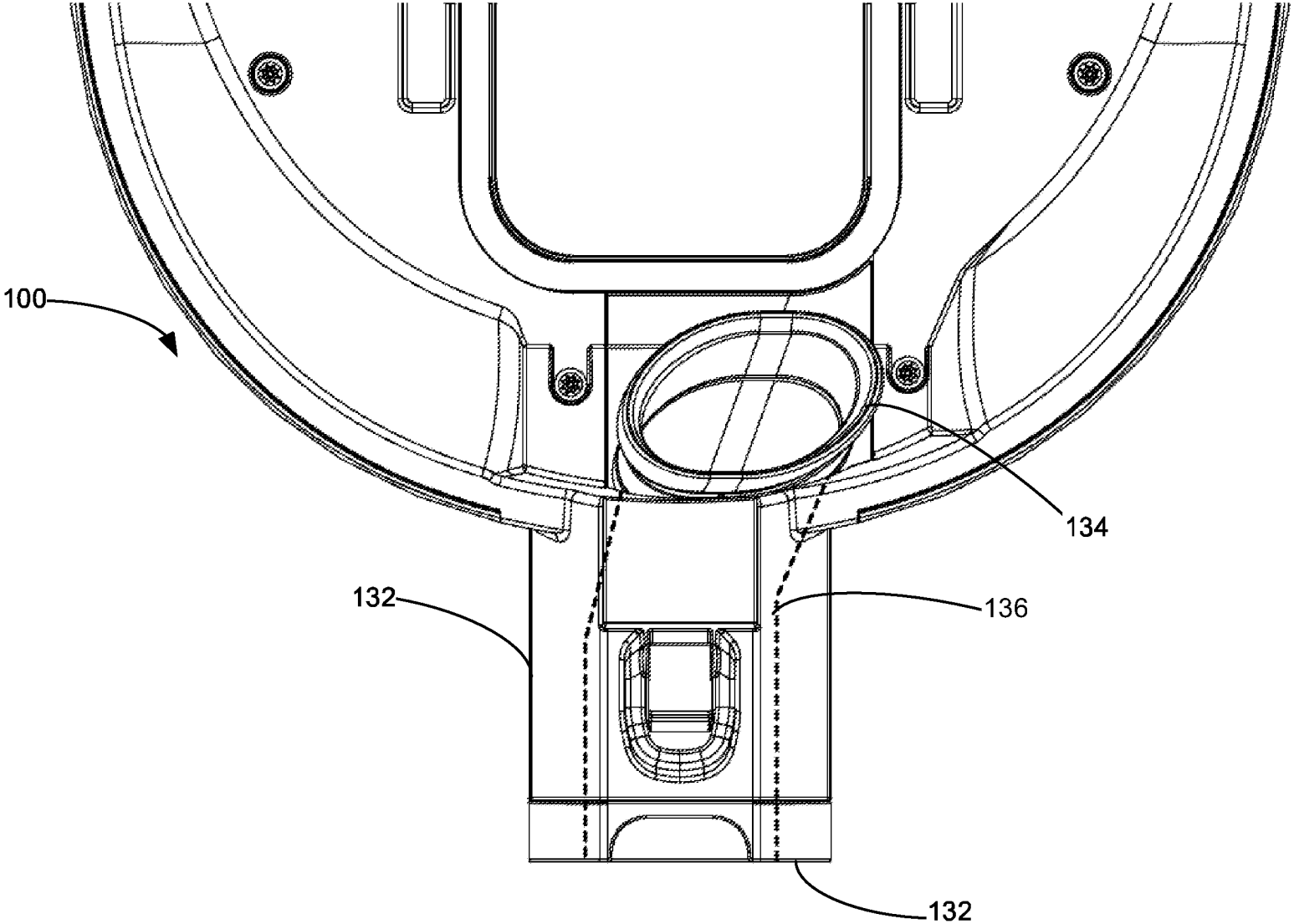
FIG. 12 is a top view of the surface cleaning apparatus of FIG. 1 with the air treatment assembly removed and an inlet conduit position indicated in dashed lines.
Figure 13:
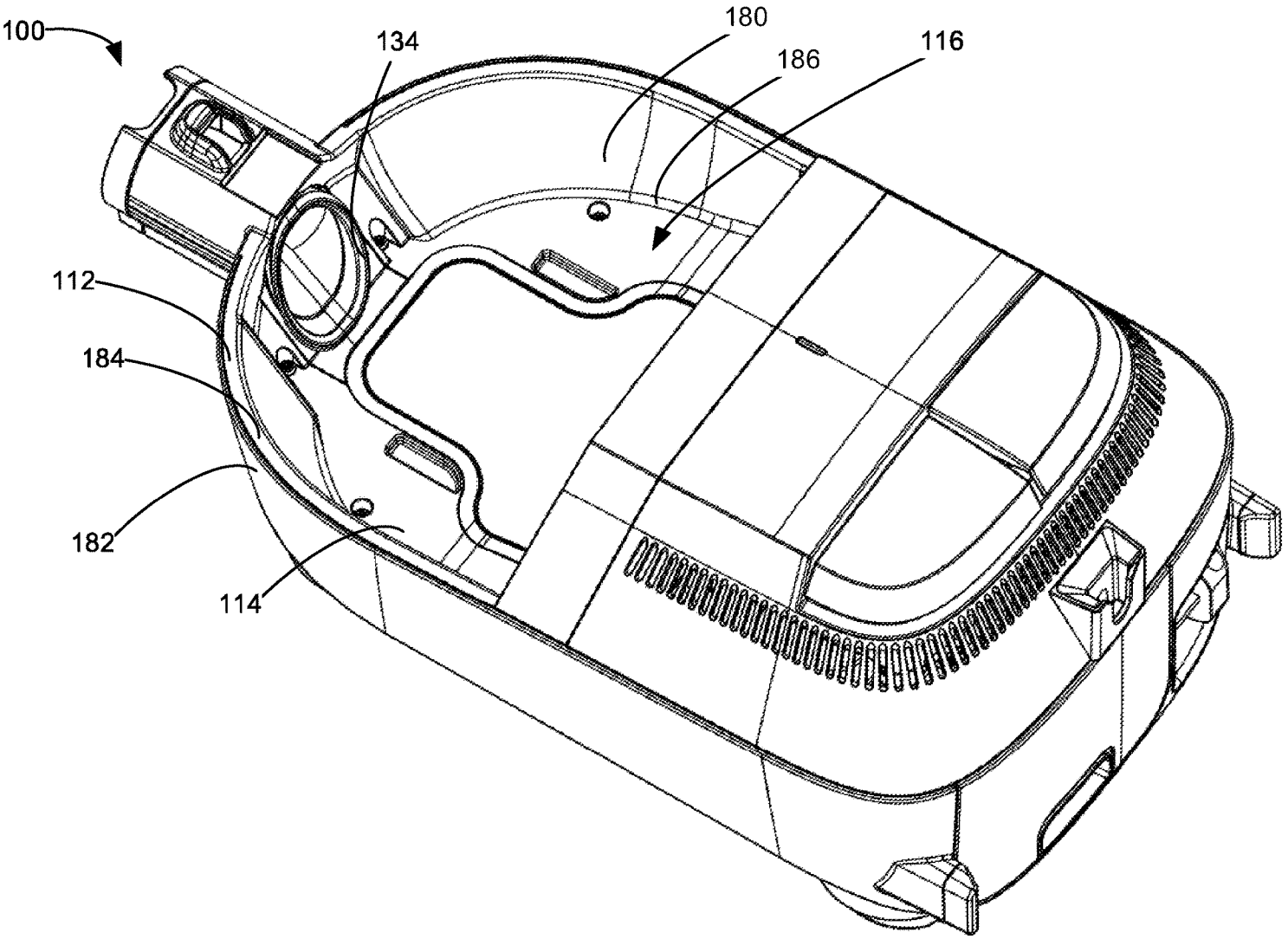
FIG. 13 is a top rear perspective view of the surface cleaning apparatus of FIG. 1 with the air treatment assembly removed.
Figure 14:
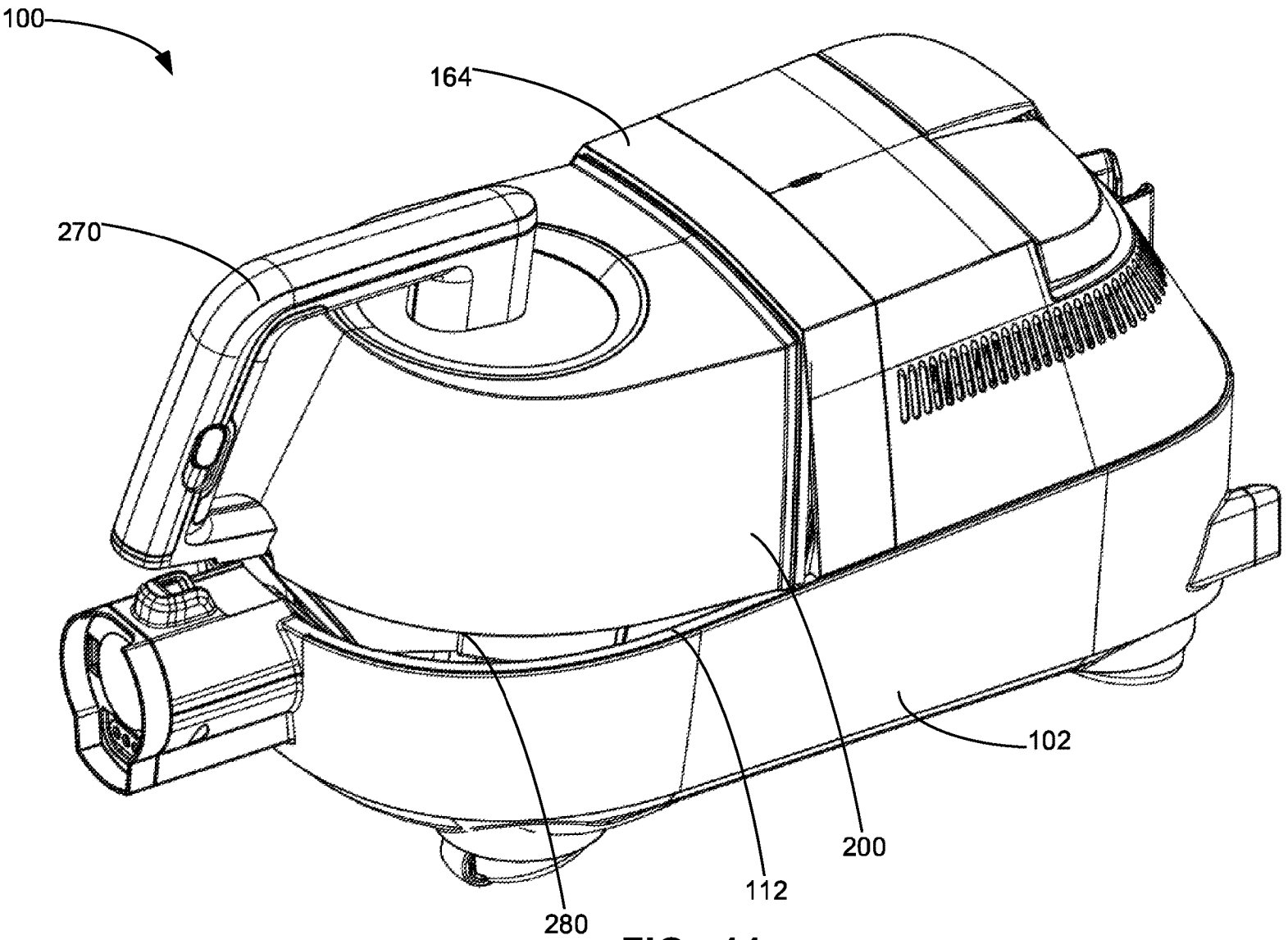
FIGS. 14-16 are front perspective views of the surface cleaning apparatus of FIG. 1 with the air treatment assembly in various stages of removal.
Figure 15:
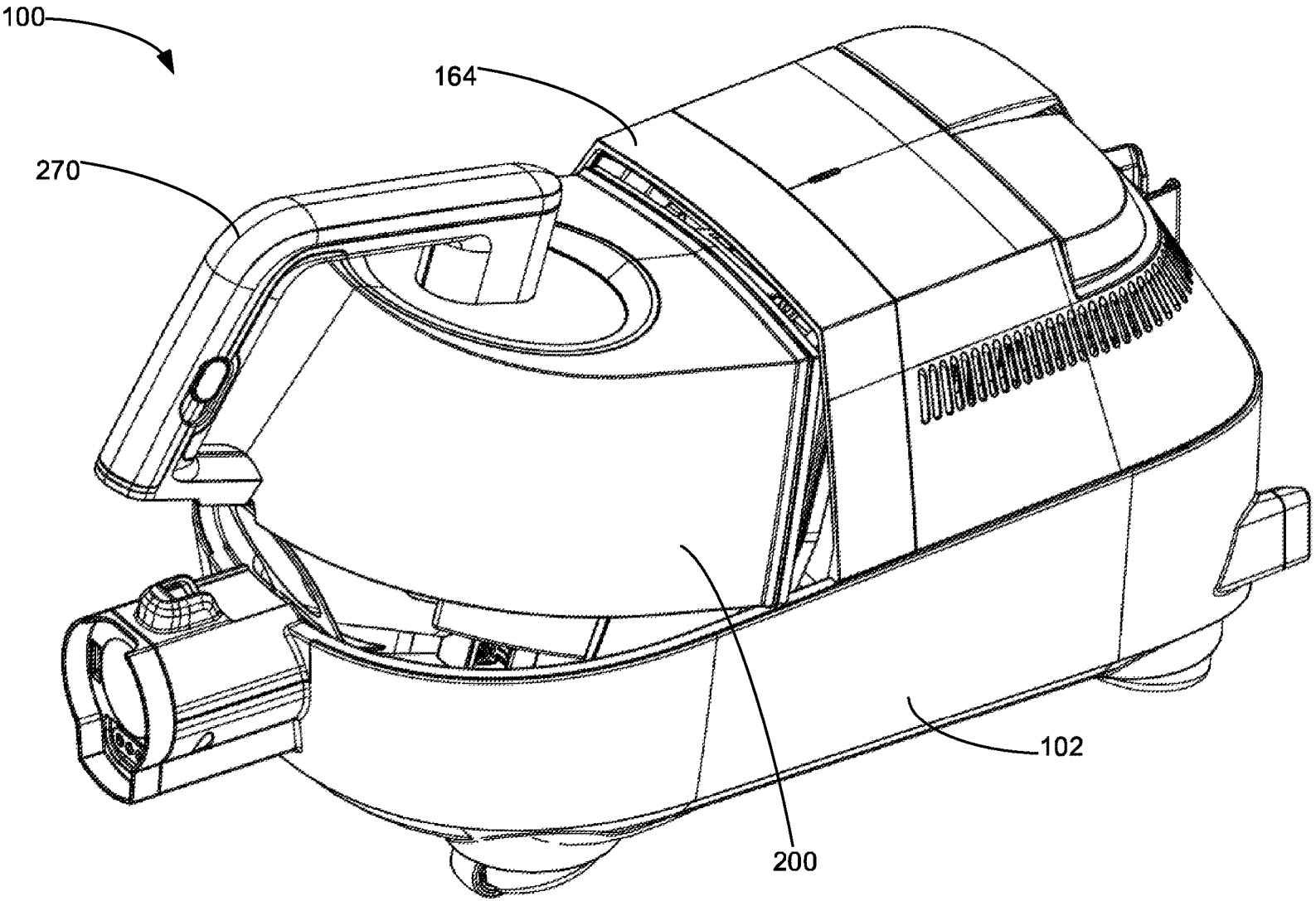

Referring to FIG. 9, the surface cleaning apparatus 100 may include a pre-motor filter 140 provided in the air flow path downstream of the air treatment assembly 200 and upstream of the suction motor 124. The pre-motor filter 140 may be made of any material and be of any design known in the art. For example, the pre-motor filter 140 may be formed from any suitable physical, porous filter media and may have one or more layers of such filter material. For example, pre-motor filter 140 may be one or more of a foam filter, felt filter, HEPA filter, or other physical filter media. In some embodiments, the pre-motor filter 140 may include an electrostatic filter, or the like. As exemplified, the pre-motor filter 140 may be located in a pre-motor filter housing 142 that is external to the air treatment assembly 200.

Figure 41:
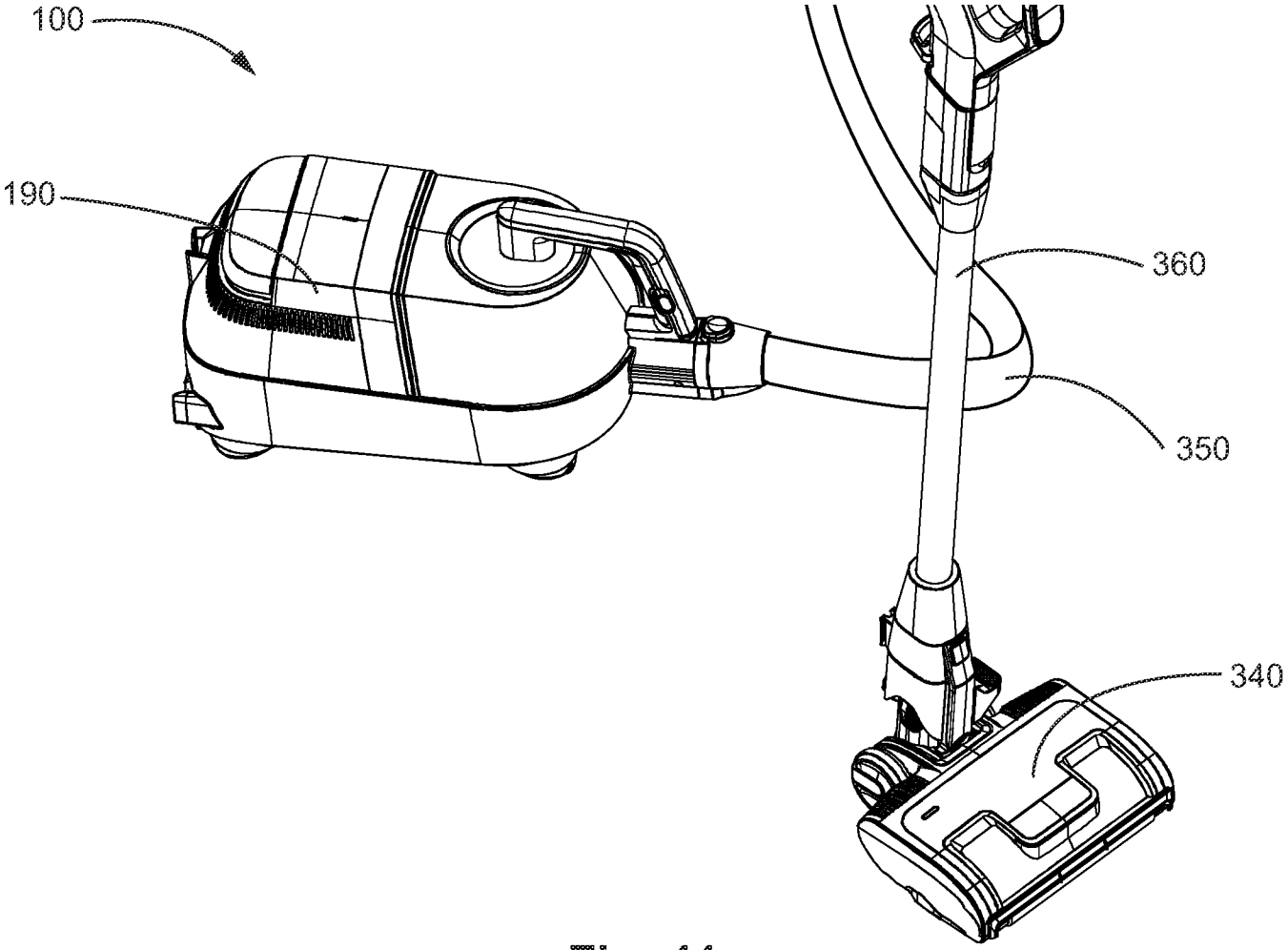
FIG. 41 is a front perspective view of the surface cleaning apparatus of FIG. 1 having a hose, a wand, and a surface cleaning head.
Figure 42:
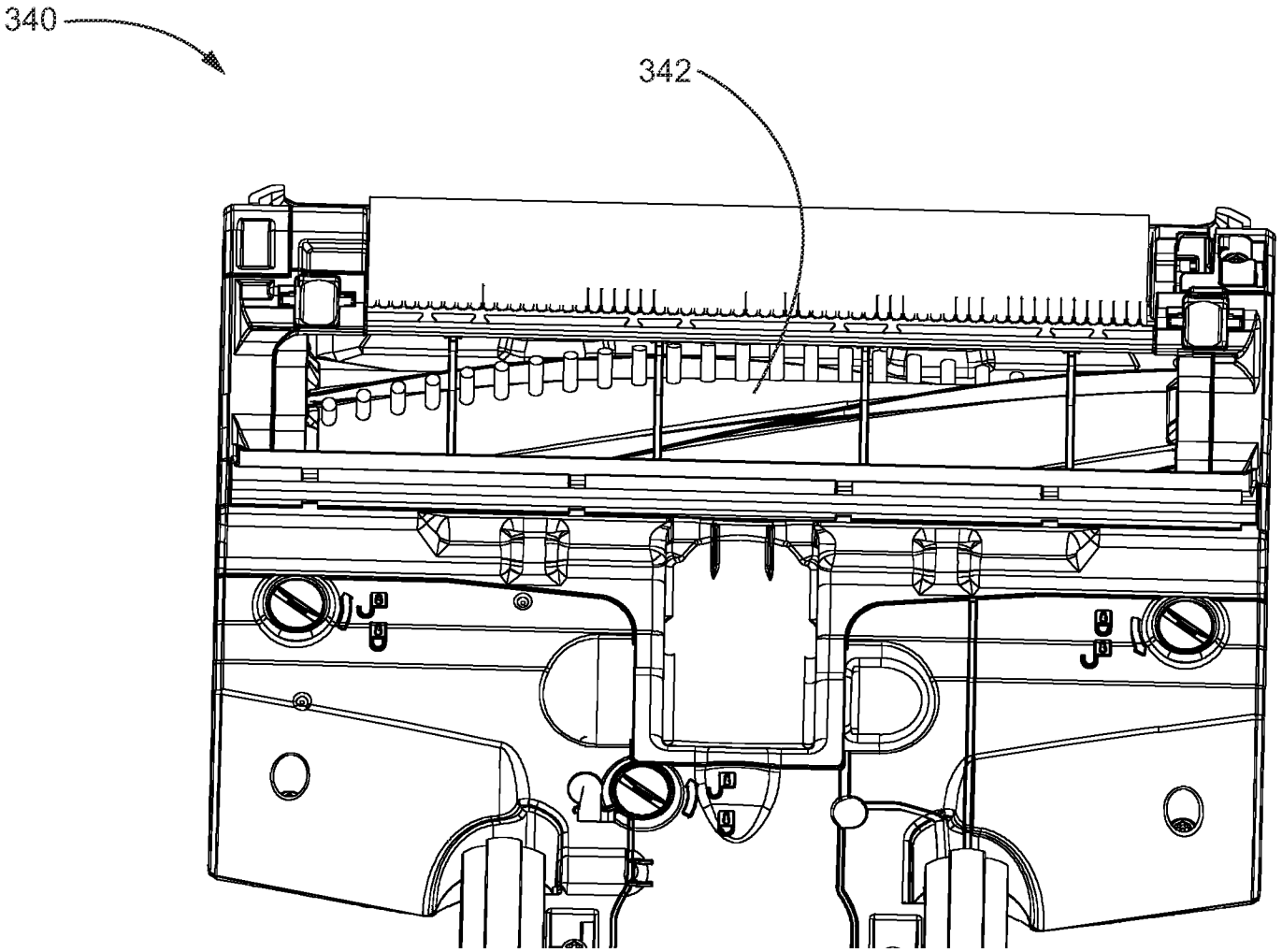
FIG. 42 is a bottom view of the surface cleaning head of FIG. 41.

As exemplified in FIG. 41, the dirty air inlet 120 may be connected (e.g., directly connected) to the downstream end of any suitable accessory tool such as a flexible hose 350. Alternately, it may be directly connected to a rigid air flow conduit (e.g., an above floor cleaning wand), a crevice tool, a mini brush, and the like. As shown, dirty air inlet 120 may be positioned forward of the air treatment assembly 200 although this need not be the case.

Figure 23:
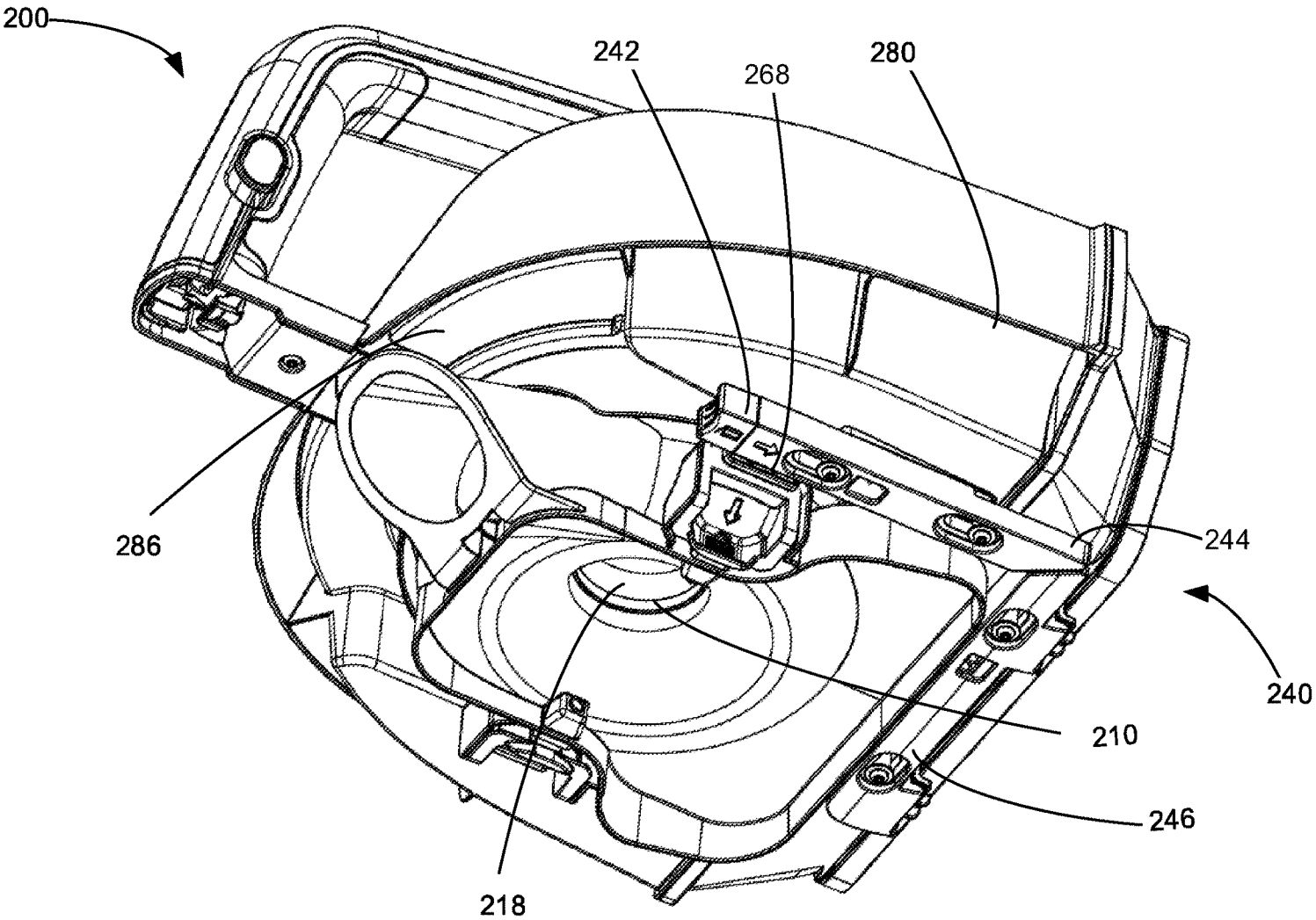
FIG. 23 is a bottom perspective view of the air treatment assembly of the surface cleaning apparatus of FIG. 1.
Figure 24:
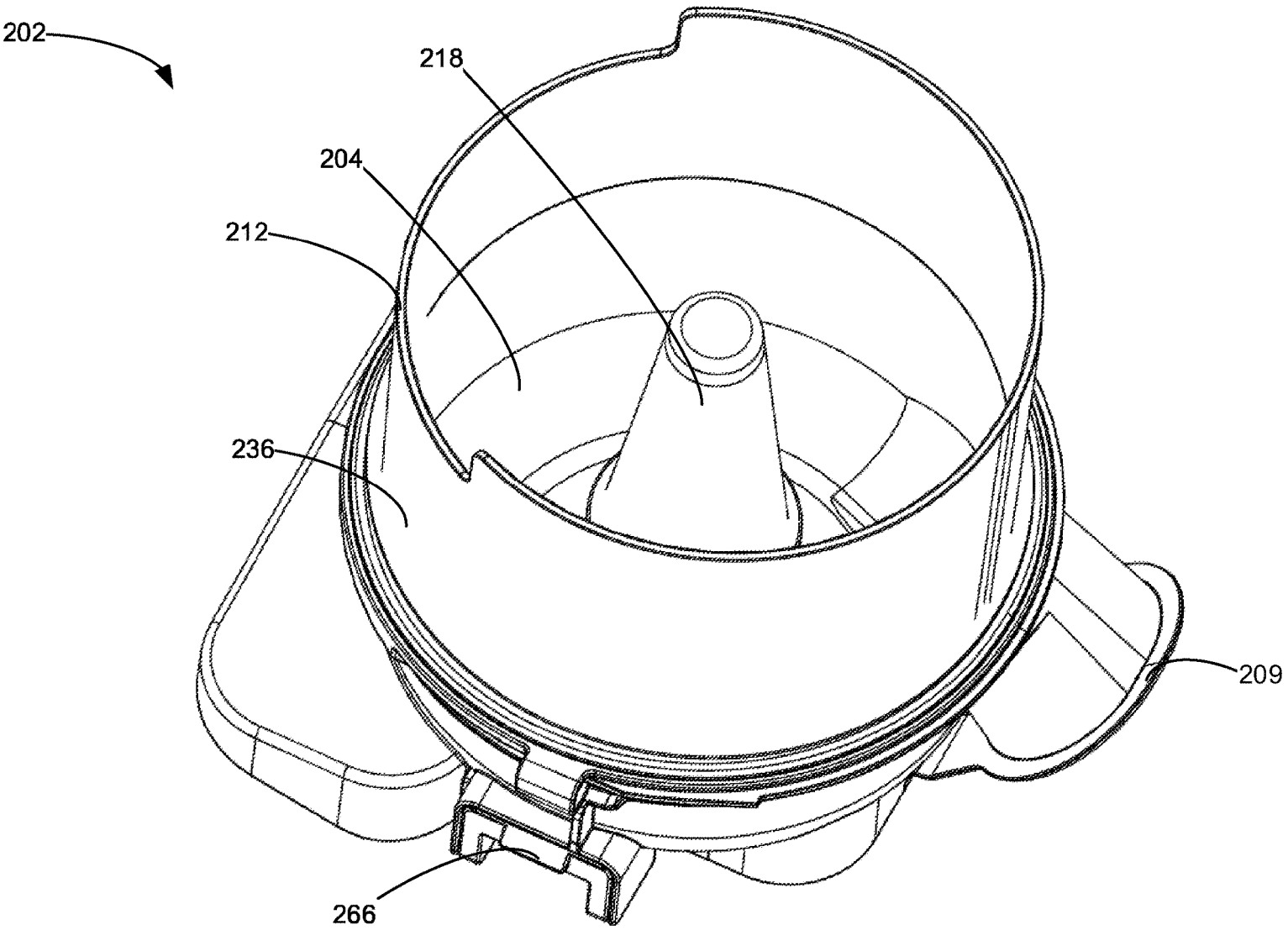
FIG. 24 is a top perspective view of an air treatment member when it has been removed from the air treatment assembly of FIG. 18.

As exemplified in FIGS. 23-24, the air treatment assembly comprises a cyclone 202, an air treatment assembly air inlet 208, the air inlet being a tangential cyclone air inlet, and an air treatment member air outlet 210, the air outlet being a cyclone air outlet. Accordingly, in operation, after activating the suction motor 124, dirty air enters apparatus 100 through dirty air inlet 120 and is directed along an air inlet conduit 130 to the cyclone air inlet 208. As shown, cyclone air inlet 208 may direct the dirty air flow to enter cyclone chamber 204 in a tangential direction so as to promote cyclonic action. Dirt particles and other debris may be disentrained (i.e., separated) from the dirty air flow as the dirty air flow travels from cyclone air inlet 208 to cyclone air outlet 210. The disentrained dirt particles and debris may be discharged from cyclone chamber 204 through a dirt outlet 212 into the dirt collection chamber 206 external to the cyclone chamber 204, in which the dirt particles and debris may be collected and stored until the dirt collection chamber 206 is emptied.

Air exiting the cyclone chamber 204 may pass through an outlet passage 214 located upstream of cyclone air outlet 210. Cyclone chamber outlet passage 214 may also act as a vortex finder to promote cyclonic flow within cyclone chamber 204. In some embodiments, the cyclone outlet passage 214 may include an air permeable portion (which may be referred to as a screen or shroud, e.g., a fine mesh screen) in the air flow path to remove large dirt particles and debris, such as hair, remaining in the exiting air flow. The cyclone air outlet 210 may comprise a conduit portion 218 which is solid (air impermeable) and the axially inward screen or shroud 216.

From the outlet passage 214, the air flow may be directed into the pre-motor filter housing 142 at an upstream side 144 of the pre-motor filter 140. The air flow may pass through the pre-motor filter 140, and then exit through a downstream side of the pre-motor filter 140 and pass through a pre-motor filter air outlet into, e.g., the motor housing 126. At the motor housing 126, the clean air flow may be drawn into the suction motor 124 and then discharged from apparatus 100 through the clean air outlet 122. Prior to exiting the clean air outlet 122, the treated air may pass through a post-motor filter 192, which may be one or more layers of filter media.

Power may be supplied to suction motor 124 and other electrical components of apparatus from an onboard energy storage member, which may include, for example, one or more batteries or other energy storage device. The energy storage device may be permanently connected to apparatus 100 and rechargeable in-situ, or removable from apparatus. Alternatively, or in addition to an energy storage member, power may be supplied to apparatus 100 by an electrical cord (not shown) connected to apparatus 100 that can be electrically connected to mains power by at a standard wall electrical outlet.

Air Treatment Assembly Having an Openable Side

In accordance with this aspect, which may be used by itself or in combination with one or more other aspects, the surface cleaning apparatus 100 has an air treatment assembly 200 having a first (upper) end 220 and second opposed (lower) end 222 and sides extending between the first and second ends and part or all of one more of the sides is an openable side 224.

An advantage of this aspect is that the openable side 224 of the air treatment assembly 200 may be used to facilitate emptying of the air treatment assembly 200. For example, the openable side 224 may form a part of the dirt collection chamber 206 and opening the openable side 224 may allow a user to empty the dirt collected in the dirt collection chamber 206. Additionally, opening the side 224 to facilitate emptying of the dirt collection chamber 206 does not require the removal of components of the air treatment assembly 200 to empty the dirt collection chamber 206, thereby simplifying the emptying process.

A further advantage is that only one seal may be required. For example, if the air treatment assembly comprises a cyclone chamber nested in a dirt collection chamber and the lower wall, which is a lower wall of the cyclone and dirt chambers, was openable, then the lower wall would have to seal the bottom of the cyclone chamber and the bottom of the dirt collection chamber. However, if the side wall were openable, then only the dirt collection chamber would have to be sealed.

Figure 22:
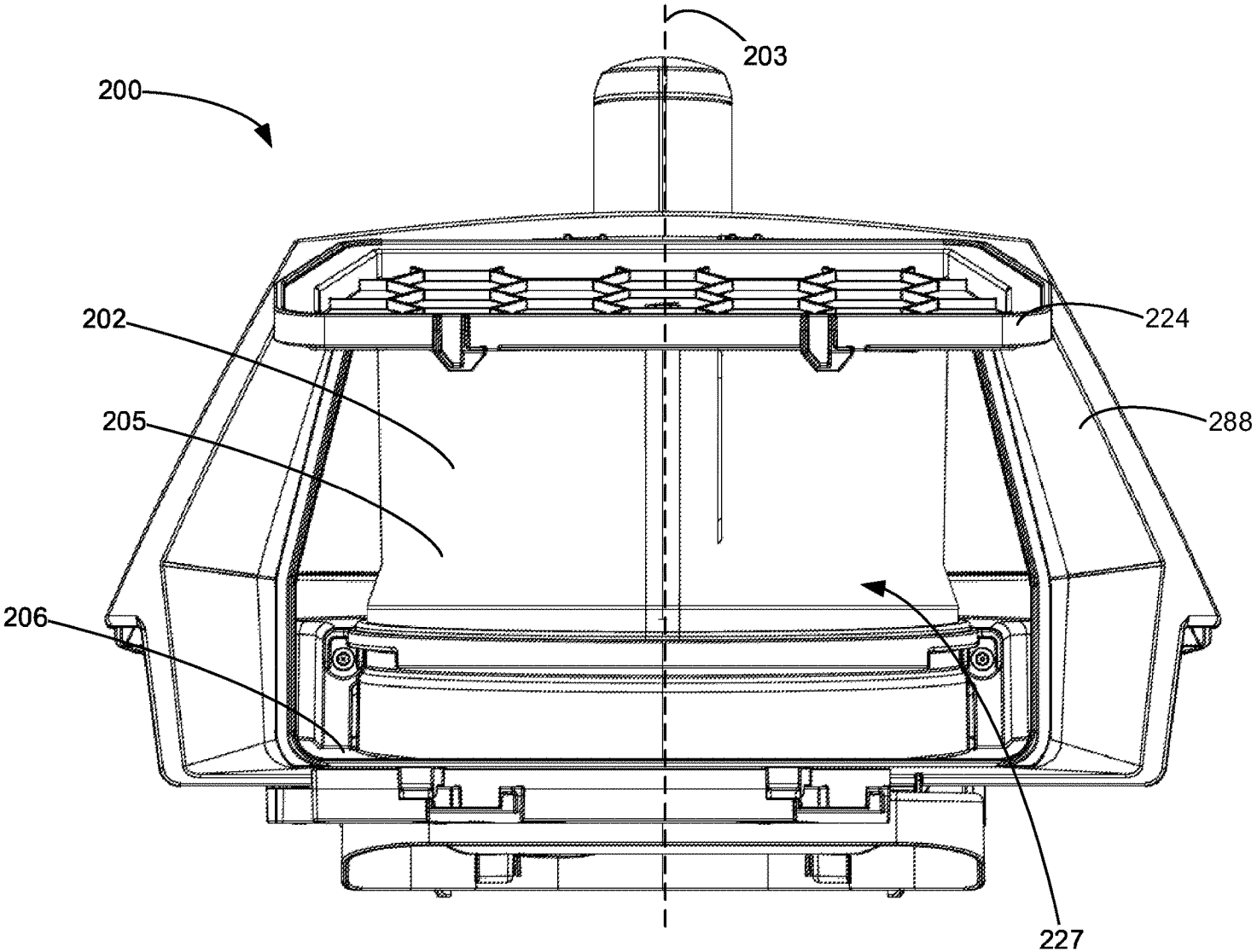
FIG. 22 is a rear view of the air treatment assembly of the surface cleaning apparatus of FIG. 1 with the rear door opened.

In accordance with this aspect, the air treatment assembly has an air treatment member 202 (e.g., cyclone) and a dirt collection chamber 206 exterior to the air treatment member 202. Accordingly, the air treatment member 202 may be referred to as a cyclone 202 and the air treatment assembly 200 may be referred to as a cyclone assembly 200. The air treatment member 202 has an air treatment member axis 203. The air treatment member axis 203 may also be referred to as the cyclone axis of rotation when the air treatment member is a cyclone. The air treatment assembly 200 has a first end 220, an opposed second end 222, and sides extending between the first and second ends wherein the air treatment member axis 203 intersects the first end 220 and the opposed second end 222. When the air treatment member assembly 200 is mounted on the canister body 102 and the canister body 102 is positioned with the lower end 104 on the floor, the air treatment member axis 203 may extend generally vertically. For example, as shown in FIG. 22, the air treatment member axis 203 extends axially through the first end 220 and the second end 222 of the air treatment assembly.

The air treatment assembly and the air treatment member have an air inlet and an air outlet. The air inlet and the air outlet of the air treatment assembly may be the air inlet and the air outlet of the air treatment member, e.g., if the air treatment assembly has a single air treatment member. The air treatment assembly and the air treatment member air inlet(s) and air outlet(s) may be located at any location of the air treatment assembly and the air treatment member. For example, they may each be at the lower end of the air treatment member as exemplified. In alternate embodiments, they may be provided at any location known in the air.

As exemplified, the air treatment assembly 200 has an air inlet 208 in fluid communication with the cyclone chamber 204, an air outlet 210 in fluid communication with the suction motor 124 and a dirt outlet 212 providing a passage from the cyclone chamber 204 to the dirt collection chamber 206. As exemplified, the air inlet 208 has an inlet port 209 located axially from the first end 220 of the air treatment assembly 200 and exterior to the air treatment assembly 200. As exemplified in FIG. 23, the air inlet 208 and the air outlet 210 of the air treatment assembly 200 are each located at the first (lower) end 220 of the air treatment assembly 200. It will be appreciated that the air inlet 208 and air outlet 210 of the air treatment assembly 200 may be positioned anywhere in the air treatment assembly 200. In some embodiments, as exemplified in FIG. 23, the air outlet 210 may be positioned such that a projection of the air outlet intersects the first end 220. Similarly, the dirt outlet 212 may be of any configuration and provided at any location as is known in the art.

Figure 21:
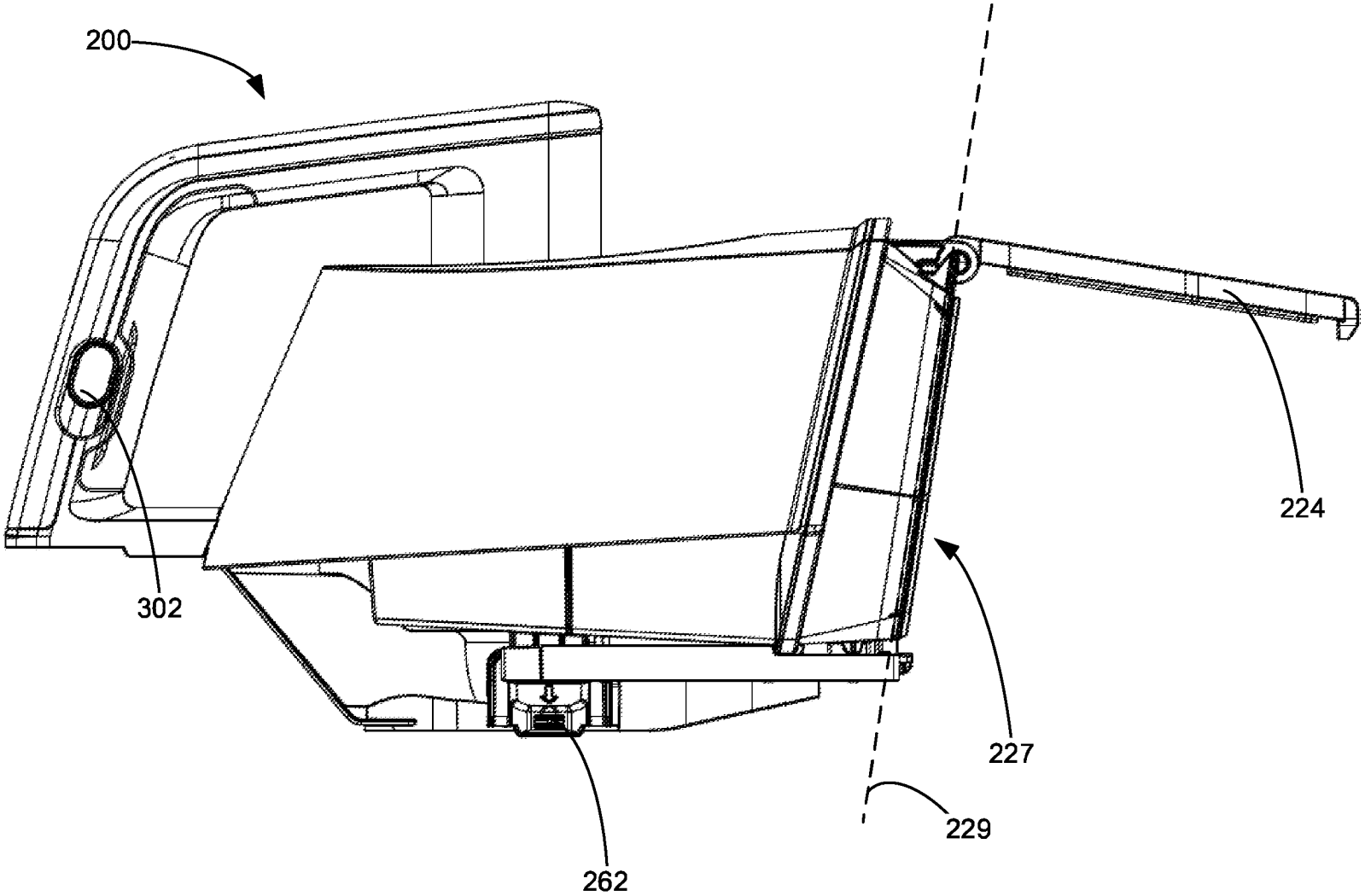
FIG. 21 is a side view of the air treatment assembly of the surface cleaning apparatus of FIG. 1 with a rea door opened.

Referring to FIG. 21, as exemplified, one of the sides 224 of the air treatment assembly is openable. The openable side 224 of the air treatment assembly 200 may also be referred to as a door 224. It will be appreciated that the openable side 224 of the air treatment assembly 200 may be any side. For example, as exemplified in FIGS. 18-23, the sides of the air treatment assembly 200 include a front side 226, a rear side 228, a first side 230, and a second side 232. When the surface cleaning apparatus 100 faces forwards, the first side 230 and the second side 232 may also be referred to as the left and right sides respectively. As exemplified in FIGS. 21-22, the rear side 228 of the air treatment assembly 200 is openable such that the dirt collection chamber 206 is opened when the rear side 228 of the air treatment assembly 200 is opened. It will be appreciated that the door may comprise all or only a part of the side that is openable.

Figure 18:
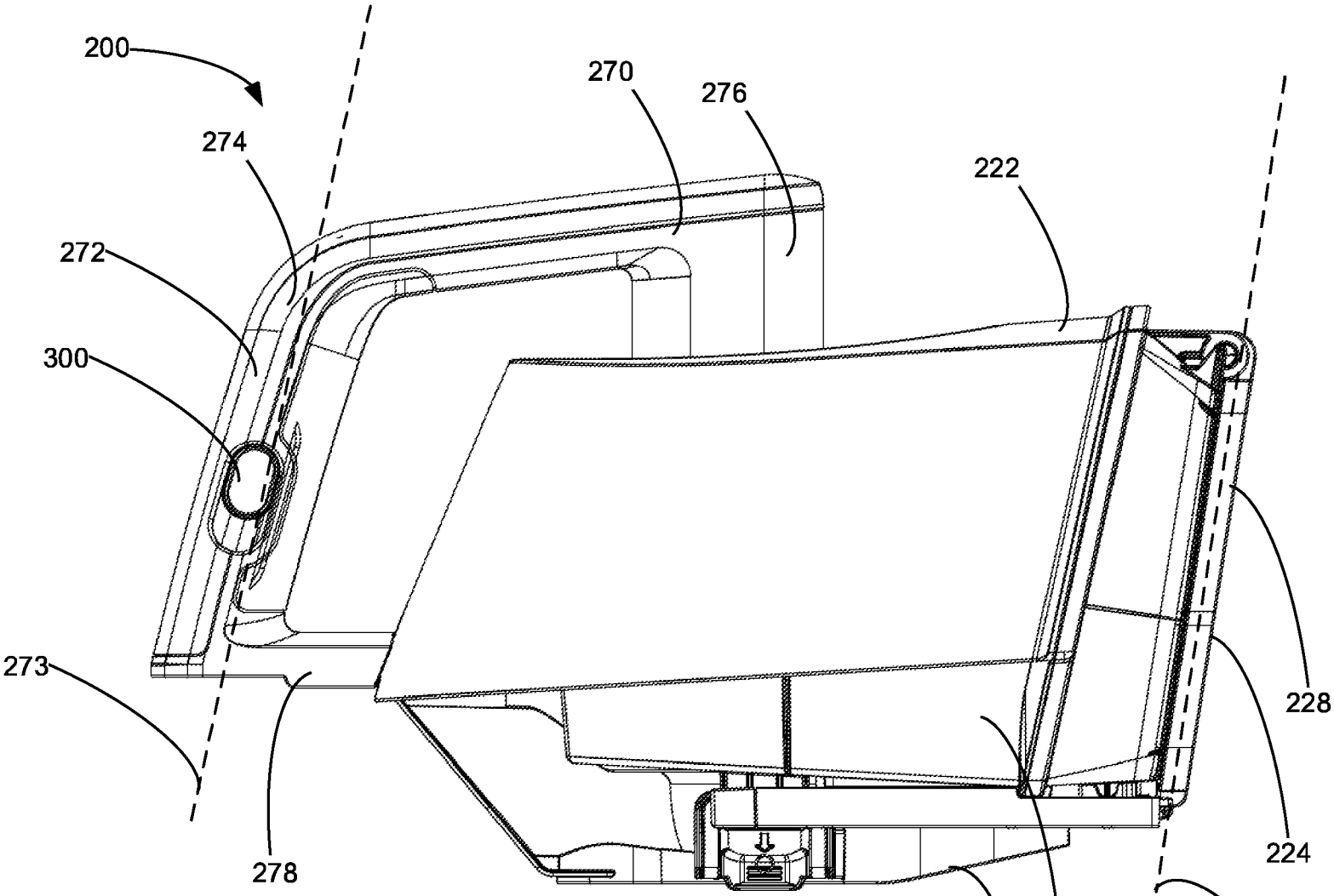
FIG. 18 is a side view of the air treatment assembly of the surface cleaning apparatus of FIG. 1.
Figure 19:
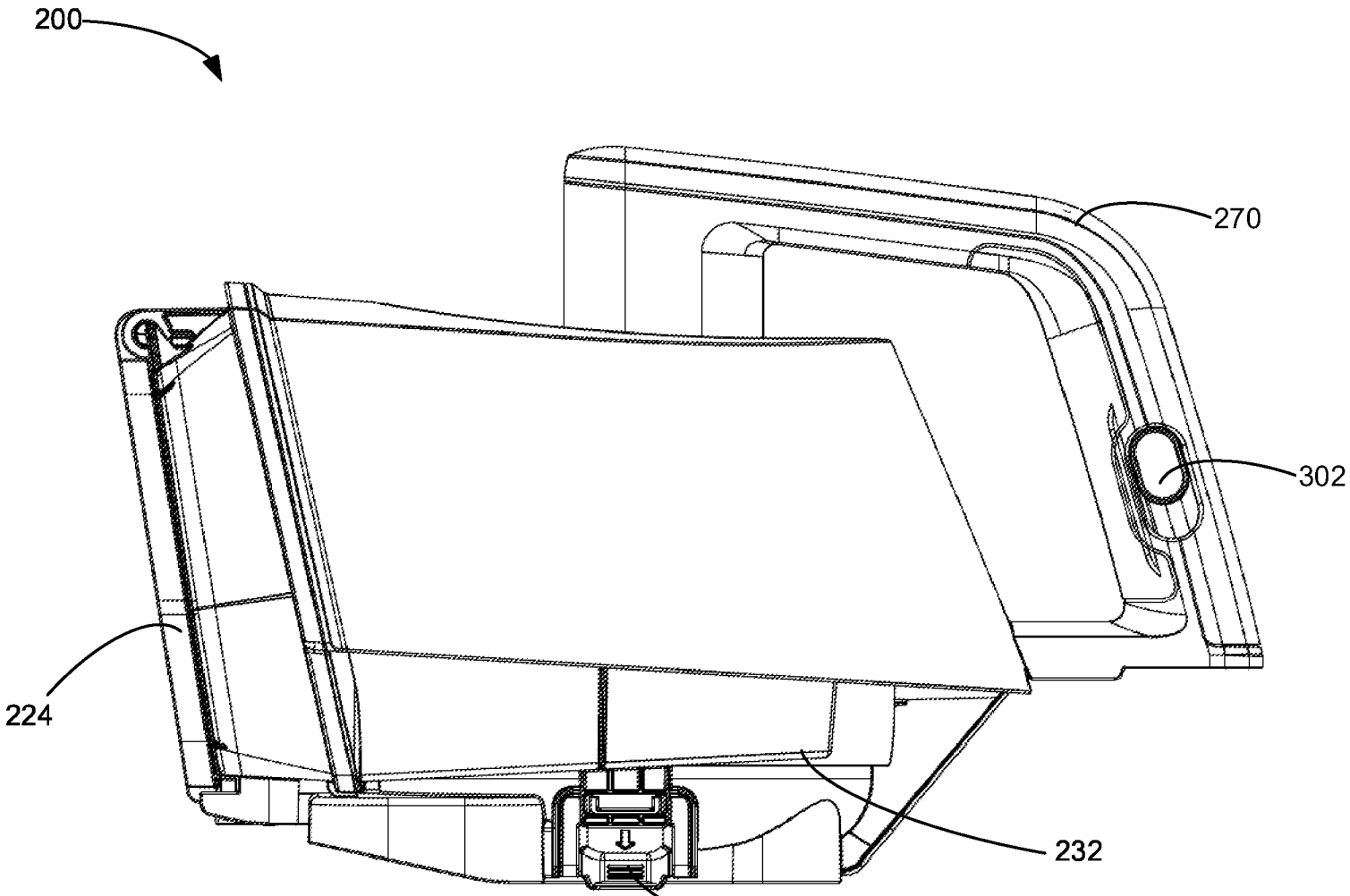
FIG. 19 is a side view of the opposite side of the air treatment assembly of the surface cleaning apparatus to that shown in FIG. 18.
Figure 20:
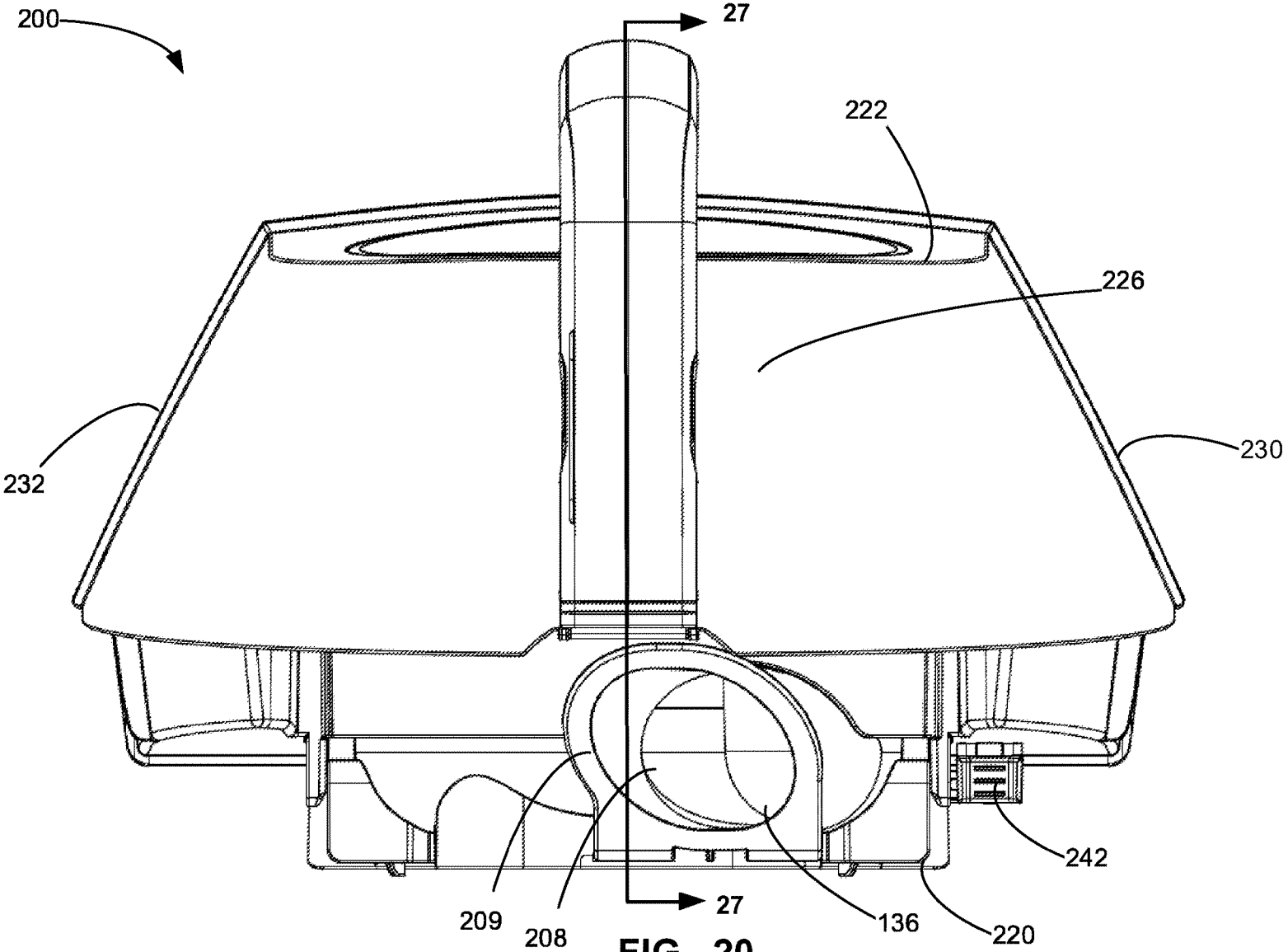
FIG. 20 is a front view of the air treatment assembly of the surface cleaning apparatus of FIG. 1.

The rear side 228 of the air treatment assembly 200 is movable between a closed position, as exemplified in FIGS. 18 and 19, and an open position, as exemplified in FIGS. 21 and 22. As shown, the openable side 224 is moveably mounted to the air treatment assembly by a mount 234. Any moveably mounted, such as a pivot mount, may be used. As exemplified, the mount 234 is provided at the second end 222 of the air treatment assembly 200, however, it may be provided at any other location, such as at the first end 220. Providing the mount 234 at the second end 222 may improve the ability to empty the dirt collection chamber 206 since, when opened, the door 224 does not block the dirt from exiting the dirt collection chamber 206 as the dirt slides out from the dirt collection chamber 206.

The first side 230, second side 232, front side 226, and rear side 228 of the air treatment assembly 200 may extend in any direction between the first end 220 and the second end 222. For example, as exemplified in FIGS. 18-23, the sides of the air treatment assembly 200 extend in a direction generally parallel to the air treatment member axis 203. In some embodiments, the front side 226 and the rear side 228 may extend in a direction generally parallel to the air treatment member axis 203 while the first side 230 and the second side 232 may extend in a direction at an angle to the air treatment member axis 203.

Figure 45:
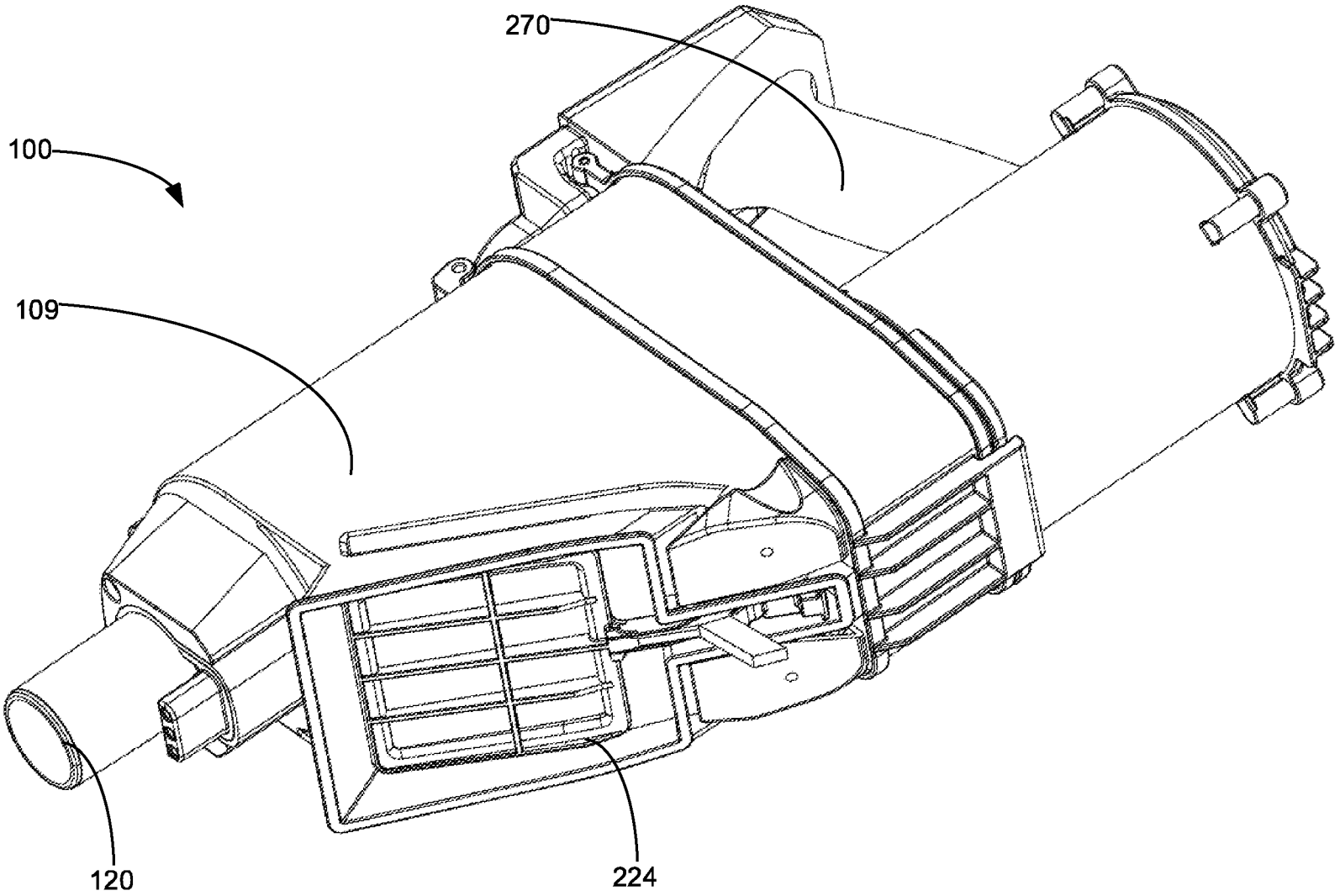
FIG. 45 is a front perspective view a surface cleaning apparatus in accordance with another embodiment with a door closer.
Figure 46:
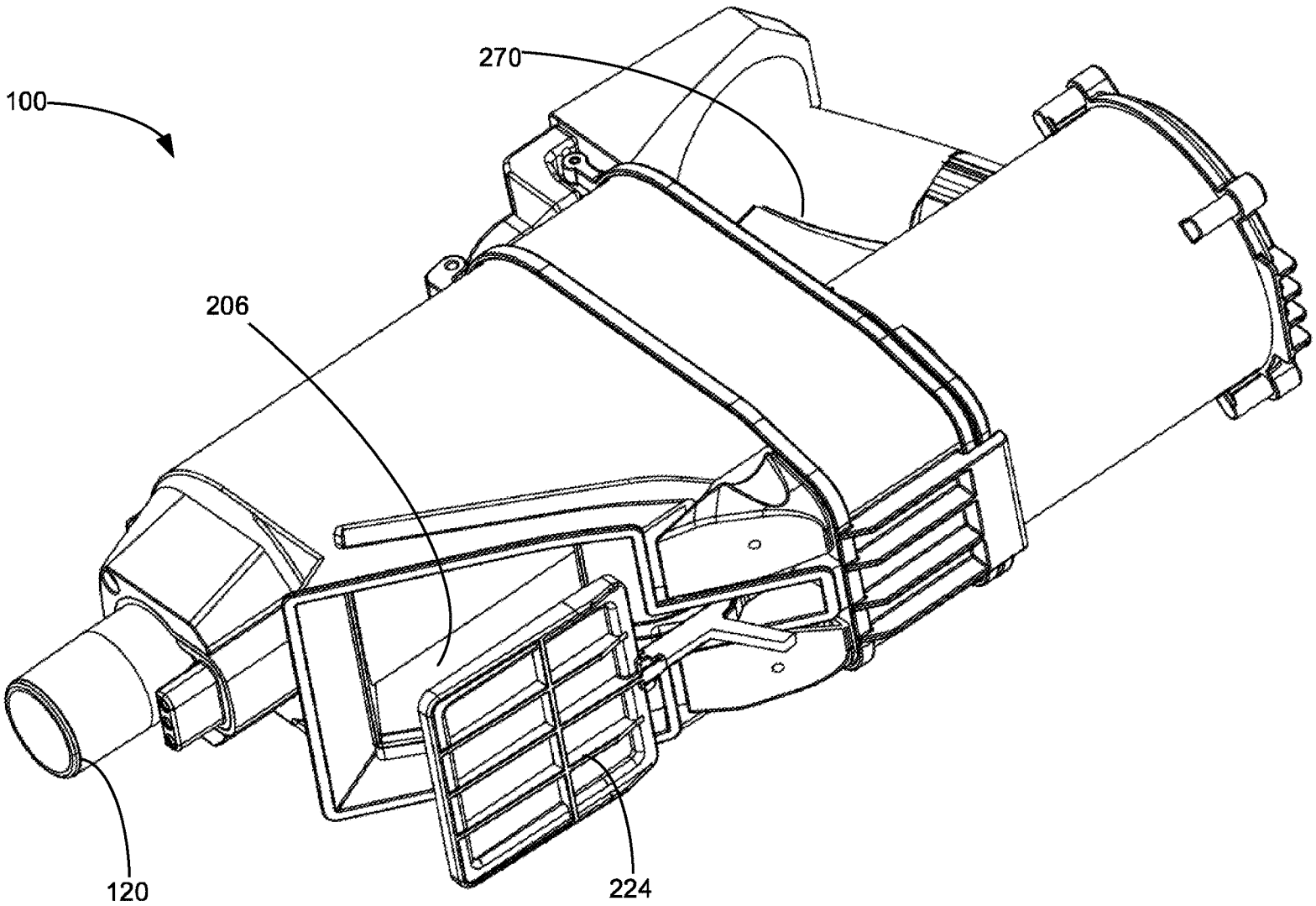
FIG. 46 is a front perspective view of the surface cleaning apparatus of FIG. 45 with the door opened; and, FIG. 47 is a cross-sectional view of the surface cleaning apparatus of FIG. 45.
Figure 47:
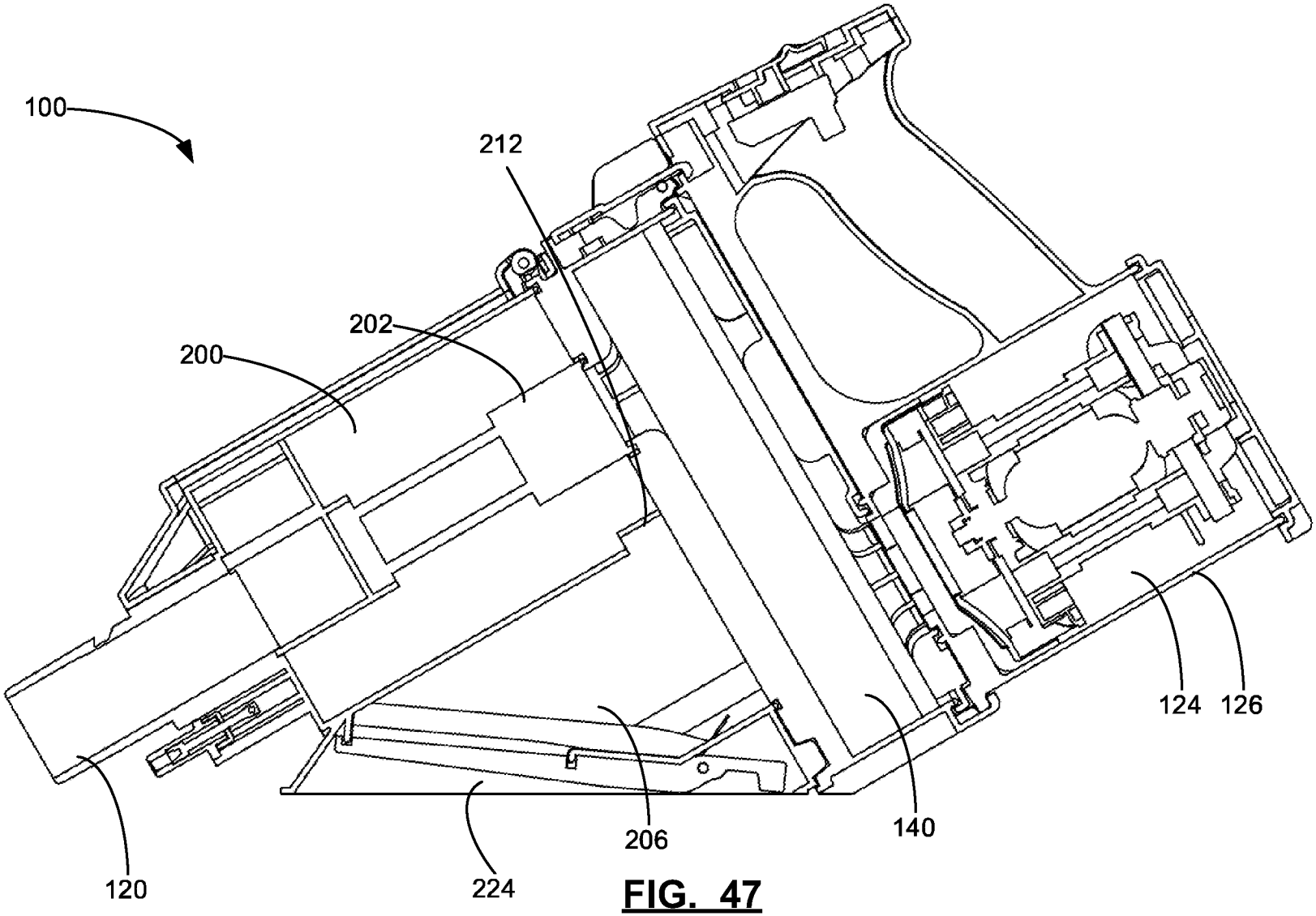

Accordingly, for example, the openable side need to extend at a 90° angle to the first and/or second ends 220, 222. For example, as exemplified in FIGS. 45 to 48, the openable side of the air treatment assembly 200 may be an angled side. For example, as shown in FIG. 45, the door 224 is located on an angled side of the surface cleaning apparatus 100 and is in the closed position. As exemplified in FIG. 46, the angled side is opened.

Figure 27:
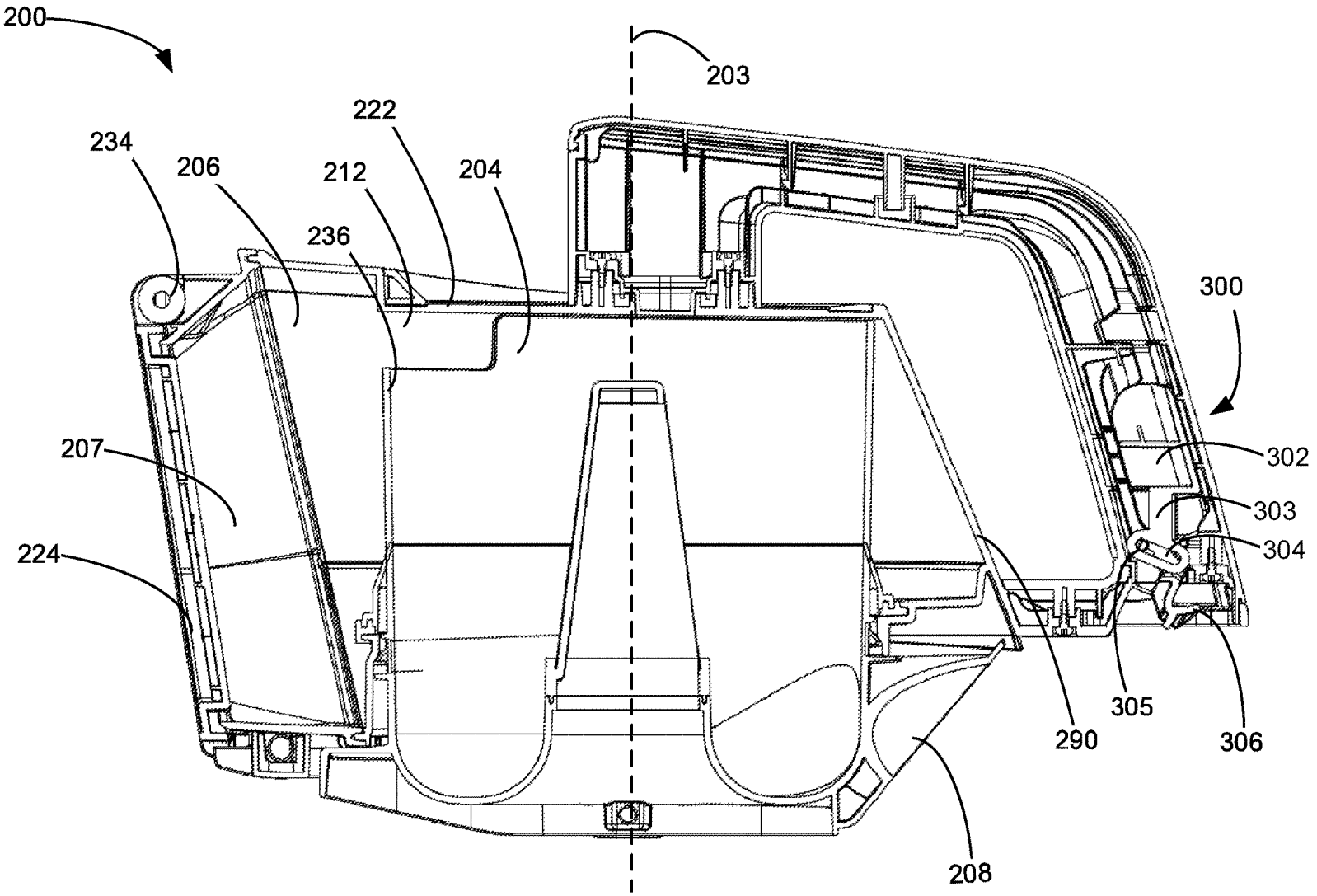
FIG. 27 is a cross-sectional side view of the air treatment assembly of the surface cleaning apparatus of FIG. 1 along the line 27-27 in FIG. 20 with the air treatment assembly locked.

The dirt outlet 212 may be positioned anywhere in the air treatment assembly 200. As exemplified, the dirt outlet 212 faces the openable side, the rear side 228 of the air treatment assembly 200 as exemplified. For example, as shown in FIG. 27, the air treatment member 202 has a sidewall 236 and the dirt outlet 212 is positioned between the sidewall 236 and the second end 222 of the air treatment assembly 200. In some embodiments, the dirt outlet 212 may be positioned between the sidewall 236 and the first end 220 of the air treatment assembly 200. The dirt outlet 212 may be any shape or size. For example, as shown, the dirt outlet 212 is a slot provided in the sidewall of the cyclone chamber. In some embodiments, the dirt outlet 212 may be a plurality of slots, an open end of the cyclone chamber that is spaced from an end wall or any other design known in the art.

It will be appreciated that the openable side 224 of the air treatment assembly 200 may be any shape and/or size. For example, the openable side 224 may form a wall 224 of the dirt collection chamber 206, as exemplified in FIG. 27. The door 224 may be generally planar. For example, when the air treatment assembly 200 is mounted on the canister body 102 and the door 224 is in the closed position, the door 224 may extend generally vertically. As exemplified in FIG. 18, the door 224 may extend in a plane 225 that is generally parallel to the air treatment member axis 203. In some embodiments, the door 224 may extend in a plane that is at an angle to the air treatment member axis 203.

The air treatment assembly 200 may include a door lock 240 for maintaining the door 224 of the air treatment assembly 200 in the closed position and a door actuator 242 for unlocking the door lock 240. Accordingly, the door may remain closed when the air treatment assembly is removed for emptying. The door lock 240 may be any locking mechanism known in the art and may use male and female engagement members wherein one of the members, e.g., the female member, is moveable by an actuator.

As exemplified in FIGS. 32 to 37, the door actuator 242 includes a first portion 244 and a second portion 246 perpendicular to the first portion 244. The first portion 244 includes a door actuator 242 and a first angled surface 245 distal to the door actuator 242. The second portion 246 has a corresponding second angled surface 247 that is slideably positioned proximate to the first angled surface 245. The second portion 246 has second portion engagement members 250 which engage with corresponding male door engagement members 252 provided on the door. The door lock 240 is provided by the door engagement members 252 engaging with the second portion engagement members 250. As exemplified in FIGS. 36-37, the first portion 244 may include a biasing member 254 positioned between the door actuator 242 and the first angled surface 245. The air treatment assembly 200 includes a biasing member stop 256 that operates with the biasing member 254 to bias the door actuator 242 to the unpushed or locked position.

When the door 224 is in the closed position, the door engagement members 252 are engaged with the second portion engagement members 250. As exemplified, when in the locked position, the second portion engagement members seat on rear surface 252*a* of the angled cam surface 252*b* of the door engagement members 252 (See FIG. 34). To move the door 224 to the open position, the door actuator 242 is pushed, thereby sliding the first angled surface 245 of the first portion 244 against the second angled surface 247 of the second portion 246 and compressing the biasing member 254 against the biasing member stop 256. As the first angled surface 245 pushes against the second angled surface 247, the second angled surface 247 is displaced in a direction perpendicular to the first portion 244, parallel to the second portion 246 (to the left as exemplified in FIG. 34). The second portion engagement members 250 are then disengaged (slid sideways) from the door engagement members 252, which unlocks the door 224, thereby allowing the door 224 to move to the open position.

Once the door 224 is opened, the user may stop pushing the door actuator 242, thereby causing the biasing member 254 to move the door actuator 242 and first portion 244 back to the unpushed position. It will be appreciated that the second portion 246 may be biased to the locked position by a second biasing member (not shown) or may be linked to the first portion so as to be pulled back by the first portion to the locked position due to the biasing force of biasing member 254. Accordingly, the second portion engagement members 250 are moved back (to the right as exemplified in FIG. 34) to the locked position such that when the user closes the door 224, the second portion engagement members 250 engage the door engagement members 252 to lock the door 224 in the closed position. In operation, the angled cam surface 252*b* of the door engagement members 252 may push the second portion engagement members 250 sideways (to the left in FIG. 34) to allow the angled cam portion 252*b* to move inwardly past the second portion engagement members 250 and the second portion engagement members 250 may then return (to the right in FIG. 34) to the locked position.

At least a portion 207 of the dirt collection chamber 206 may be positioned between the air treatment member 202 and the openable door 224. For example, the portion 207 of the dirt collection chamber 206 between the air treatment member 202 and the openable door 224 of the air treatment assembly 200 may be at least 40%, 50%, 60%, 70%, 80% or 90% of the dirt collection chamber 206. Positioning the majority of the dirt collection chamber 206 between the air treatment member 202 and the openable door 224 may improve the emptying process of the surface cleaning apparatus 100. For example, positioning all or the largest portion of the dirt collection chamber 206 between the air treatment member 202 and the openable door 224 may make it easier to empty dirt from the dirt collection chamber 206.

Removable Air Treatment Member

In accordance with this aspect, which may be used by itself or in combination with one or more other aspects, the air treatment member 202 is removably mounted in the air treatment assembly 200. An advantage of this aspect is that the air treatment member 202 and air treatment member assembly 200 may be more easily cleaned. For example, hair may build up around the air treatment member 202 over time. The user may remove the air treatment member 202 from the air treatment member assembly 200 to more easily remove the built-up hair. Similarly, once the air treatment member 202 has been removed, the user may more easily clean the air treatment assembly 200.

As exemplified in FIGS. 24-26 and 40, the cyclone 202 has been removed from the cyclone assembly 200. The air treatment member 202 may be axially removable through one of the first end 220 and the second end 222 of the air treatment assembly 200. As exemplified in FIG. 40, the air treatment member 202 is removably mounted through the first end 220 of the air treatment assembly 200.

In some embodiments, the air treatment member 202 may be removable in a direction relative to an opening 227 of the dirt collection chamber 206 formed when the door 224 is opened. For example, as exemplified in FIGS. 21 and 22, when the door 224 is opened, the opening 227 is formed in the dirt collection chamber 206 that faces in a first direction (horizontally as exemplified in FIG. 21). The air treatment member 202 may be removable in a direction that is generally transverse to the first direction. For example, as shown, the air treatment member 202 may be axially removable (downwardly as exemplified in FIG. 21). In other words, as shown in FIG. 21, the dirt collection opening extends in a plane 229 and the air treatment member 202 is removable in a direction generally transverse to the plane 229.

The air treatment assembly 200 may include an air treatment member lock 260 for securing the air treatment member 202 within the air treatment assembly 200. As exemplified in FIG. 25, the air treatment member lock 260 has an air treatment member release actuator 262. The air treatment release actuator 262 may be used to unlock the air treatment member lock 260 such that the air treatment member 202 may be removed from the air treatment assembly 200.

Figure 25:
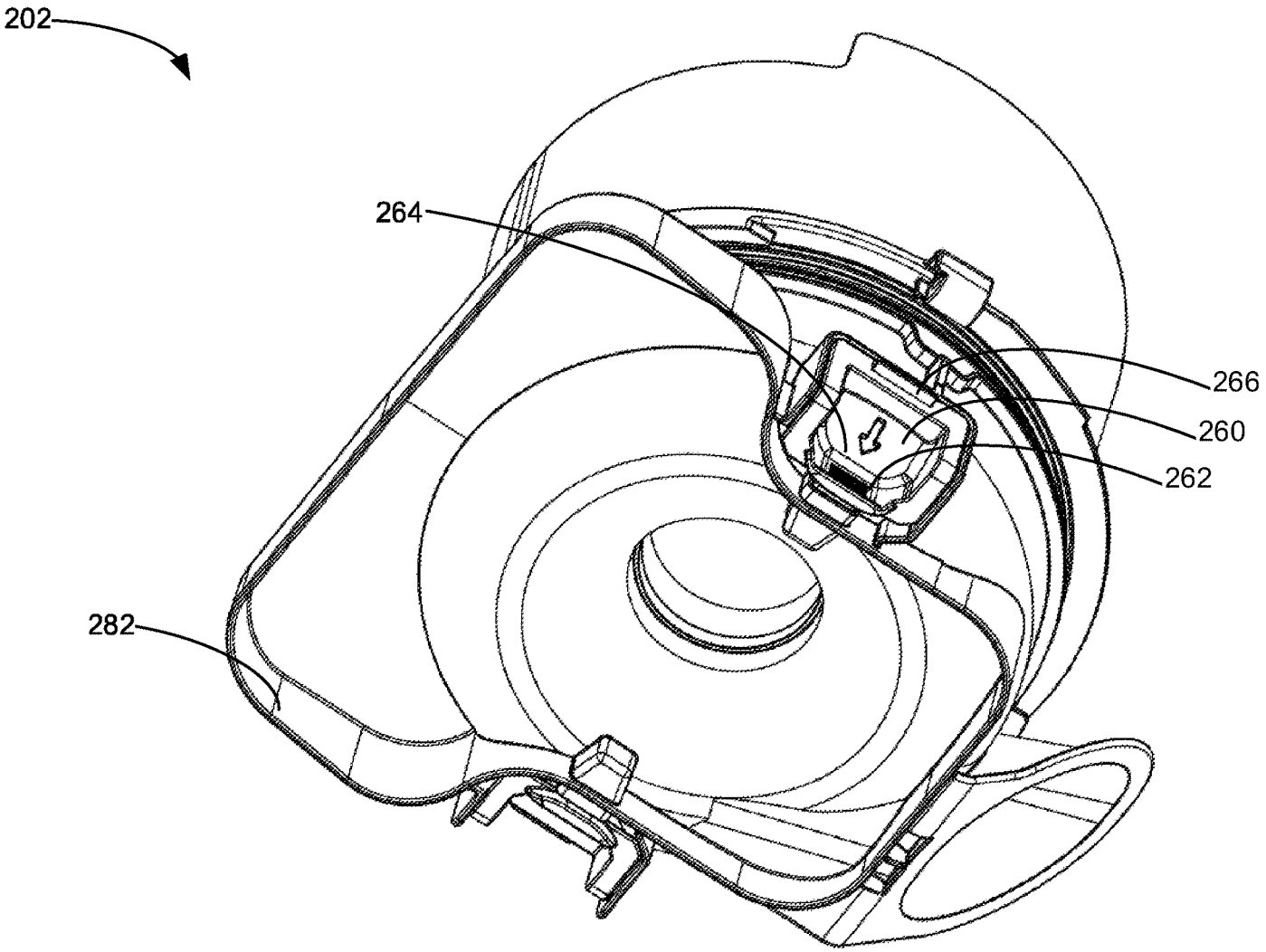
FIG. 25 is a bottom perspective view of an air treatment member of FIG. 24.
Figure 26:
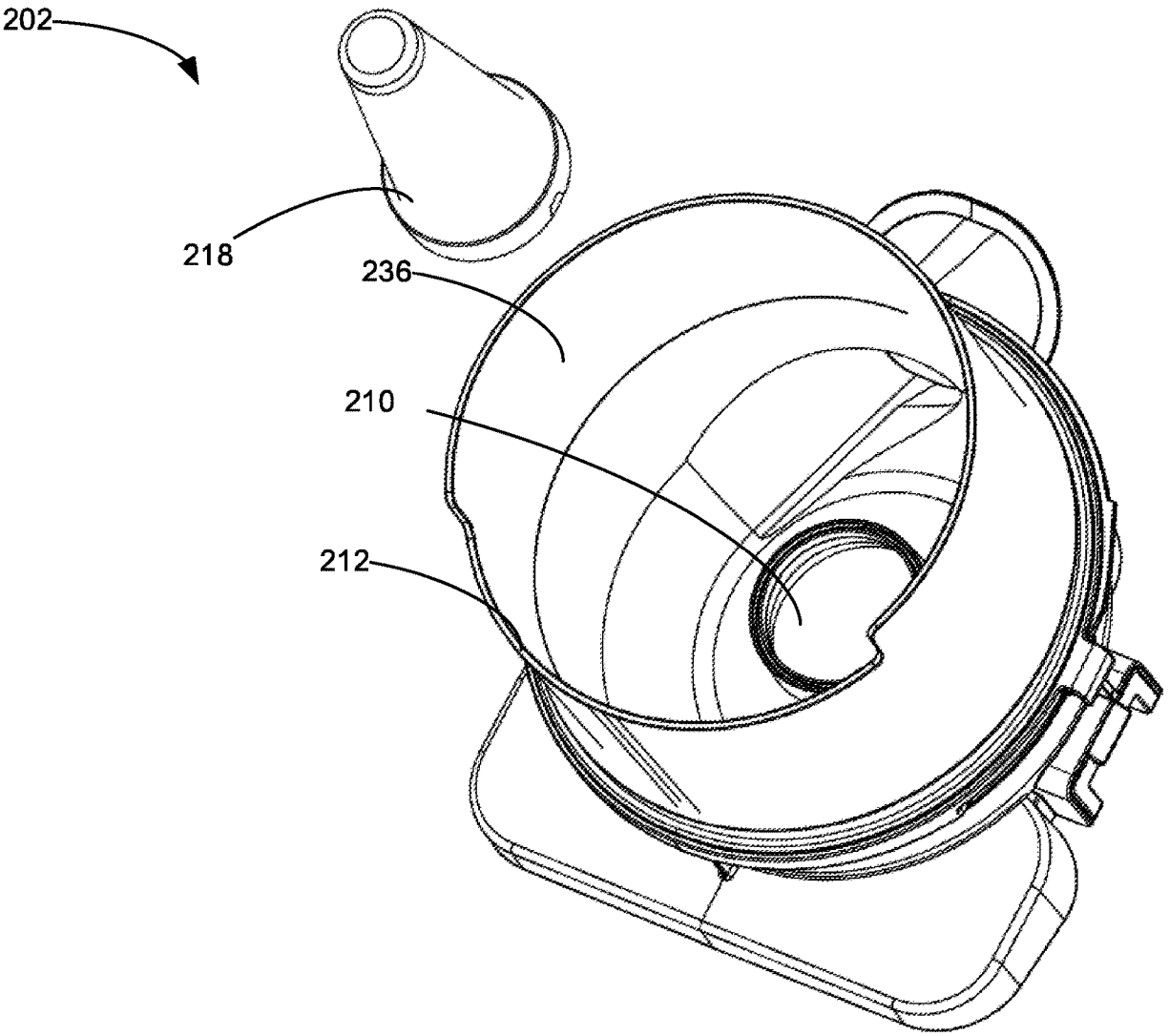
FIG. 26 is a top perspective view of the air treatment member of the surface cleaning apparatus of FIG. 1 with the vortex finder removed.

The air treatment member release actuator 262 may be positioned anywhere in the air treatment assembly 200. For example, as shown in FIG. 25, the air treatment member release actuator 262 is located at the first end 220 of the air treatment assembly 200 and includes a first air treatment member release actuator 262 and a second air treatment member release actuator 262. As exemplified, the first air treatment release actuator 262 and the second air treatment release actuator 262 are located below the first end 220 of the air treatment assembly 200.

As exemplified, the air treatment member release actuators 262 are slide locks having a slidable portion 264 and an air treatment member release engagement member 266. The air treatment member release engagement member 266 engages with a corresponding air treatment assembly engagement member 268 such that when the air treatment member release engagement member 266 is engaged with the air treatment assembly engagement member 268, the air treatment member 202 is secured within the air treatment assembly 200, as exemplified in FIG. 40. The air treatment member release actuators 262 may be biased to the locked position by a biasing member (not shown).

To release the air treatment member 202 from the air treatment assembly 200, a user may pinch the first air treatment member release actuator 262 and the second air treatment member release actuator 262 together, thereby sliding the slide locks 264 inwardly and disengaging the air treatment member release engagement members 266 from the air treatment assembly engagement members 268. Once the air treatment member release actuators 262 are disengaged, the air treatment member 202 may be axially removed through the first end 220 of the air treatment assembly 200. To reinsert the cyclone 202 in the dirt collection chamber, the air treatment member release actuators 262 may be pushed inwardly until the cyclone 202 is in the inserted position. The air treatment member release actuators 262 may then be released and the biasing member may move the air treatment member release actuators 262 to the locked position.

In some embodiments, the air treatment member release actuator 262 may be located axially from the first end 220 of the air treatment assembly 200.

Air Treatment Assembly Handle

In accordance with this aspect, which may be used by itself or in combination with one or more other aspects, the air treatment assembly 200 has a handle 270 having a handle portion 272 that extends generally vertically and is spaced apart from one of the sides of the air treatment assembly 200. Optionally, the handle portion 272 faces a side that is opposed to the openable side.

An advantage of this aspect is that the handle 270 may be the sole handle and may be used by the user to carry the surface cleaning apparatus 100 and/or just the air treatment assembly 200. The handle 270 may also provide the user with greater control to aim the dirt being emptied from the dirt collection chamber 206, particularly if the handle portion 272 faces a side that is opposed to the openable side. Accordingly, the user is less likely to spill dirt being emptied from the dirt collection chamber 206, thereby improving the cleaning process.

Figure 2:
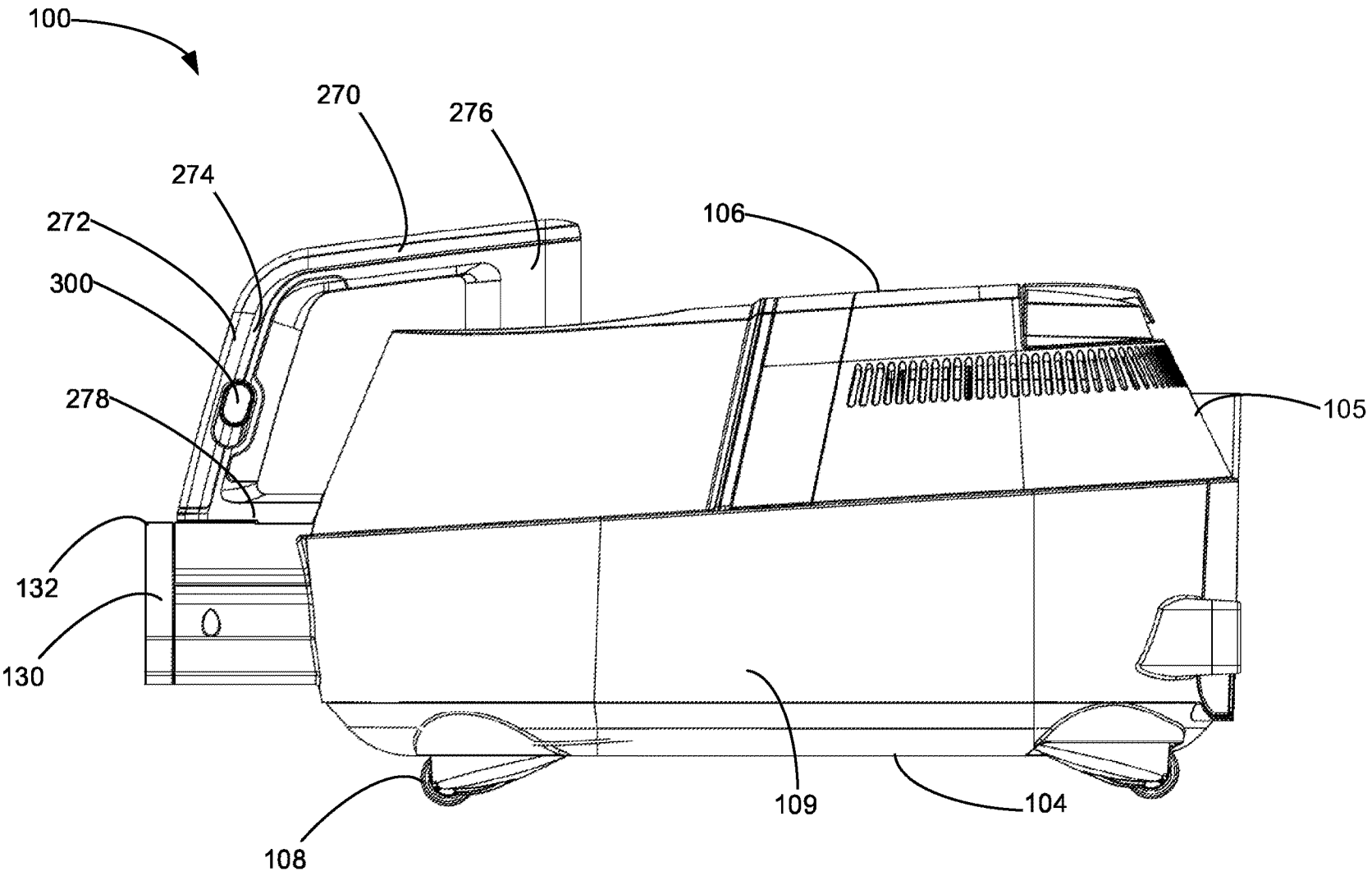
FIG. 2 is a side view of the surface cleaning apparatus of FIG. 1.
Figure 3:
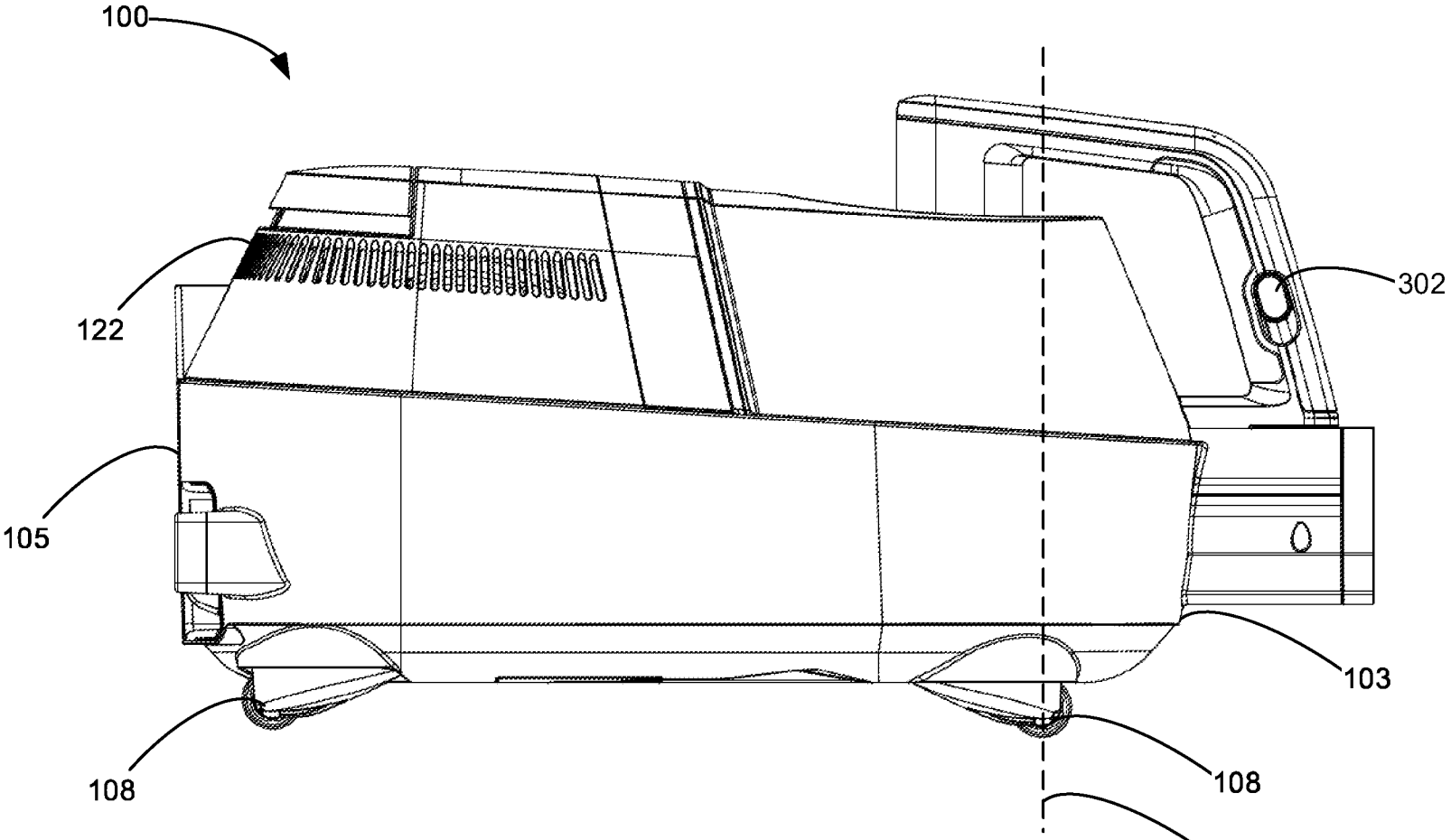
FIG. 3 is a side view of the opposite side of the surface cleaning apparatus to that shown in FIG. 2.
Figure 4:
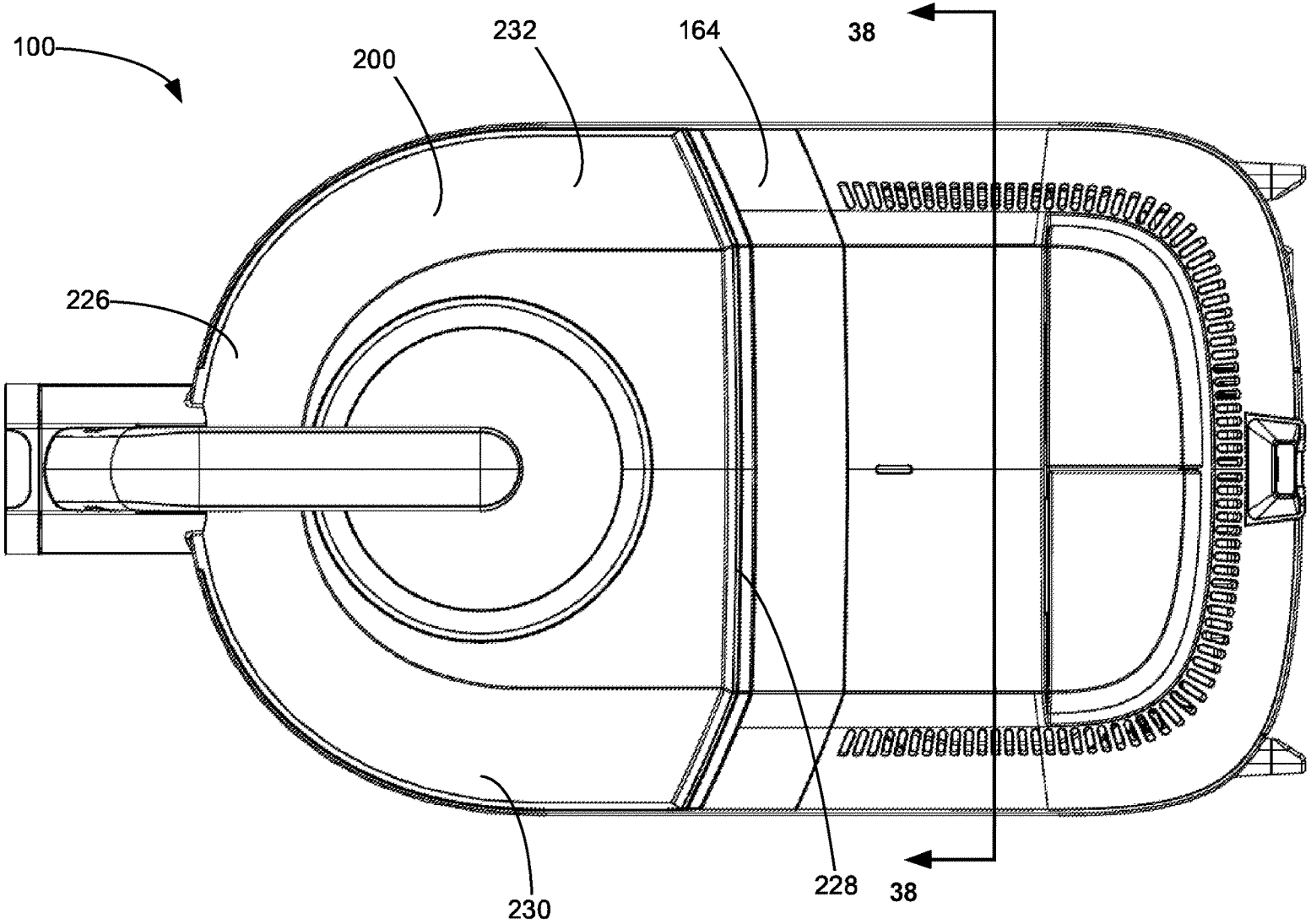
FIG. 4 is a top view of the surface cleaning apparatus of FIG. 1.
Figure 5:
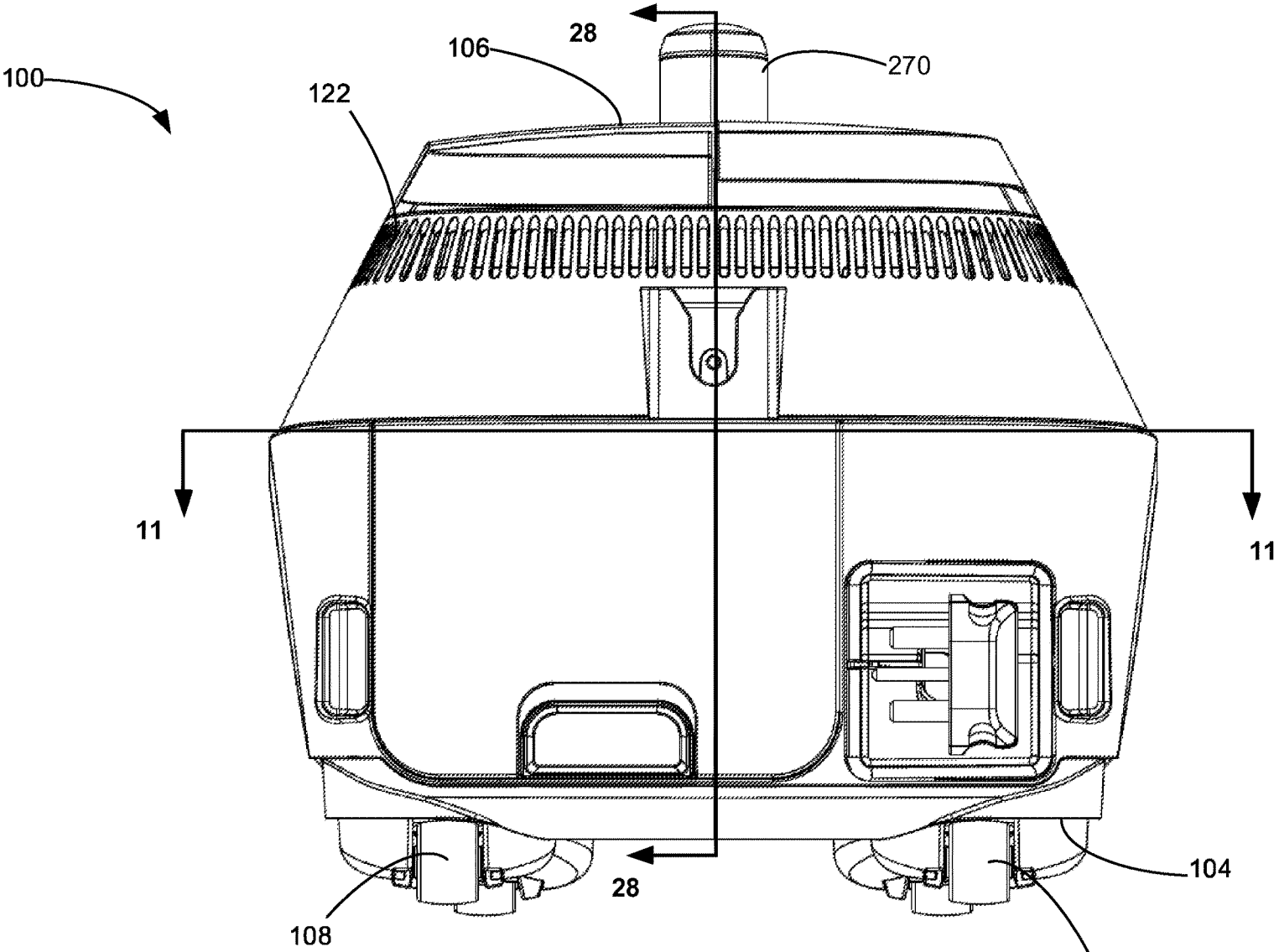
FIG. 5 is a rear view of the surface cleaning apparatus of FIG. 1.
Figure 6:
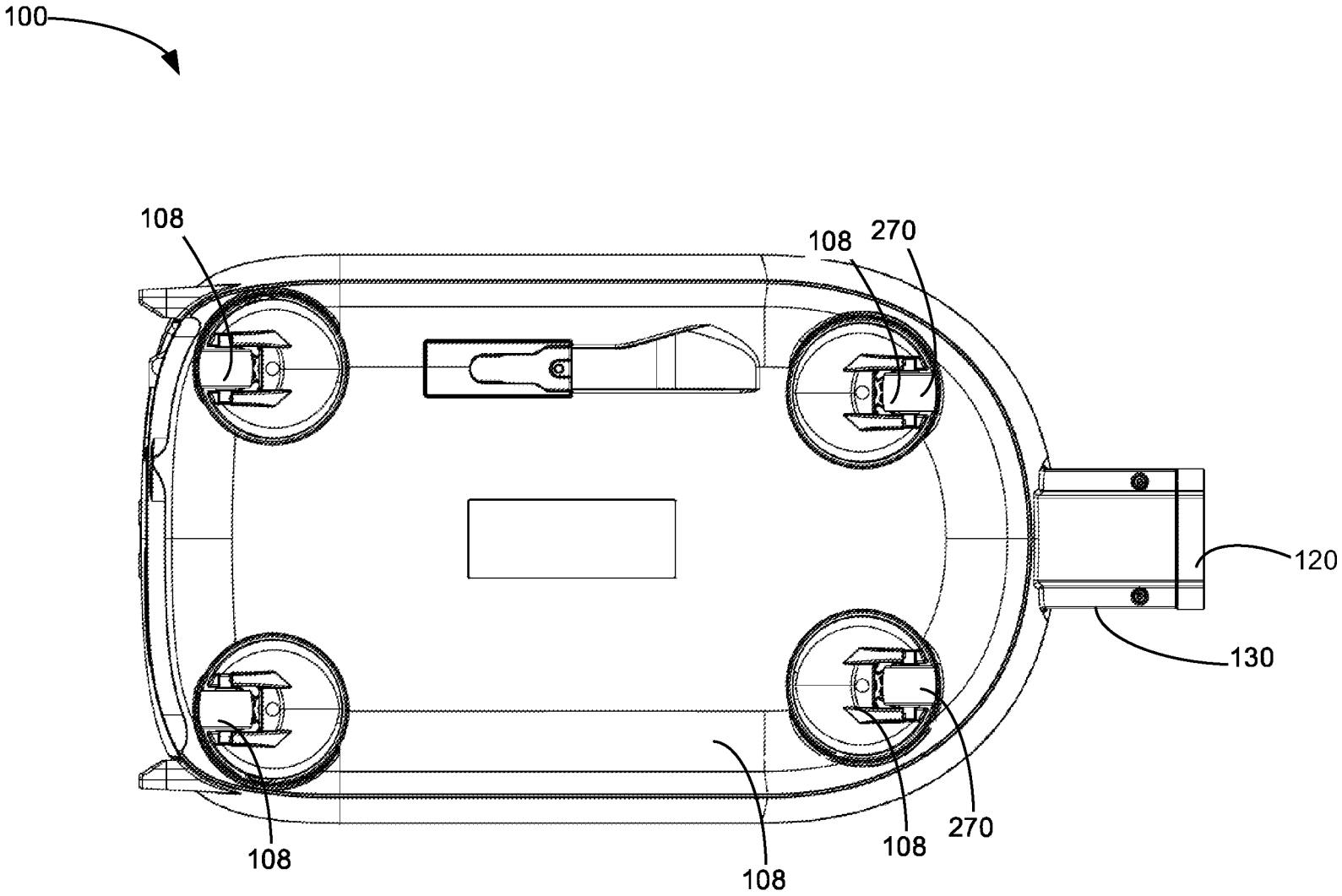
FIG. 6 is a bottom view of the surface cleaning apparatus of FIG. 1.
Figure 7:
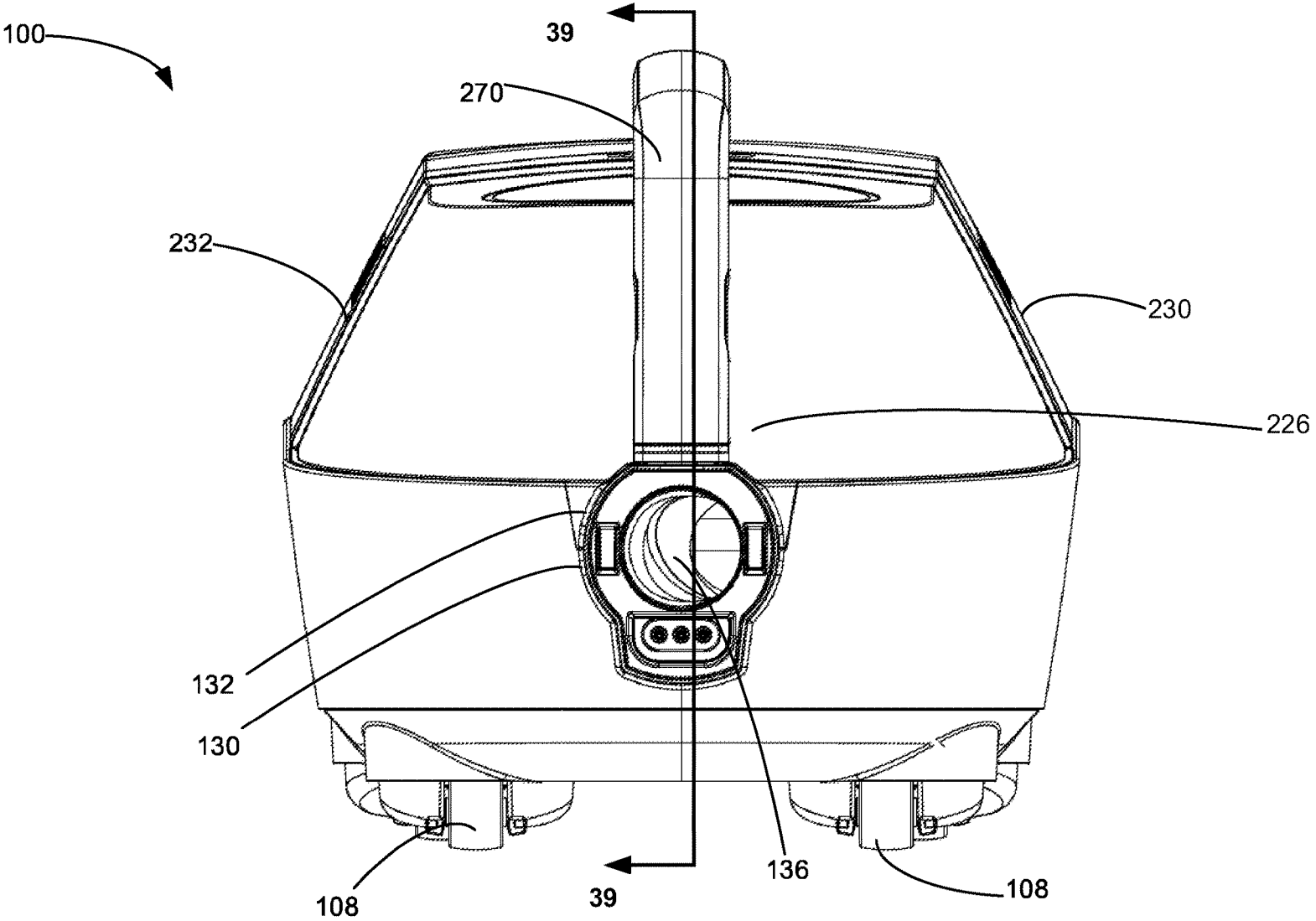
FIG. 7 is a front view of the surface cleaning apparatus of FIG. 1.
Figure 8:
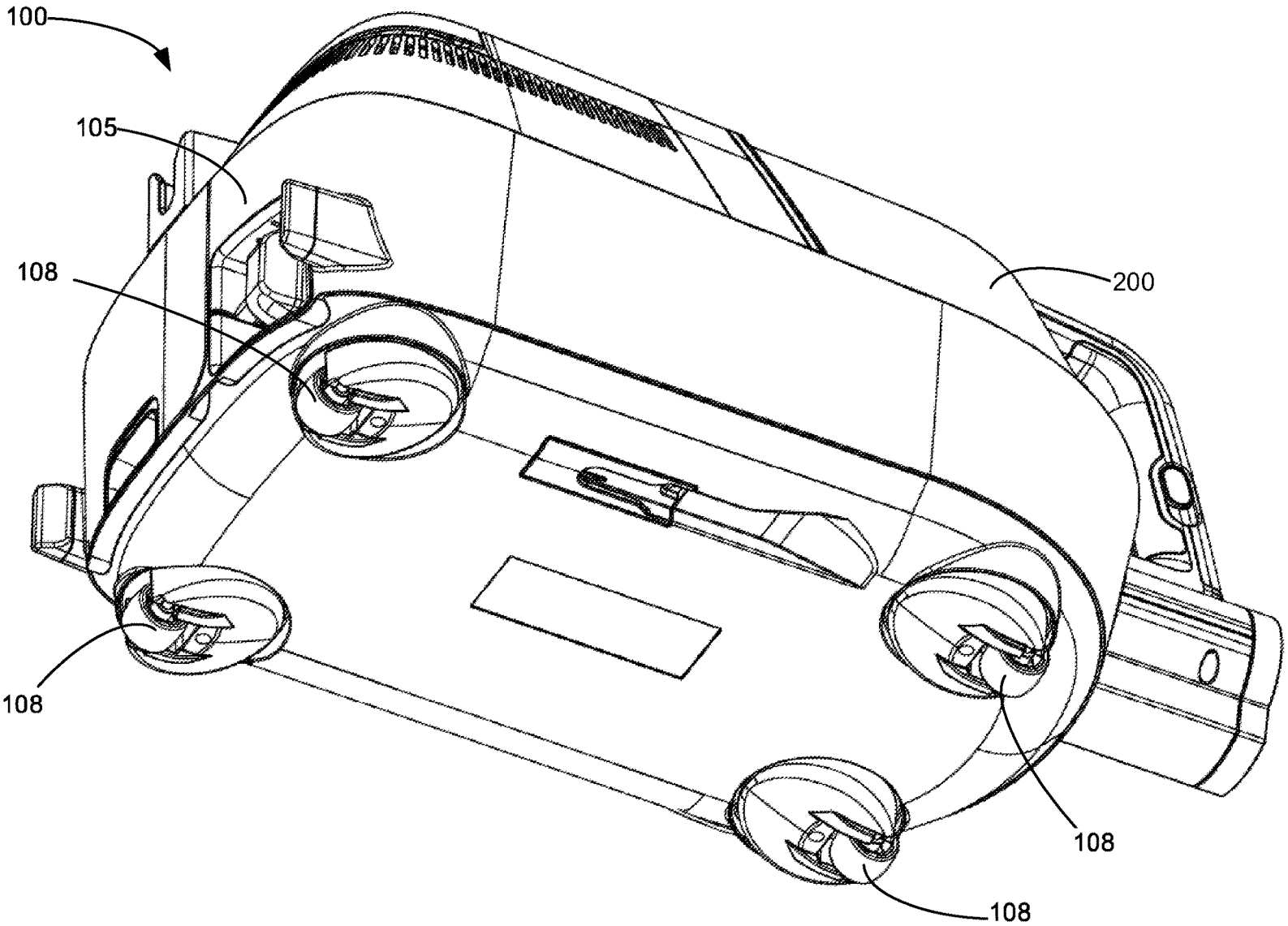
FIG. 8 is a bottom perspective view of the surface cleaning apparatus of FIG. 1.

In accordance with this aspect, the air treatment assembly 200 has a handle 270 having a handle portion 272 facing and spaced apart from one of the air treatment assembly sides. As exemplified in FIG. 18, the handle portion 272 faces the front side 226 of the air treatment assembly 200. When the air treatment assembly 200 is mounted on the canister body 102 and the canister body 102 is positioned with the lower end 104 on a floor, as shown in FIGS. 1 to 3, the handle portion 272 extends generally vertically. As exemplified in FIG. 21, the rear side 228 of the air treatment assembly 200 is openable and is opposed to the front side 226, which faces the generally vertically extending handle portion 272. The handle portion 272 has a handle axis 273. As exemplified, the handle axis 273 may be generally parallel to the air treatment member axis 203. In some embodiments, the handle axis 273 may extend at an angle to the air treatment member axis 203.

The generally vertically extending handle portion 272 may include a pistol grip portion 274 or may consist essentially of the pistol grip portion 274. For example, as shown in FIG. 18, the handle 270 has an upper arm portion 276 extending outwardly from the second end 222 of the air treatment assembly 200 and which extends to the second end 222 of the air treatment assembly and a lower arm portion 278 extending outwardly from the front sidewall of the air treatment assembly 200. As exemplified, the pistol grip portion 274 of the handle portion 272 is located between the upper arm portion 276 and the lower arm portion 278. It will be appreciated that one or both of the upper arm portion 276 and the lower arm portion 278 may be mounted to a common sidewall or, alternately, each may be mounted to an end 220, 222.

Figure 16:
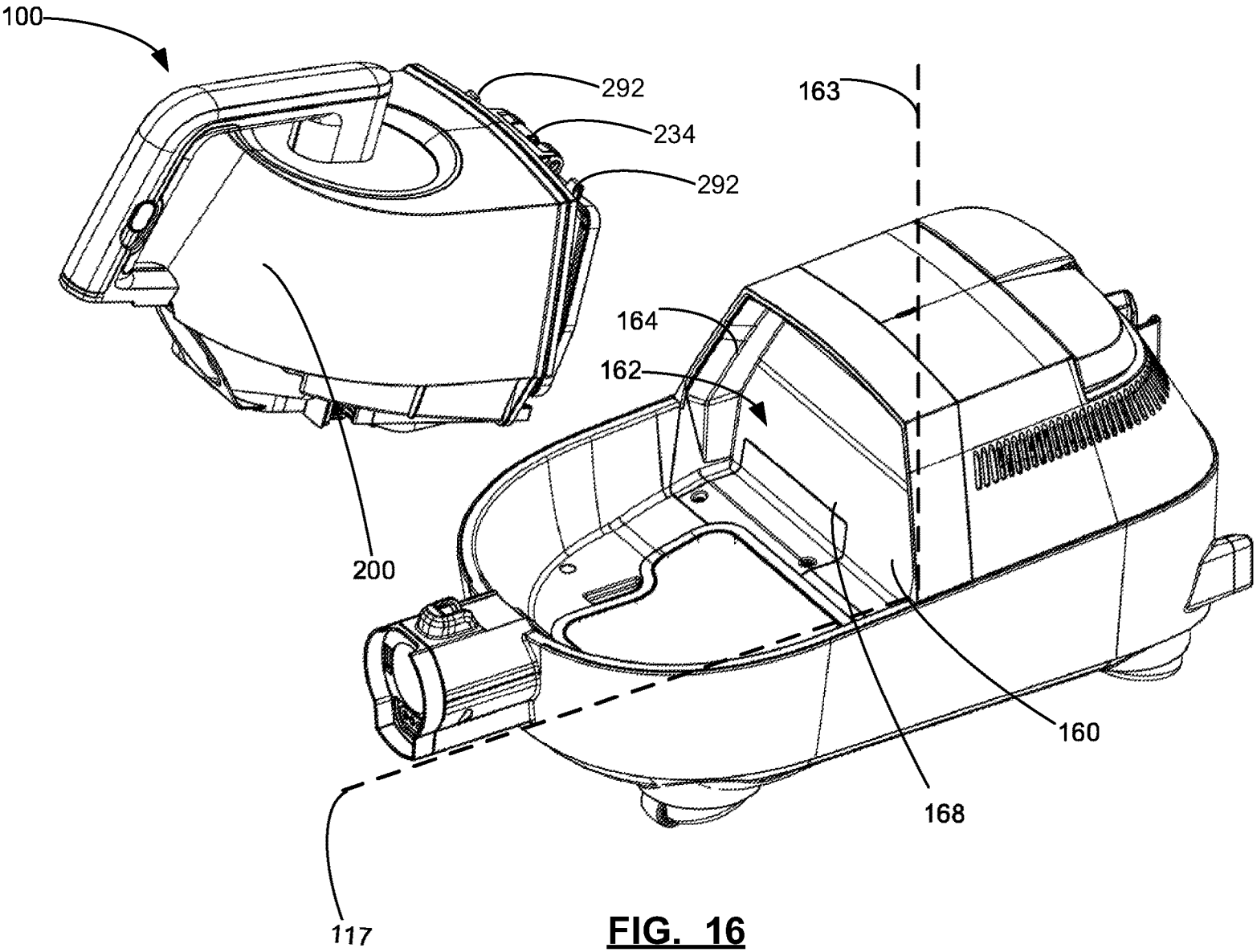
Figure 17:
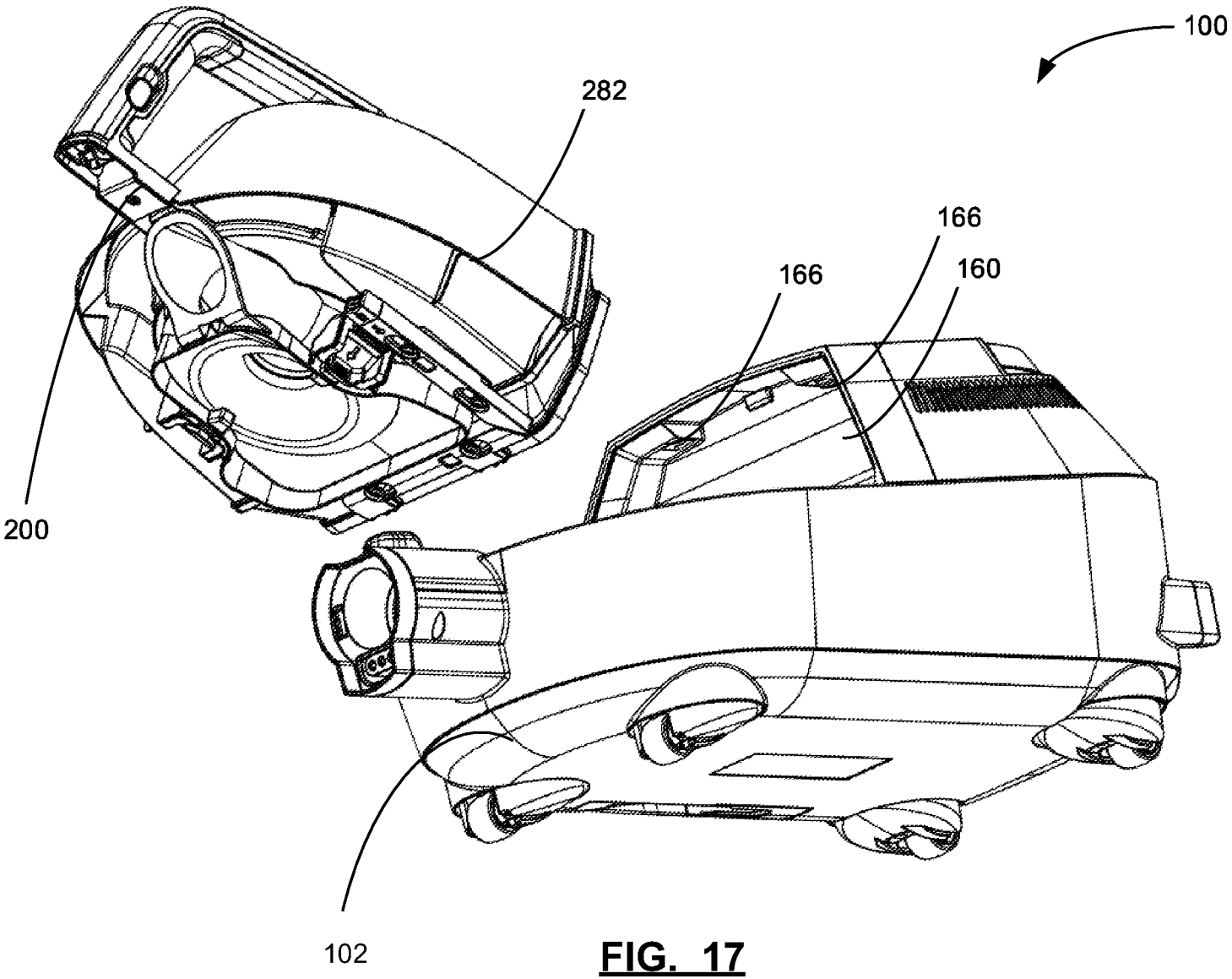
FIG. 17 is a bottom perspective view of the surface cleaning apparatus of FIG. 1 with the air treatment assembly removed.

Referring now to FIGS. 16 and 17, as exemplified, the canister body 102 has a wall 160. As shown, the wall 160 faces the front 103 of the surface cleaning apparatus 100. When the air treatment assembly 200 is mounted to the canister body 102, the rear side 228 of the air treatment assembly 200 may be positioned facing the front facing wall 160 of the canister body 102, with the generally vertically extending handle portion 272 positioned facing the front side 226 of the air treatment assembly 200.

As discussed in more detail subsequently, the wall 160 may be provided at a rear end of wall recess 162 and wall recess 162 may be used to assist the user with positioning the air treatment assembly 200 in the canister body 102. For example, to remount the air treatment assembly 200 on the canister body 102 after the air treatment assembly 200 has been removed, the user may slide the rear side 228 of the air treatment assembly 200 into the wall recess 162 until the rear side 228 contacts the wall 160. Accordingly, the wall 160 may be used to provide an indication to the user that the air treatment assembly 200 is in the proper position to be remounted.

As exemplified in FIG. 16, the canister body 102 may not have a handle. Accordingly, the handle 270 of the air treatment assembly 200 may be used as the handle for the surface cleaning apparatus 100. When the air treatment assembly 200 is mounted to the canister body 102, the air treatment assembly 200 and the canister body 102 may be referred to as a canister assembly 190. In some embodiments, the handle 270 of the air treatment assembly 200 may be the only handle of the canister assembly 190.

Pre-Motor Filter

In accordance with this aspect, which may be used by itself or in combination with one or more other aspects, the air treatment assembly is removably mounted to the canister body and the platform on which the air treatment assembly is received when mounted to the canister body is provided with the pre-motor filter and the outer perimeter of the pre-motor filter is recessed inwardly from the outer perimeter of the platform and/or the air treatment assembly. For example, as exemplified, the recess 110 of the canister body 102 has sidewalls 112 extending upwardly from the platform 114 and the platform 114 has a pre-motor filter housing 142. When the pre-motor filter 140 is positioned in the pre-motor filter housing 142, at least a portion of a perimeter 150 of the pre-motor filter 140 is recessed inwardly from the sidewalls 112 of the recess 110.

An advantage of this aspect is that the size of the surface cleaning apparatus 100 may be reduced. Recessing the pre-motor filter 140 inwardly from the sidewalls 112 of the recess 110 may allow other components of the surface cleaning apparatus 100 to be positioned exterior to the pre-motor filter 140, without impacting the air flow path, thereby reducing the footprint of the surface cleaning apparatus 100. Another advantage of recessing the perimeter 150 of the pre-motor filter 140 inwardly from the sidewalls 112 of the recess 110 is that the pre-motor filter 140 may more easily be positioned below the air treatment assembly 200, thereby providing a lower profile. Additionally, the pre-motor filter 140 may be located within the surface cleaning apparatus 100 in a way that makes it easy for the user to remove the pre-motor filter 140 for cleaning or disposal, without having to deform the pre-motor filter 140 during removal.

In accordance with this aspect, the platform 114 of the surface cleaning apparatus 100 has a pre-motor filter housing 142 for removably receiving a pre-motor filter 140 therein. As exemplified, the pre-motor filter housing 142 comprises a portion of the platform and a lower end of the air treatment assembly (which seals the upper end of the volume in which the pre-motor filter is positioned when the pre-motor filter is provided in the pre-motor filter housing 142).

The pre-motor filter 140 has a perimeter 150. As exemplified in FIGS. 10 and 11, the perimeter 150 is recessed inwardly from the sidewalls 112 of the recess 110 of the surface cleaning apparatus 100 such that when the pre-motor filter 140 is positioned within the pre-motor filter housing 142, a portion 115 of the platform 114 is visible between the perimeter 150 of the pre-motor filter 140 and the sidewalls 112 of the recess 110, as exemplified in FIGS. 10 and 11.

It will be appreciated that any amount of the perimeter 150 of the pre-motor filter 140 may be recessed inwardly from the sidewalls 112 of the recess 110. For example, the amount of the perimeter 150 of the pre-motor filter 140 that is recessed inwardly from the sidewalls 112 of the recess 110 may be, including, but not limited to, at least 50%, at least 75%, at least 95%, and 100% As exemplified in FIGS. 10 and 11, 100% of the perimeter 150 of the pre-motor filter 140 is recessed inwardly from the sidewalls 112 of the recess 110.

It will be appreciated that the pre-motor filter 140 may be any shape. The shape of the pre-motor filter 140 and/or the pre-motor filter housing 142 may be shaped to complement other components of the surface cleaning apparatus 100. For example, a forward portion 152 of the pre-motor filter 140 may be narrower in a plane transverse to the forward direction than a rearward end 154 of the pre-motor filter 140. As exemplified in FIGS. 10 and 11, the pre-motor filter 140 is generally T-shaped. Similarly, the pre-motor filter housing 142 is correspondingly generally T-shaped. The T-shaped pre-motor filter housing 142 and pre-motor filter 140 may allow for a generally lower profile for the body 102 of the surface cleaning apparatus 100 by providing space for other components of the surface cleaning apparatus 100 to be positioned adjacent the pre-motor filter 140.

It will be appreciated that an inlet to post pre-motor air flow path, which may extend to the suction motor, may be located below the pre-motor filter and may be in a lower surface of the pre-motor filter housing. Therefore, the pre-motor filter and a downstream header therefor occupy a portion of the height of the canister body (the vertical height when the canister body is placed on a floor). The wheel housings are positioned exterior to the downstream header of the pre-motor filter. By recessing the forward side portions of the pre-motor filter housing inwardly, the wheel housings may be provided closer to the front/rear centre line of the canister body thereby enabling the canister body to be narrower. For example, as exemplified in FIGS. 6, 38, and 39, the floor travelling members 108 of the canister body 102 include a first front wheel 170 and a second front wheel 170 and the perimeter 150 of the pre-motor filter 140 is recessed inwardly from a vertical projection 172 of the wheels 170. By recessing the perimeter 150 of the pre-motor filter 140 inwardly of the vertical projections 172 of the first and second wheels 170 and shaping the pre-motor filter housing 142 in a T-shape, the wheels 170 may be positioned closer to the pre-motor filter housing 142 without impacting the vertical profile of the canister body 102.

Alternately, or in addition, the front end of the pre-motor filter housing may be recessed rearwardly to enable the inlet conduit to extend inwardly into the recess. For example, as exemplified in FIGS. 12-13, the canister body 102 has an inlet conduit 130 with an inlet port 132 and an outlet port 134. The inlet port 209 of the air treatment assembly 200 may be positioned in the recess 110 of the canister body 102 when the air treatment assembly 200 is mounted to the canister body 102. As exemplified in FIGS. 12 and 13, when the pre-motor filter 140 is positioned in the pre-motor filter housing, the forward side 152 of the pre-motor filter 140 may be positioned rearward of the inlet conduit 130.

Referring to FIGS. 1-8, the air treatment assembly 200 is removably mounted to the canister body recess 110. As shown, the air treatment assembly 200 seats in the recess 110 when the air treatment assembly 200 is mounted to the canister body 102. The air treatment assembly 200 has an air treatment assembly seat 280 that rests on the sidewalls 112 of the recess 110 when the air treatment assembly 200 is mounted to the canister body 102. Accordingly, the air treatment assembly 200 forms a part of an exterior surface 109 of the surface cleaning apparatus 100 when mounted to the canister body 102.

Figure 30:
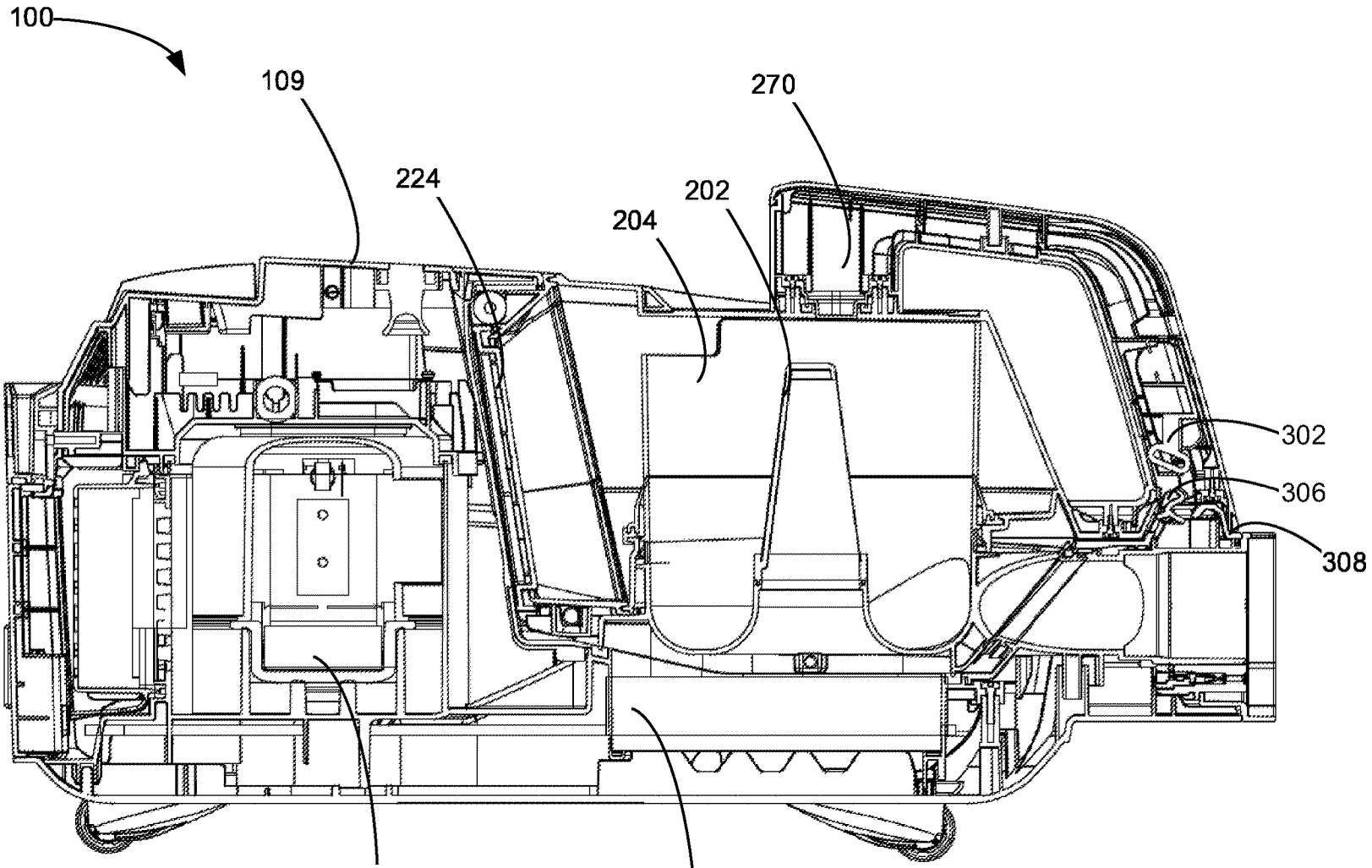
FIG. 30 is a cross-sectional side view of the surface cleaning apparatus of FIG. 1 along the line 28-28 in FIG. 5 with the air treatment assembly lock in an unlocked position.

As exemplified in FIG. 30, the first end 220 of the air treatment assembly 200 may be used to seal the upstream side 144 of the pre-motor filter 140. In other words, the air treatment assembly 200 has a seal receiving portion 282 for coupling with a pre-motor filter seal 284 such that when the air treatment assembly 200 is positioned within the recess 110, the seal 284 is positioned between the pre-motor filter housing 142 and the air treatment assembly 200. The seal 284 may be coupled to the air treatment assembly 200 and/or may be positioned around the perimeter 150 of the pre-motor filter 140. As exemplified in FIG. 9, the seal 284 is positioned around the perimeter 150 of the pre-motor filter 140. Accordingly, when the air treatment assembly 200 is mounted to the canister body 102, the seal receiving portion 282 seats on the seal 284, thereby sealing the air treatment assembly 200 and the pre-motor filter housing 142. As shown, when the upstream side 144 of the pre-motor filter housing 142 is sealed, the air outlet 210 of the of the air treatment assembly 200 faces the pre-motor filter 140. It will be appreciated that the seal 284 may be a gasket or the like and, optionally, a seal 284 may not be provided.

The dirt collected by the air treatment assembly 200 is collected in the dirt collection chamber 206. A portion 286 of the dirt collection chamber 206 may be exterior to the perimeter 150 of the pre-motor filter 140. For example, referring to FIG. 23, the seal receiving portion 282 of the air treatment assembly 200 is interior of an exterior surface 288 of the dirt collection chamber 206. Accordingly, when the air treatment assembly 200 is mounted to the canister body 102, the dirt collection chamber 206 extends beyond the perimeter 150 of the pre-motor filter 140. It will be appreciated that 40%, 50%, 60%, 70%, 80%, 90% or all of the dirt collection chamber 206 may extend beyond the perimeter 150 of the pre-motor filter 140.

Recessed Outlet Port

In accordance with this aspect, which may be used by itself or in combination with one or more other aspects, the outlet port 134 of the inlet conduit 130 of the canister body 102 is recessed inwardly from an outer surface 182 of the sidewalls 112 of the recess 110. An advantage of this aspect is the air treatment assembly 200 may be more easily mounted to the canister body 102 while ensuring that the air flow passage is properly maintained. Additionally, the inlet conduit 130 may be a single part that passes from exterior of the surface cleaning apparatus 100 to interior of the surface cleaning apparatus 100 without having one or more seals therein. Accordingly, leakage of the air flow passageway may be reduced.

The sidewalls 112 of the recess 110 have an inner surface 180, an outer surface 182, an upper end 184, and a lower end 186. As exemplified in FIG. 13, the outlet port 134 of the inlet conduit 130 of the canister body 102 is recessed inwardly (rearwardly) from the outer surface 182 of the sidewalls 112 of the recess 110. As shown, the outlet port 134 is positioned below the upper end 184 of the sidewalls 112 of the recess 110. In some embodiments, as exemplified in FIGS. 12 and 13, the inlet conduit 130 may extend through the sidewalls 112 of the recess 110. It will be appreciated that 50%, 60%, 70%, 80%, 90% or all of the outlet port 134 is positioned below the upper end 184 of the sidewalls 112.

Figure 28:
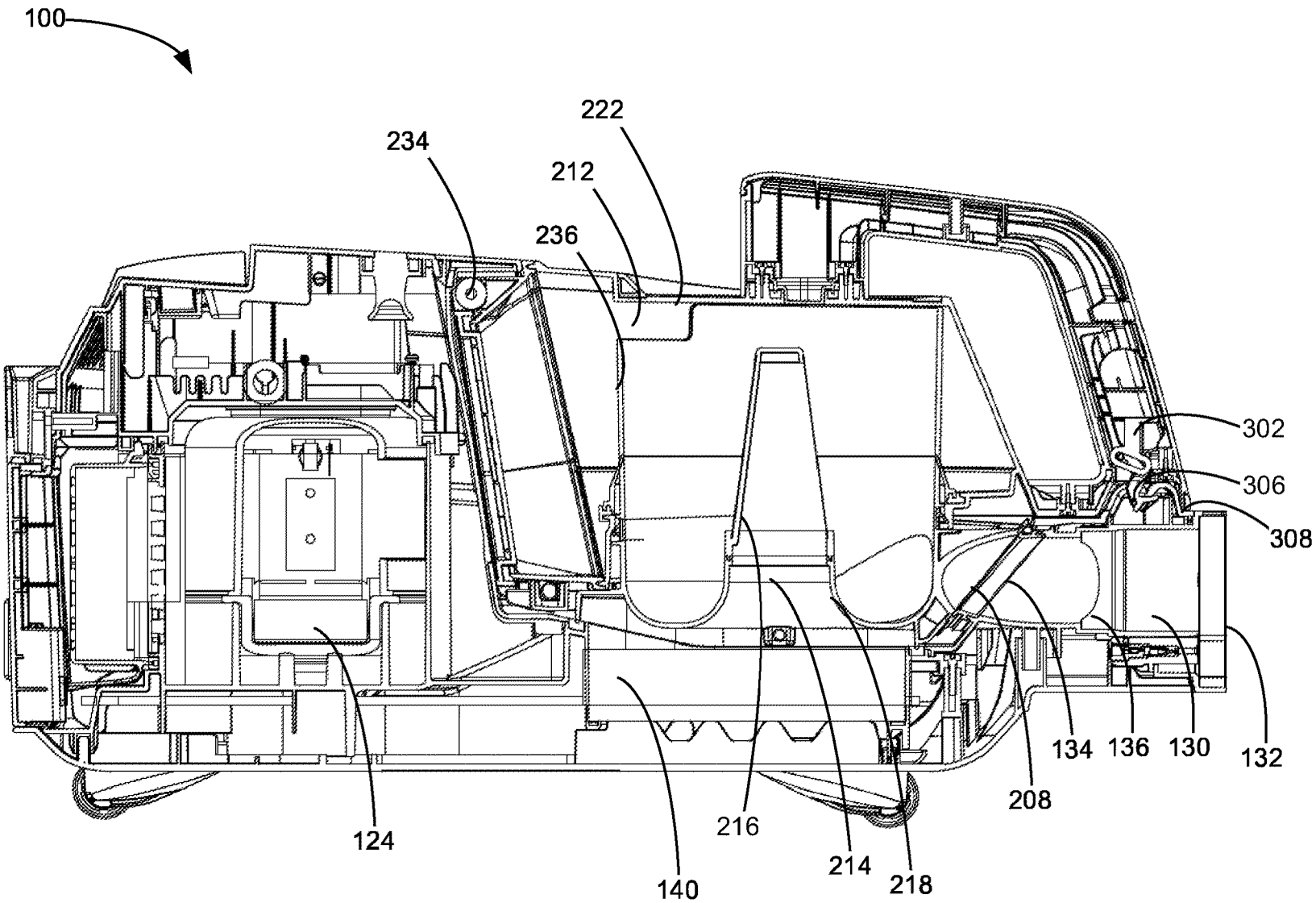
FIG. 28 is a cross-sectional side view of the surface cleaning apparatus of FIG. 1 along the line 28-28 in FIG. 5 with the air treatment assembly lock in a locked position.
Figure 29:
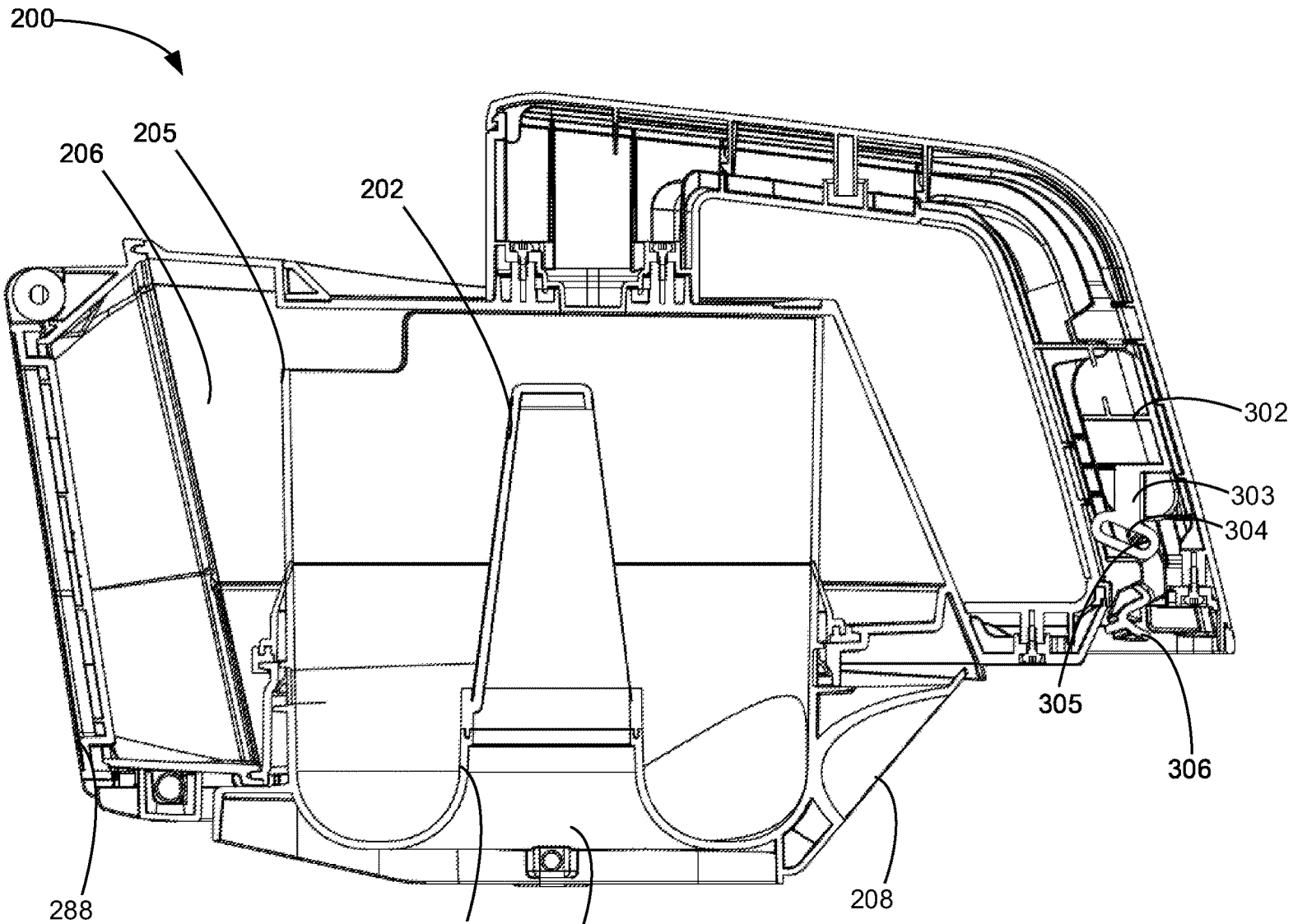
FIG. 29 is a cross-sectional side view of the air treatment assembly of the surface cleaning apparatus of FIG. 1 along the line 27-27 in FIG. 20 with the air treatment assembly lock in an unlocked position.

As exemplified in FIG. 29, the air treatment chamber 204 is nested within the dirt collection chamber 206 and the outer wall 205 of the air treatment member 202 may be positioned inward of the outer surface 288 of the dirt collection chamber 206. As exemplified in FIG. 23, the inlet port 209 of the air treatment assembly 200 is positioned inwardly of the outer surface 288 of the dirt collection chamber 206. For example, the inlet port 209 extends rearward of a front wall 290 of the dirt collection chamber 206 when the air treatment assembly 200 is mounted to the canister body 102. Accordingly, as exemplified in FIGS. 27 and 28, the air flow passage 136 is provided at the first end 220 of the air treatment assembly 200. Accordingly, when the air treatment assembly 200 is mounted to the canister body 102, both the first end 220 of the air treatment assembly 200 and the air flow passage 136 are positioned within the recess 110.

As exemplified in FIG. 28, the inlet conduit 130 of the canister body 102 extends to the air inlet 208 of the air treatment assembly 200 located proximate the first end 220 of the air treatment assembly 200. Accordingly, the air inlet 208 and the inlet conduit 130 define an air flow passage 136 that extends under the dirt collection chamber 206. Therefore, as exemplified, the outlet port extends to the inlet of the tangential air inlet of the cyclone chamber.

In some embodiments, the airflow passage connecting the air outlet 210 of the air treatment assembly 200 to the pre-motor filter 140 may include an inlet port 156 that is positioned in the recess 110.

Mounting of the Air Treatment Assembly

In accordance with this aspect, which may be used by itself or in combination with one or more other aspects, the body has a recess into which a portion of the sides of the air treatment assembly, e.g., a rear portion of the sides of the air treatment assembly, is received when the air treatment assembly is mounted to the body. An advantage of this aspect is the wall 160 and the wall recess 162 may act as a guide for the user to mount the air treatment assembly 200, thereby making it easier for the user to remount the air treatment assembly 200 after its removal. Another advantage is that the wall recess 162 may provide structural stability to the mounting of the air treatment assembly 200, thereby reducing the likelihood of the air treatment assembly 200 being moved during use and reducing the likelihood of air leaks caused by improperly sealed airflow passages.

As exemplified in FIG. 28, the canister body 102 has a wall 160 with sidewalls 164 extending away from the wall 160 to define a volume that includes a wall recess 162. The wall 160 may extend generally vertically and the sidewalls 164 may extend generally forwardly. As exemplified in FIG. 16, the sidewalls 164 comprise an upper portion and left and right side portions that extend forwardly. The sidewalls 164 therefore define a generally U-shaped perimeter that seats over a rear portion of each of the upper end, the left side and the right side of the air treatment assembly 200 when the air treatment assembly is mounted to the canister body. It will be appreciated that, optionally, the sidewalls 164 need not be a continuous U-shaped member and may be provided on only two sides (e.g., the left and right side) of the air treatment assembly 200.

The wall recess 162 is sized to receive a portion of the air treatment assembly, such as the portion opposed to the handle. Accordingly, if the handle is provided on the front of the air treatment assembly, the rear portion of the air treatment assembly may be seated in the wall recess 162 when the air treatment assembly is mounted to the canister body. The wall recess 162 may be slightly larger than the portion of the air treatment assembly that is received therein to enable the air treatment assembly to be slidingly received therein without damaging the air treatment assembly but still able to provide support for the portion of the air treatment assembly when the surface cleaning apparatus is in use.

Accordingly, when the air treatment assembly 200 is mounted to the canister body 102 and the canister body 102 is positioned with the floor travelling members 108 on the floor, the wall 160 of the canister body 102 extends generally vertically and the rear portion of the left and right sidewalls of the air treatment assembly 200 is positioned within the wall recess 162. As exemplified in FIG. 28, the openable rear side 228 of the air treatment assembly 200 may be positionable within the wall recess 162.

As exemplified in FIG. 16, the wall recess 162 of the canister body 102 may have an absence of an air flow passage therethrough. Accordingly, the wall recess 162 need not be sealed to the air treatment assembly 200.

The wall recess 162 may be used to assist in mounting the air treatment assembly to the canister body. As shown in FIGS. 14 to 17, the air treatment assembly 200 may be toed into the wall recess 162 to secure the air treatment assembly 200 to the canister body 102. In other words, the air treatment assembly 200 may be tilted to lower the wall engagement members 292 below the upper portion of the sidewall 164 of the wall recess 162, as exemplified in FIG. 15. The air treatment assembly 200 may then be slid rearward, as exemplified in FIG. 14, and lowered into the recess 110 of the canister body 102. The front side of the air treatment assembly 200 may then be lowered to the inserted position shown in FIG. 1, thereby mounting the air treatment assembly 200 to the canister body 102 to form the canister surface cleaning apparatus assembly 190.

Optionally, the air treatment assembly 200 may have one or more engagement members that engage with one or more mating engagement members provided in the wall recess 162 such that the wall recess 162 of the canister body 102 acts to secure the air treatment assembly 200 in place when the air treatment assembly 200 is mounted to the canister body 102. For example, as exemplified in FIG. 17, an upper portion of the sidewall 164 of the wall recess 162 has slots 166 for receiving wall engagement members 292 positioned on the second end 222 of the air treatment assembly 200. As the air treatment assembly 200 is toed into the wall recess 162, the wall engagement members 292 may engage with the slots 166 in the sidewall 164 of the wall recess 162 to secure the air treatment assembly 200 in the recess 110 and the wall recess 162.

Optionally, as exemplified in FIGS. 27-31, an air treatment assembly lock 300 may be used to secure the air treatment assembly 200 to the canister body 102. It will be appreciated that the air treatment assembly lock 300 may be positioned in any location on the air treatment assembly 200 or canister body 102 and may be of any design known in the art.

As exemplified, the lock 300 is positioned at the front side 103 of the canister surface cleaning apparatus assembly 190. Optionally, the air treatment assembly lock 300 is positioned on the handle 270 of the air treatment assembly 200. This may enable a user to operate the lock with one hand while holding the handle.

To operate the air treatment assembly lock 300, an air treatment assembly lock actuator 302 may be used. As exemplified in FIG. 18, the air treatment assembly lock actuator 302 is positioned on the handle 270 of the air treatment assembly 200. It will be appreciated that the lock actuator 302 may be any mechanism capable of releasing the air treatment assembly 200 from the canister body 102. For example, as exemplified in FIGS. 18 and 27-31, the air treatment assembly lock actuator 302 is slideably connected to a mount engagement member 306. As exemplified in FIG. 27, the lock actuator 302 has a planar portion 303 with a slot 304. The slot 304 receives a pin 305 located on the mount engagement member 306. As exemplified, the slot 304 extends at an angle relative to the lock actuator 302. Accordingly, when the lock actuator 302 is moved upwards by the user, the planar portion 303 moves upwards, causing the pin 305 to move along the slot 304. As the pin 305 moves along the slot 304, the mount engagement member 306, which is hook-shaped, rotates in a rearward direction until the pin 305 reaches the end of the slot 304, as exemplified in FIG. 29.

The mount engagement member 306 is engageable with a corresponding canister mount engagement member 308. For example, as exemplified in FIGS. 27-31, the canister mount engagement member 308 is hook-shaped.

Figure 31:
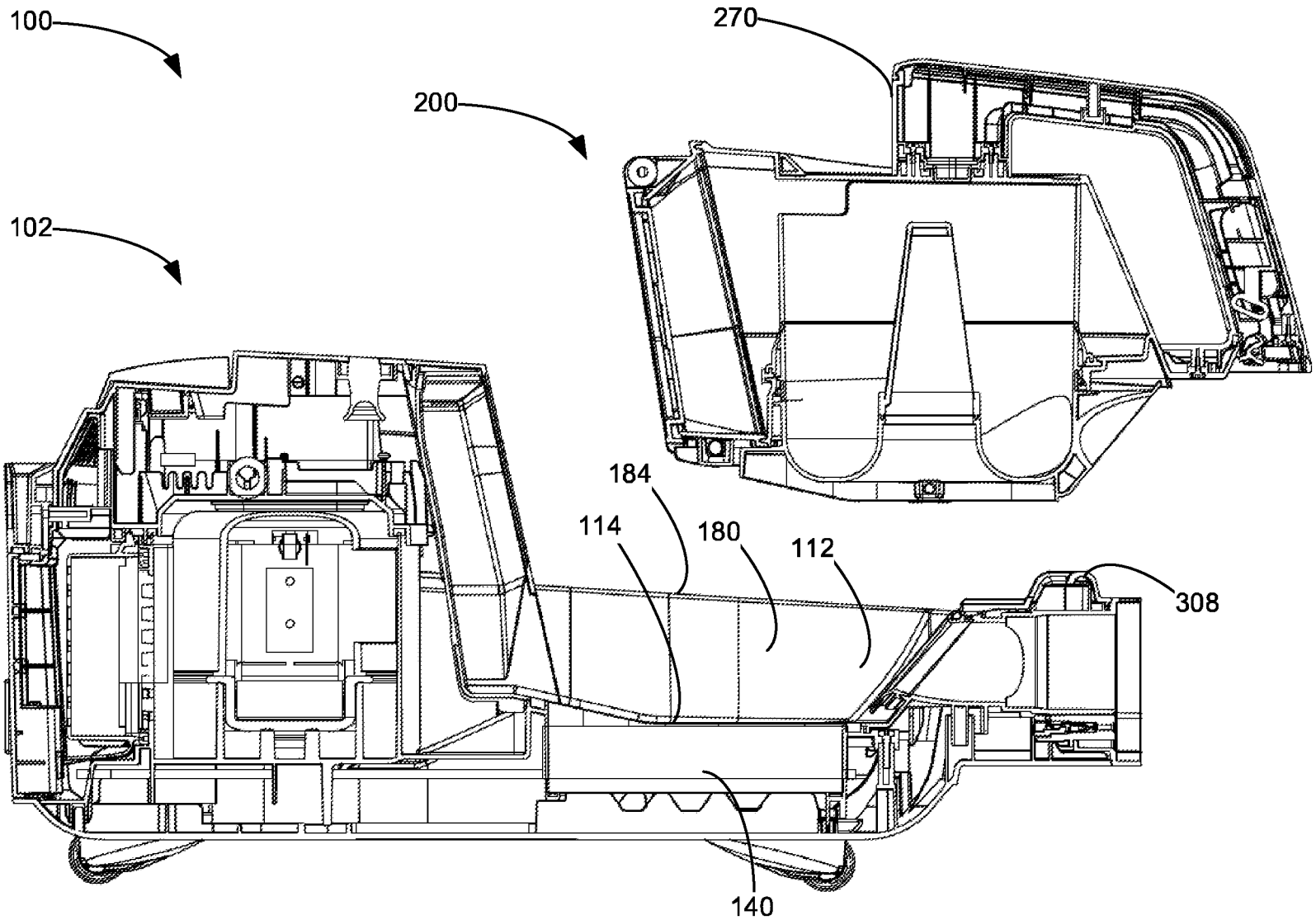
FIG. 31 is a cross-sectional side view of the surface cleaning apparatus of FIG. 1 along the line 28-28 in FIG. 5 with the air treatment assembly lock in an unlocked position and the air treatment assembly unmounted.
Figure 32:
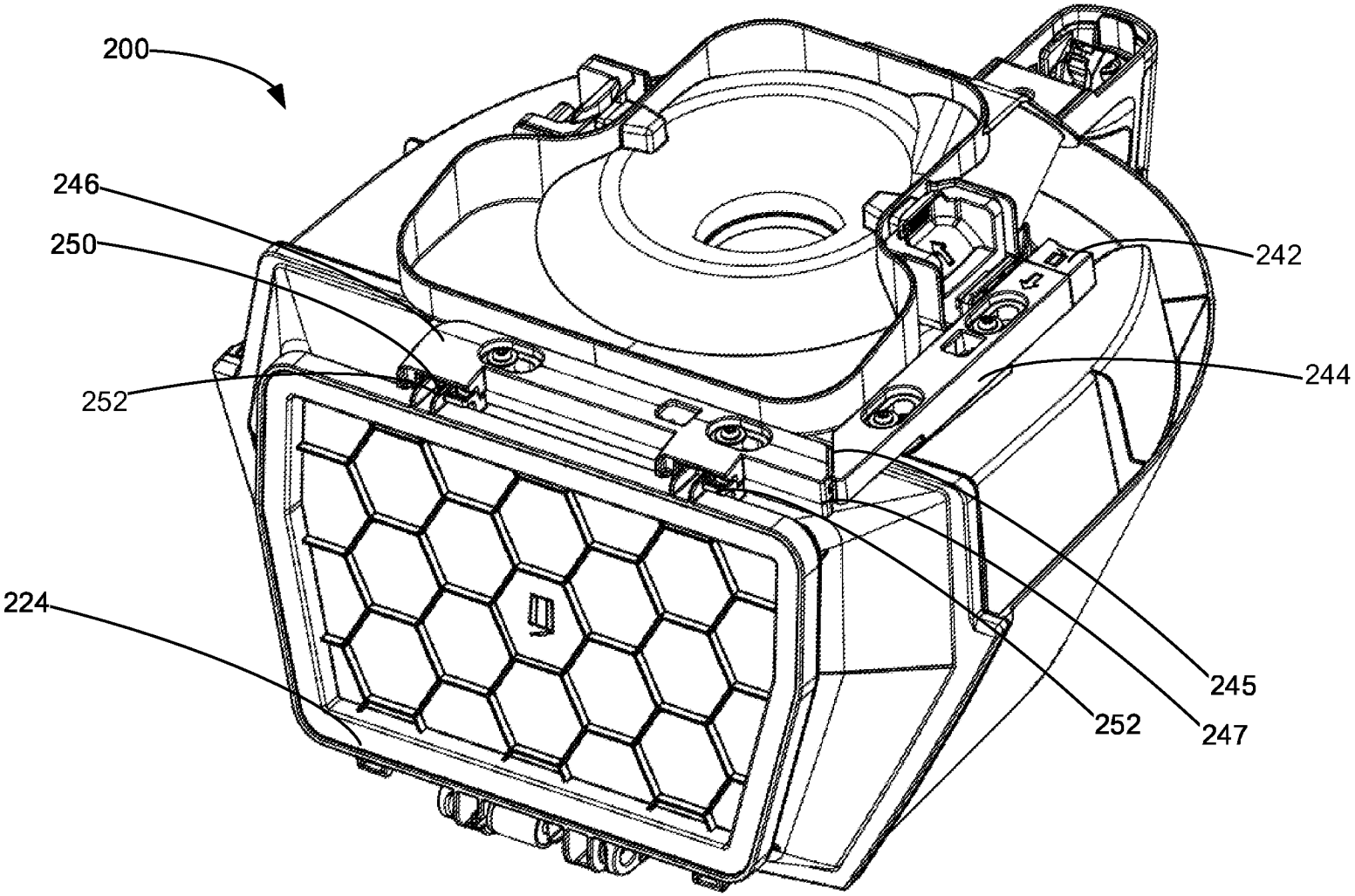
FIG. 32 is a rear bottom perspective view of the air treatment assembly of the surface cleaning apparatus of FIG. 1 with the rear door locked.
Figure 33:
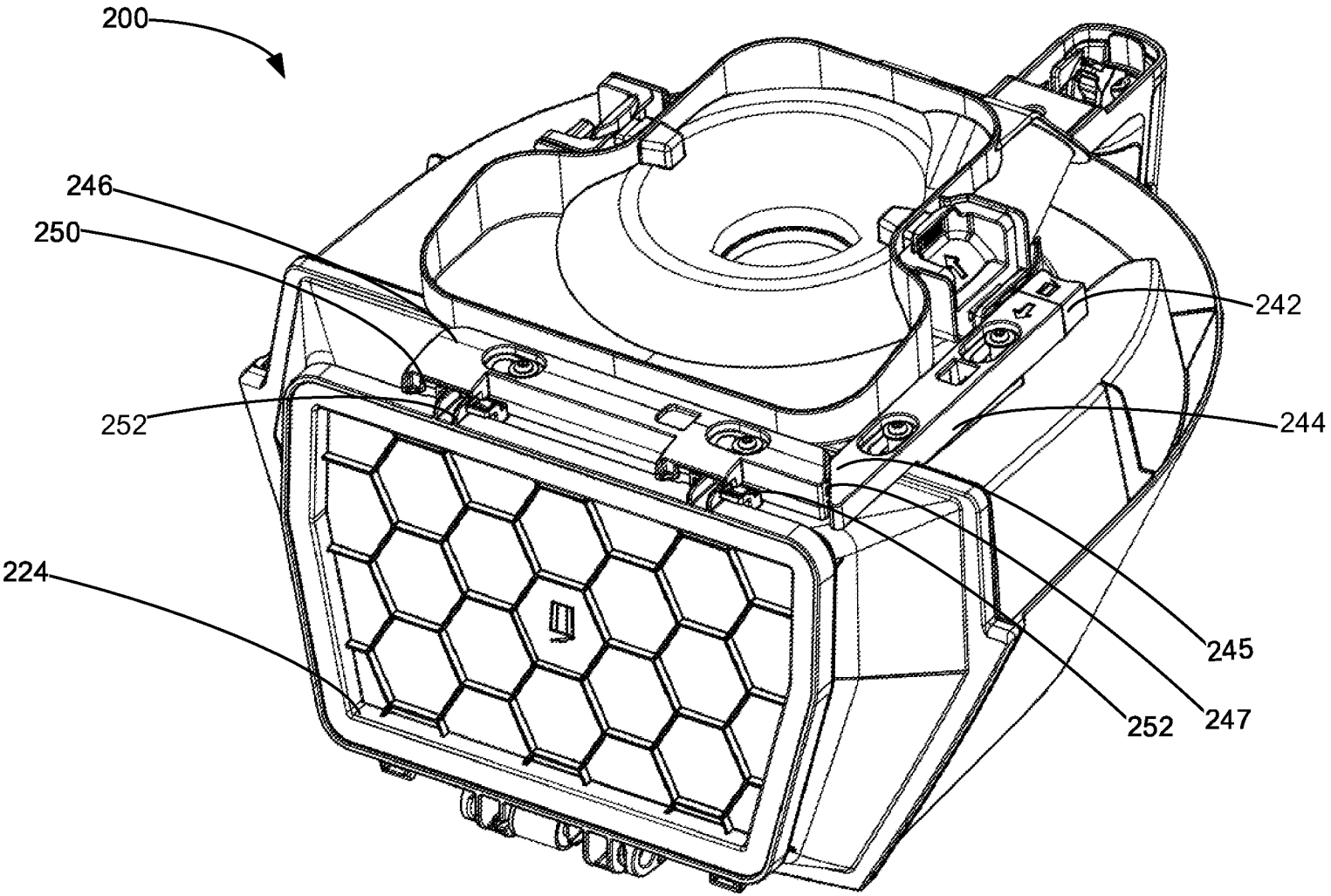
FIG. 33 is a rear bottom perspective view of the air treatment assembly of the surface cleaning apparatus of FIG. 1 with the rear door unlocked.
Figure 34:
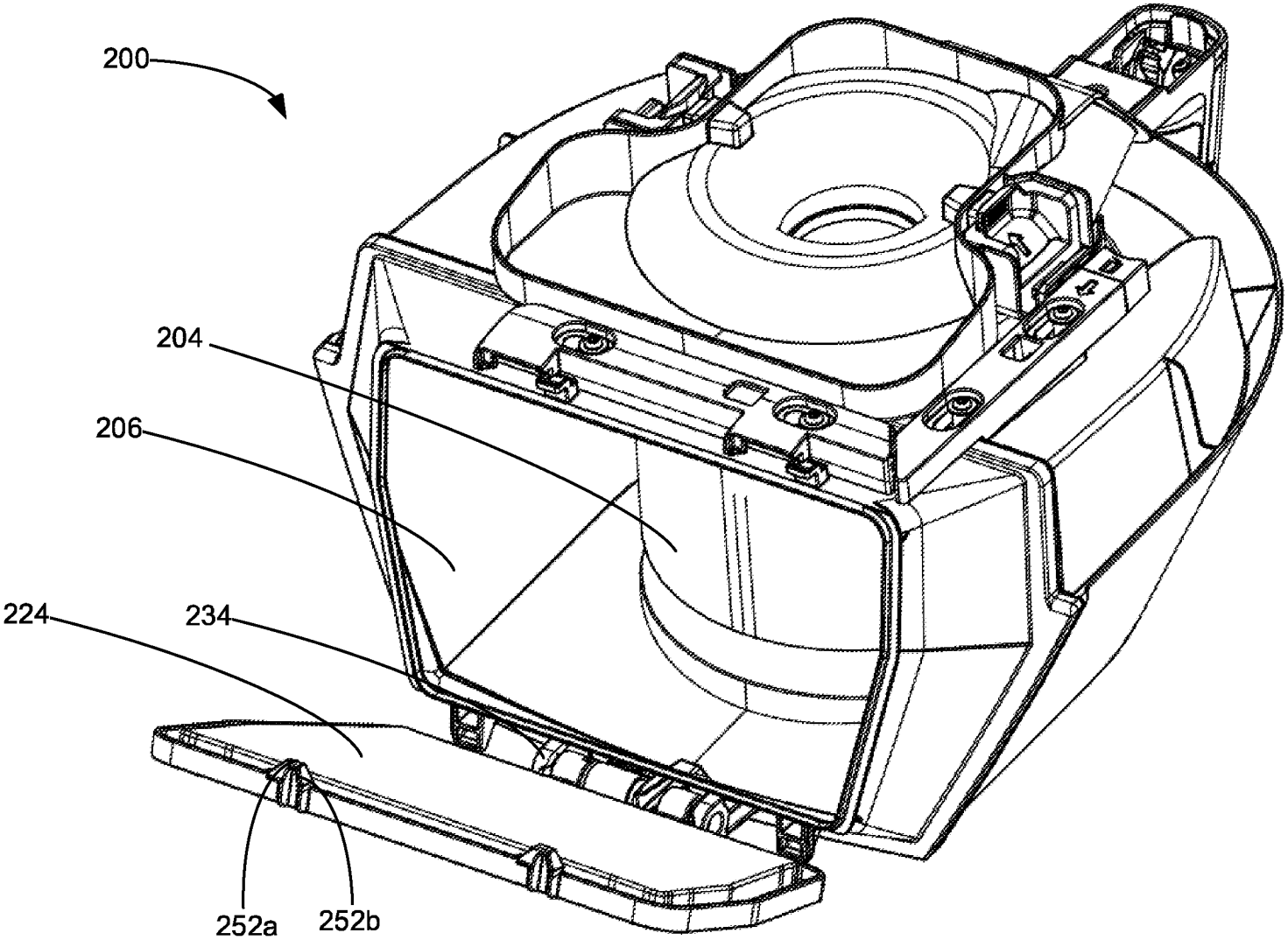
FIG. 34 is a rear bottom perspective view of the air treatment assembly of the surface cleaning apparatus of FIG. 1 with the rear door unlocked and open.
Figure 35:
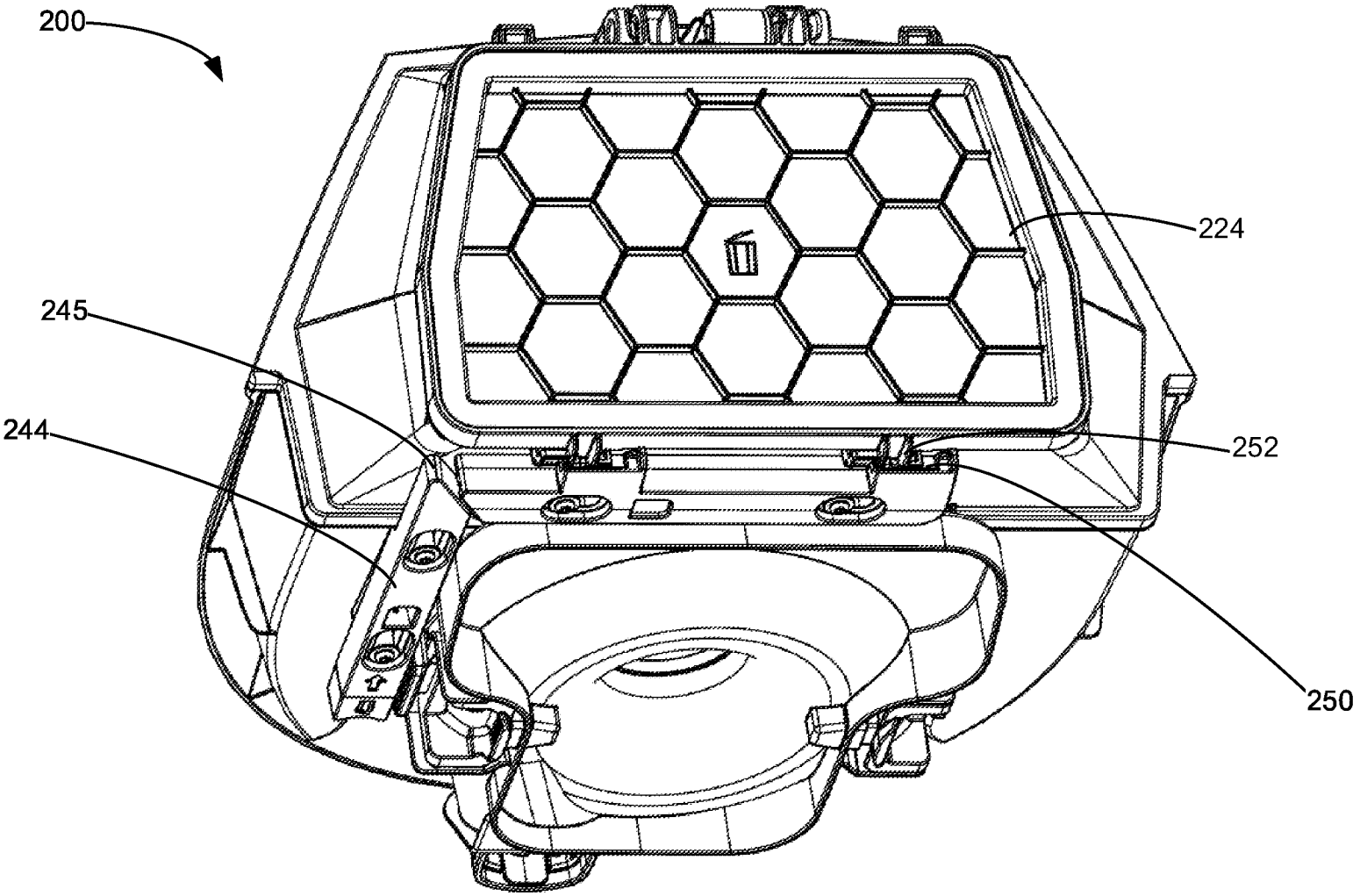
FIG. 35 is a rear bottom perspective view of the air treatment assembly of the surface cleaning apparatus of FIG. 1 with the rear door unlocked and closed.
Figure 36:
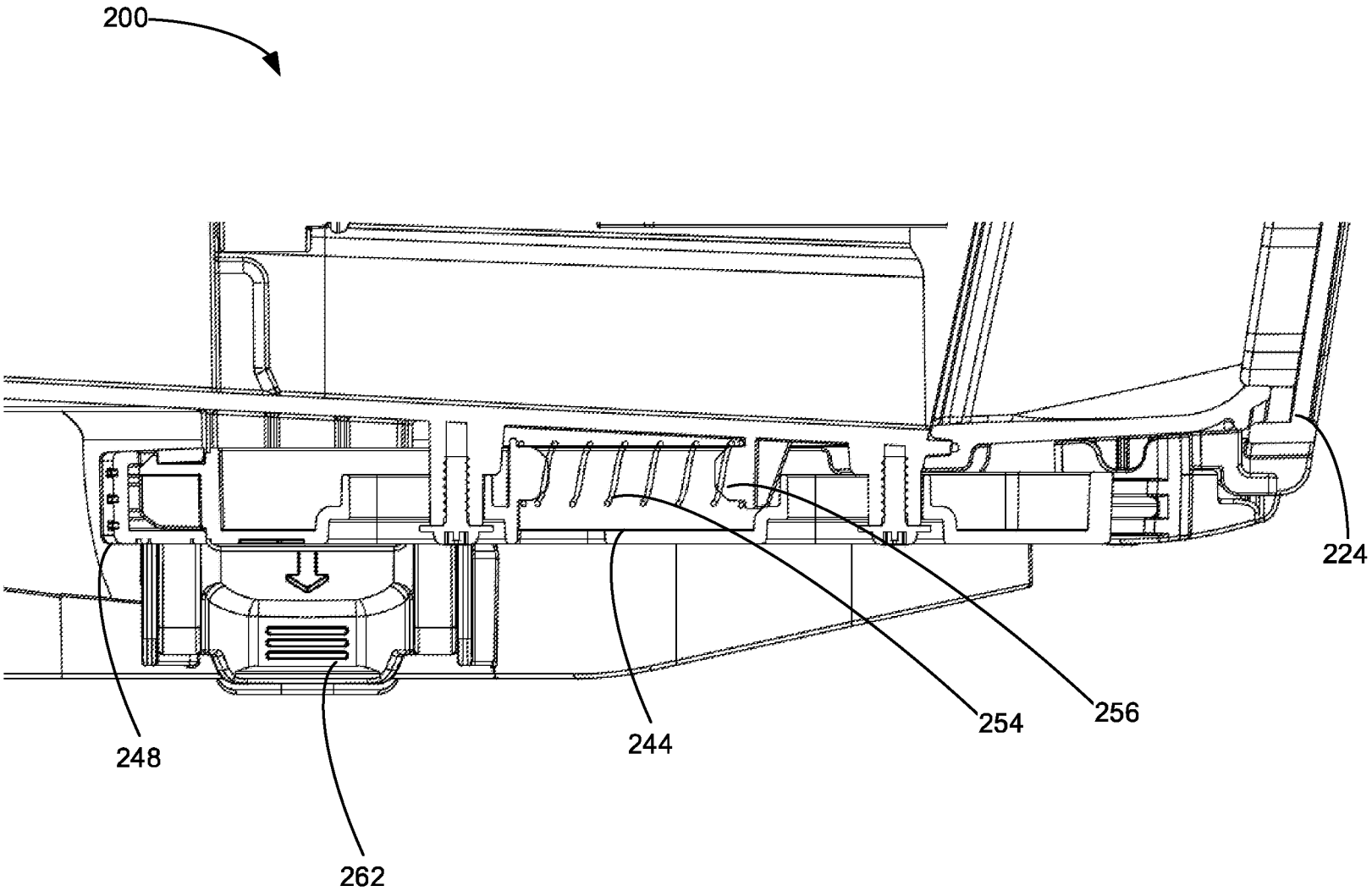
FIG. 36 is a cross-sectional side view of a door lock mechanism of the air treatment assembly of the surface cleaning apparatus of FIG. 1 with the door locked.
Figure 37:
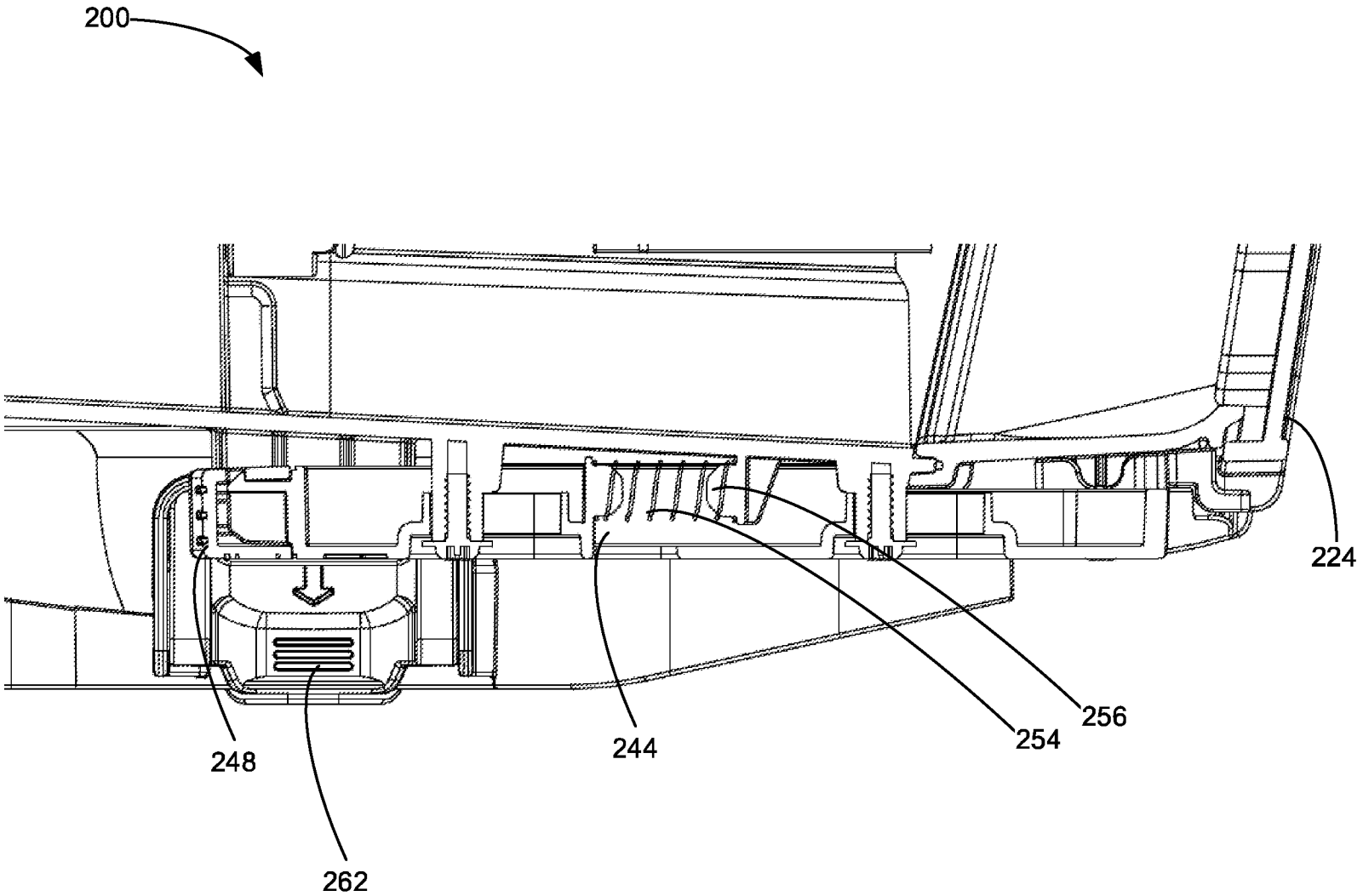
FIG. 37 is a cross-sectional side view of the door lock mechanism of the air treatment assembly of the surface cleaning apparatus of FIG. 1 with the door unlocked.
Figure 38:
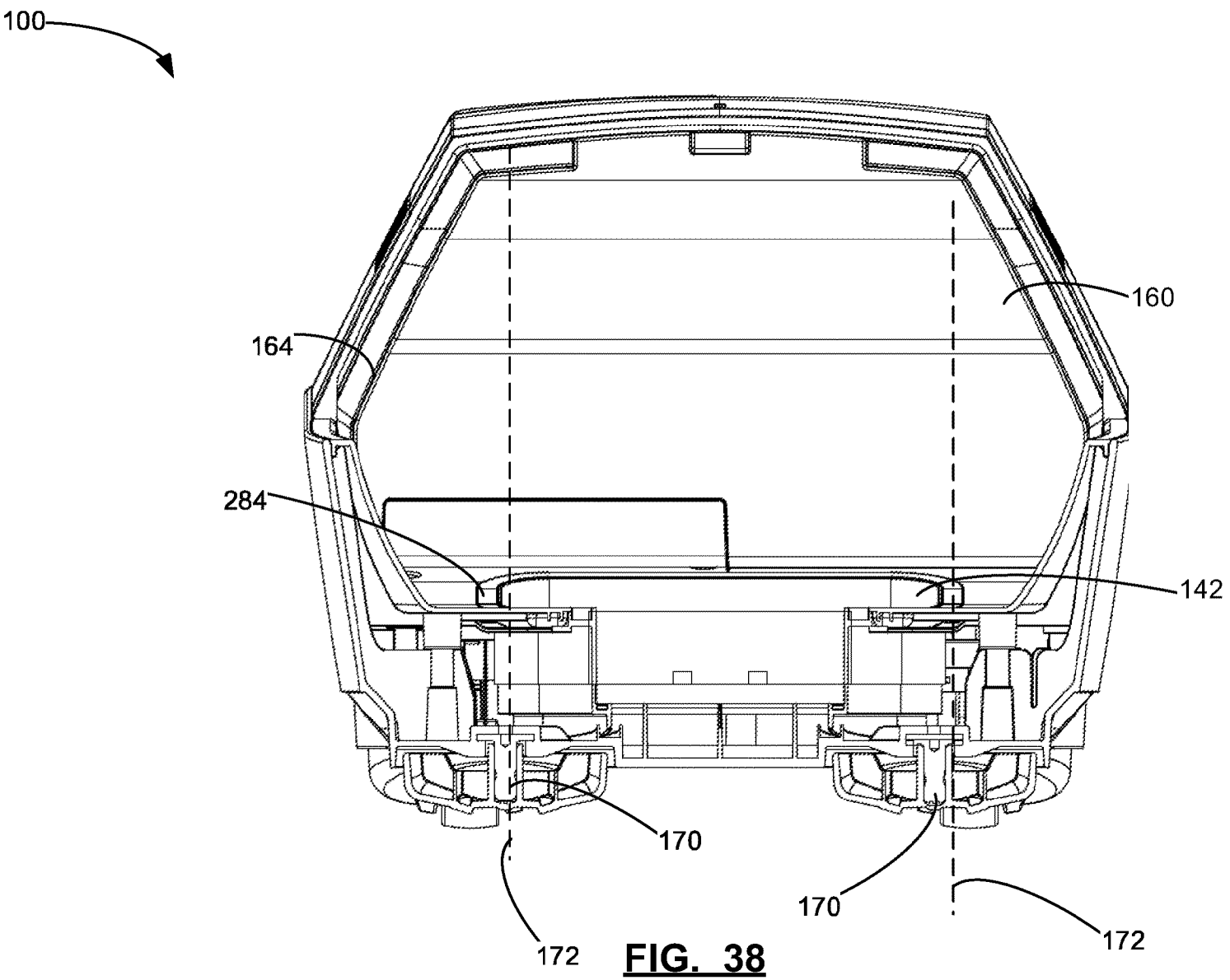
FIG. 38 is a front cross-sectional view of the surface cleaning apparatus of FIG. 1 along the line 38-38 in FIG. 4 with the air treatment assembly removed.
Figure 39:
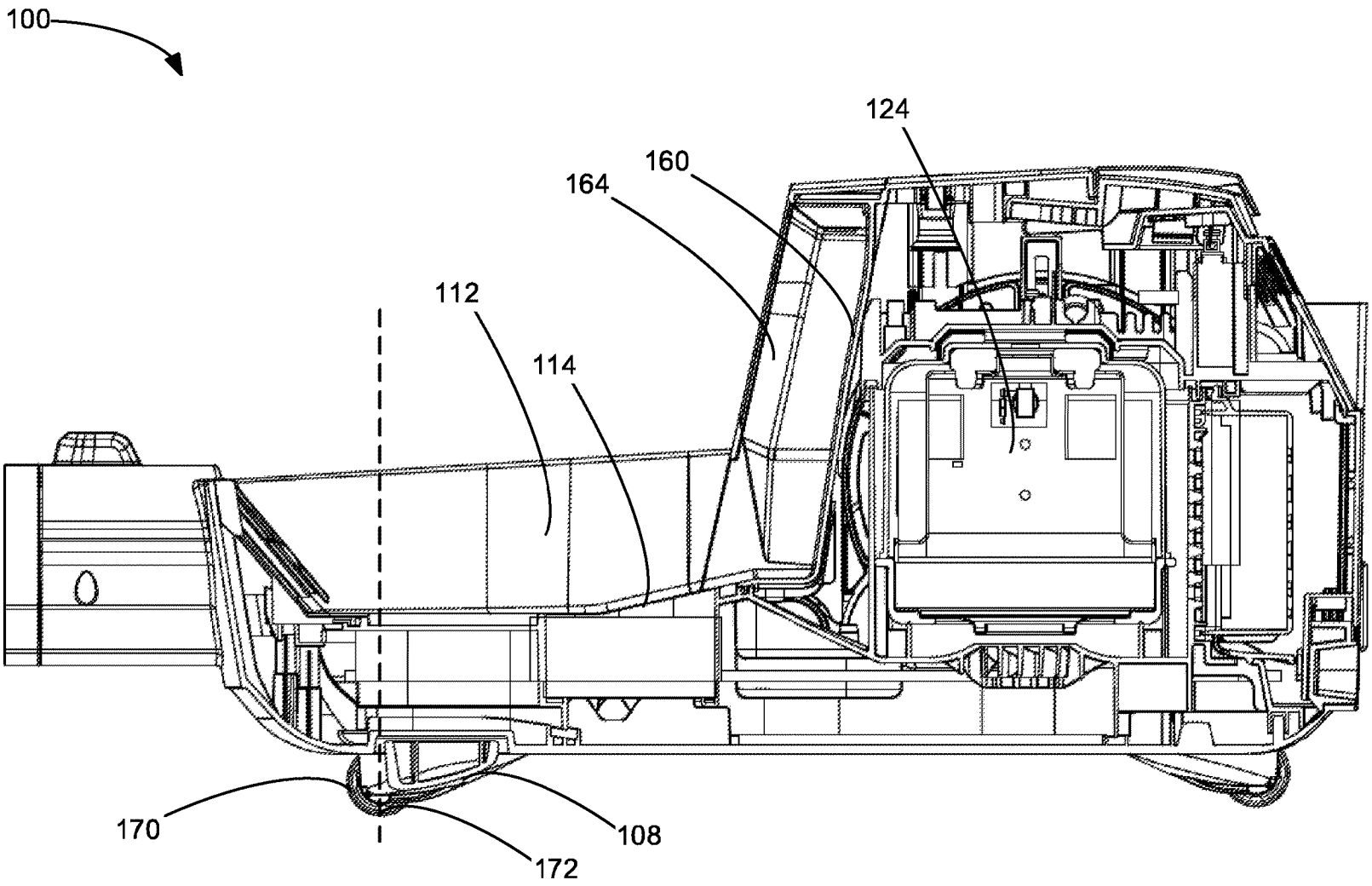
FIG. 39 is a side cross-sectional view of the surface cleaning apparatus of FIG. 1 along the line 39-39 in FIG. 7 with the air treatment assembly removed.
Figure 40:
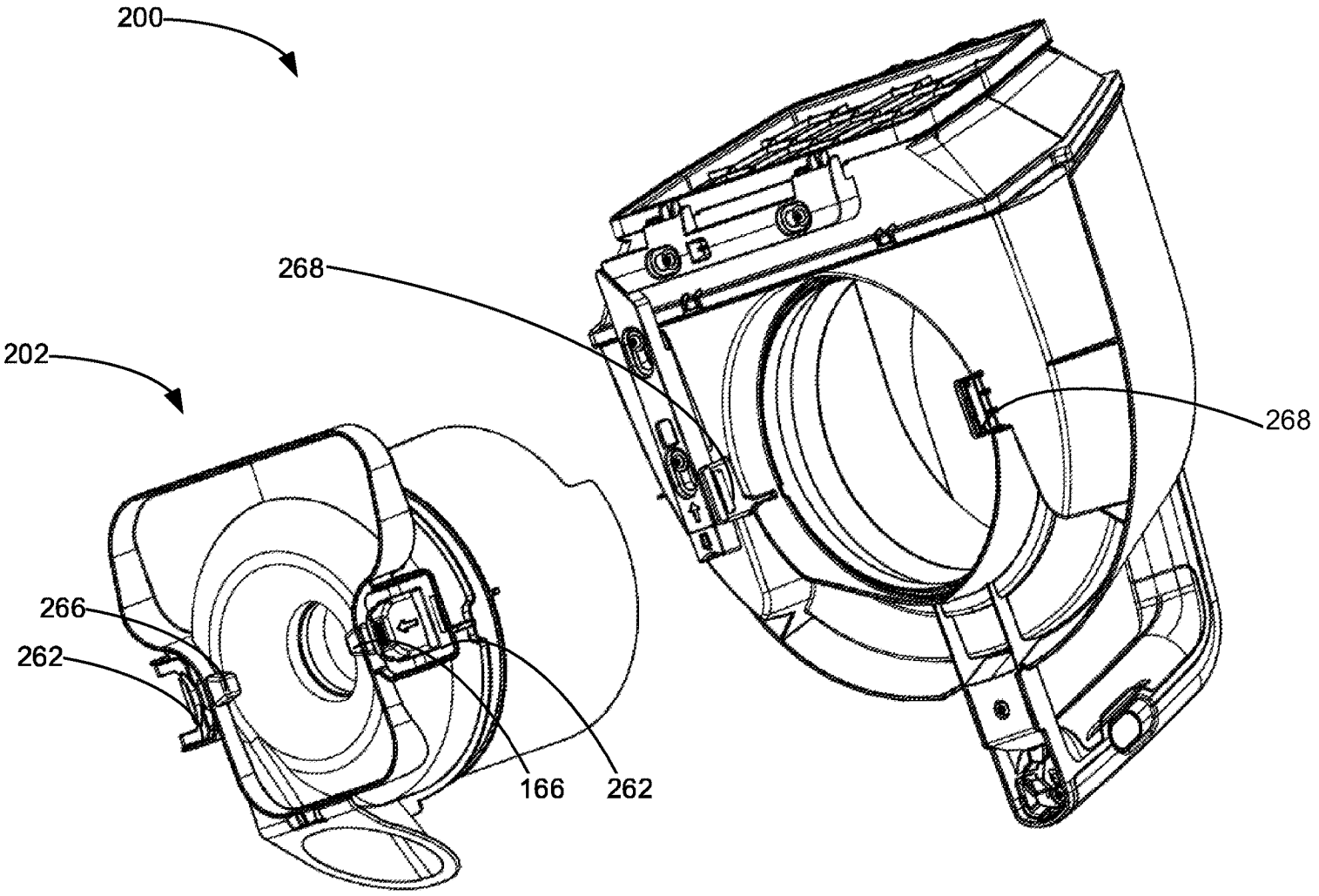
FIG. 40 is a bottom perspective view of the air treatment member removed from and aligned for insertion into the air treatment assembly of the surface cleaning apparatus of FIG. 1.

Accordingly, the lock actuator 302 may be slid upwardly from the closed position, as exemplified in FIG. 28, to the open position, as exemplified in FIGS. 30 and 31. When in the closed or locked position, the hook-shaped portion of the mount engagement member 306 seats under the hook-shaped canister mount engagement member 308 to secure the air treatment assembly 200 to the canister body 102. When in the open position, the mount engagement member 306 is disengaged from the canister mount engagement member 308 such that the air treatment assembly 200 is unlocked from the canister body 102 and may be unmounted by the user.

Accordingly, during operation, the user may unlock the air treatment assembly lock 300 by sliding the lock actuator 302 downwardly, thereby causing the mount engagement member 306 to disengage from the canister mount engagement member 308. The user may then lift the handle 270 of the air treatment assembly 200, as exemplified in FIG. 31. Once the front side 226 of the air treatment assembly 200 is lifted by the handle 270, the wall engagement members 292 disengage from the slots 166 in the wall recess 162. The user may then lift the air treatment assembly 200 from the canister body 102.

It will be appreciated that the recess 110 and the wall recess 162 may be generally perpendicular to each other or may extend at an angle relative to each other. For example, as shown in FIG. 16, an opening 168 of the wall recess 162 extends in a first plane 163, an opening 116 of the recess 110 extends in a second plane 117, and the second plane 117 is generally transverse to the first plane 163. As shown, the platform 114 of the canister body 102 extends in the second plane 117. In other words, the platform 114 of the canister body 102 may extend generally parallel to the opening 116 of the recess 110.

Motor Control Actuator

In accordance with this aspect, which may be used by itself or in combination with one or more other aspects, the surface cleaning apparatus 100 has one or more low voltage actuators 320 for controlling one or more motors of the surface cleaning apparatus 100. An advantage of this design is that the low voltage actuators 320 may be used to enable or disable a motor in the surface cleaning apparatus 100 using low voltage wires, i.e., without the use of higher voltage wires. This design may reduce the likelihood of electrical shock and may simplify construction. Another advantage is that low voltage wires may be lighter and smaller than corresponding high voltage wires, so the weight of the wiring in the surface cleaning apparatus 100 may be reduced. Still another advantage is that the user may control the operation of the surface cleaning apparatus 100 from a single location.

In accordance with this aspect, as exemplified in FIGS. 41-44, the surface cleaning apparatus 100 includes a surface cleaning head 340, a hose 350, and a wand 360. The hose 350 is couplable to the dirty air inlet 120 of the canister body 102, thereby providing an airflow passage to the canister body 102. The wand 360 may be coupled or couplable to the surface cleaning head 340 and the hose 350, as exemplified in FIG. 41. As shown, the surface cleaning head 340 includes a brush 342 that is driven by a brush motor 344 (not shown).

Figure 43B:
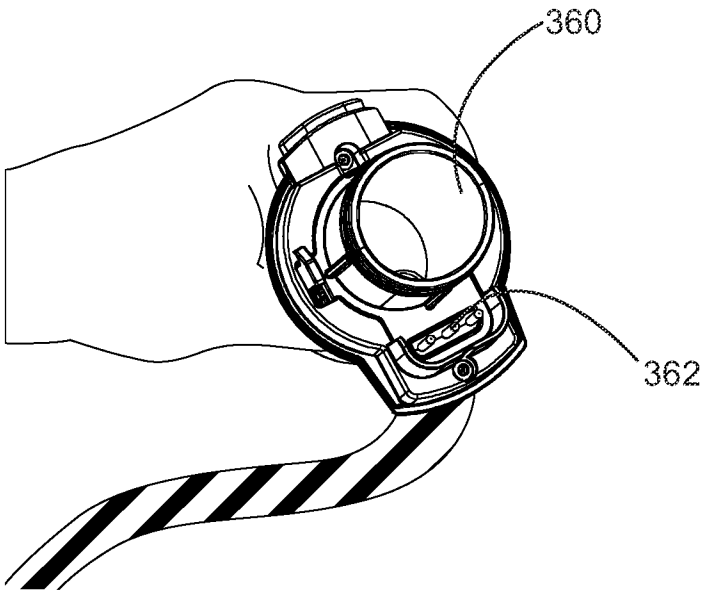
FIG. 43B is a top view of the wand of FIG. 41 with the handle removed.
Figure 43A:
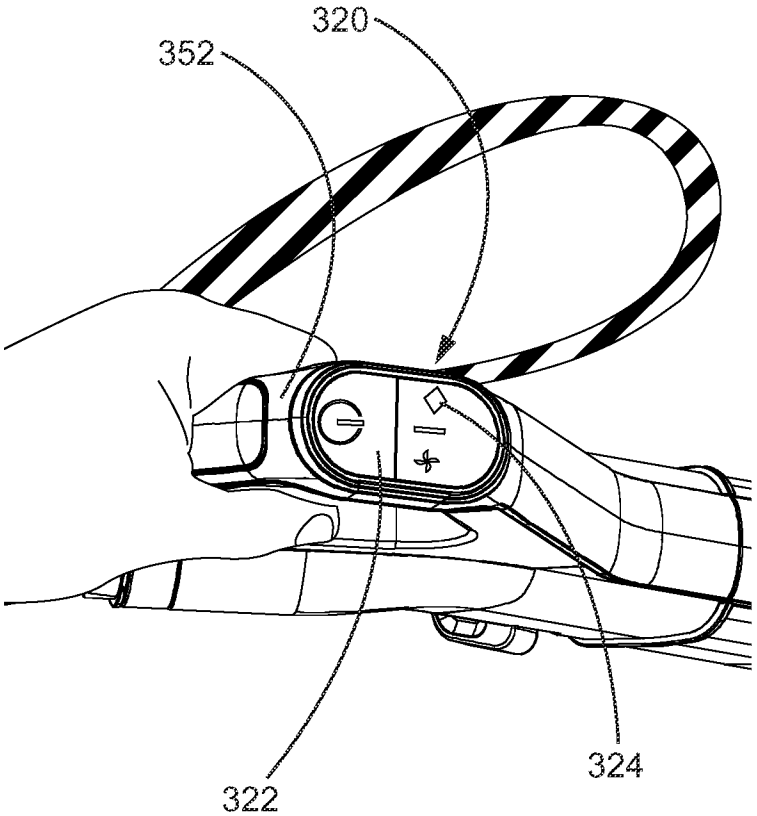
FIG. 43A is a top view of a handle of the hose of FIG. 41.
Figure 44:
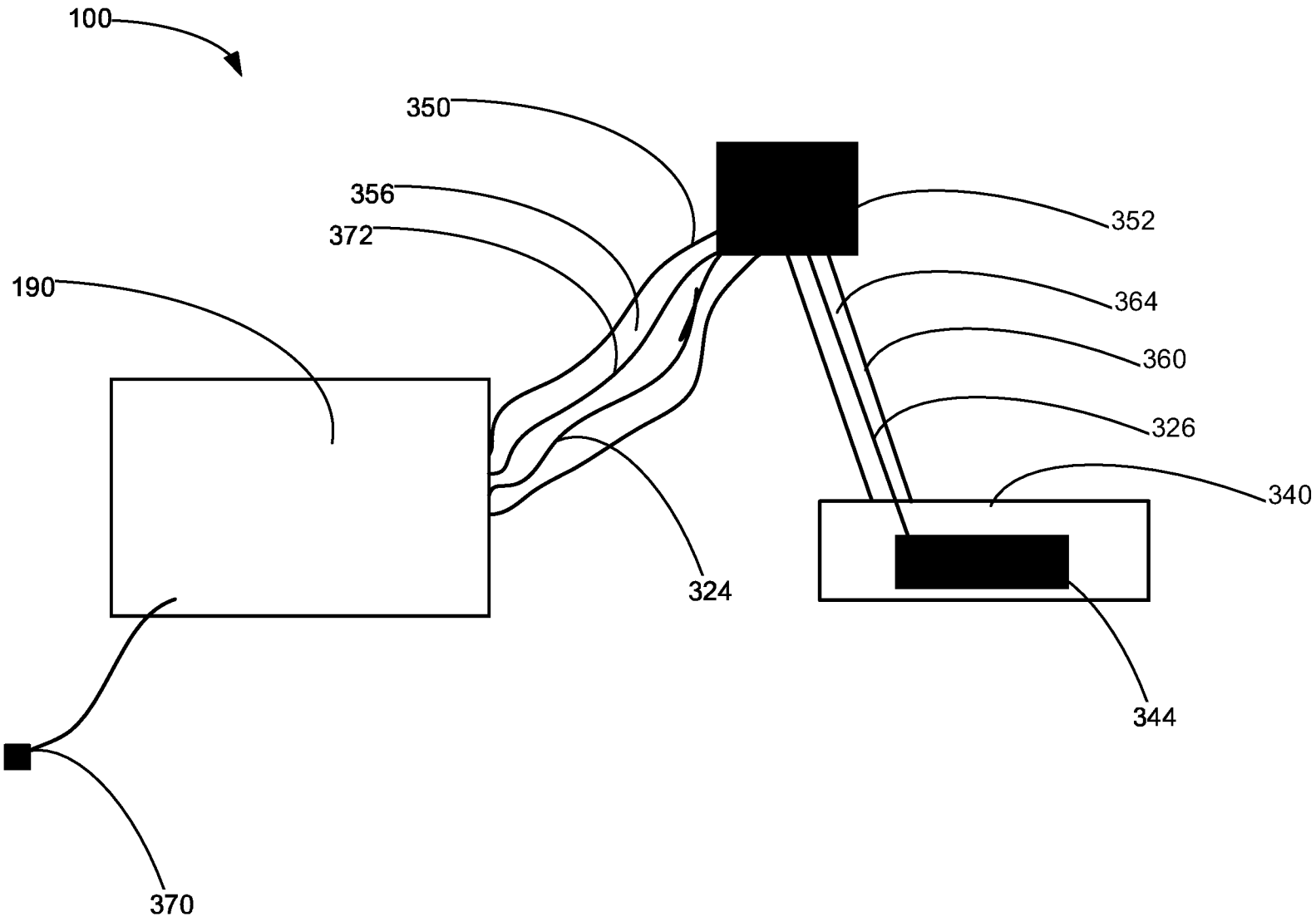
FIG. 44 is a schematic view of a low voltage circuit of the surface cleaning apparatus of FIG. 41.

Referring to FIGS. 43A and 44, as exemplified, the hose 350 has a handle 352 with a first actuator 320 and a second actuator 322. The first actuator 320 is electrically connected to the suction motor 124 through the hose 350 and the optional second actuator 322 is electrically connected to the brush motor 344 in the surface cleaning head 340 by way of the wand 360. In other words, the controls for the suction motor 124 and the brush motor 344 are remotely located from the motors themselves. Each of the first actuator 320 and the second actuator 322 are electrically connected to their respective motor by a low voltage circuit. As exemplified in FIG. 44, a first low voltage wire 324 connects the first actuator 320 to the suction motor 124 and a second low voltage wire 326 connects the second actuator 322 to the brush motor 344. It will be appreciated that the first and second low voltage wires 324, 326 may be signal wires that are used to send a signal to open/close a circuit to actuate and de-actuate a motor.

For example, when the first actuator 320 is actuated, a control signal is sent through the first low voltage wire 324 to the suction motor 124, thereby enabling the suction motor 124. When the first actuator 320 is actuated a second time, a control signal is sent to the suction motor 124, thereby disabling the suction motor 124. Similarly, when the second actuator 322 is actuated, a control signal is sent through the second low voltage wire 326 to the brush motor 344, thereby enabling the brush motor 344. When the second actuator 322 is actuated a second time, a control signal is sent to the brush motor 344, thereby disabling the brush motor 344.

Accordingly, a low voltage control signal may be used to control a higher voltage suction motor 124 and/or brush motor 344. While a suction motor 124 and a brush motor 344 are exemplified herein, it will be appreciated that the low voltage control signals may be used to actuate any electrically powered component of the surface cleaning apparatus 100.

It will be appreciated that the first actuator 320 and the second actuator 322 may be any type of actuator capable of enabling and disabling one or more motors in the surface cleaning apparatus 100. As exemplified, the first actuator 320 and the second actuator 322 are microswitches. In some embodiments, the handle 352 may have a touch screen control and the first actuator 320 and the second actuator 322 may be touch controlled.

Power Conduit

In accordance with this aspect, which may be used by itself or in combination with one or more other aspects, the wand 360 and the hose 350 coupled to the wand 360 of the surface cleaning apparatus 100 each has an internal power conduit. The power conduit may be used to run the low voltage control wires from the handle 352 to the suction motor 124 and the brush motor 344. An advantage of this design is that the wiring of the surface cleaning apparatus 100 may be hidden, thereby protecting the wiring from damage or from getting snagged on other objects during use.

In accordance with this aspect, the handle 352 of the hose 350 of the surface cleaning apparatus 100 has a hose electrical connector (not shown) that electrically couples to a wand electrical connector 362 in the wand 360. As exemplified in FIG. 44, the handle 352 of the hose 350 is electrically connected to the power supply 370 of the surface cleaning apparatus 100 by a power supply wire 372, which passes through a hose power conduit 356 to the handle 352. The handle 352 of the hose 350 is also electrically connected to the suction motor 124 by way of the first low voltage wire 324. The first low voltage wire 324 passes through the hose power conduit 356 to the suction motor 124. The wand electrical connector 362 is electrically connected to the second low voltage wire 326 and passes through a wand power conduit 364. Accordingly, power is supplied to the handle 352 through the hose power conduit 356, the first actuator 320 controls the operation of the suction motor 124 through the first low voltage wire 324 that passes through the hose power conduit 356, and the second actuator 322 controls the operation of the brush motor 344 through the second low voltage wire 326 that passes through the wand power conduit 364.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Clauses

Clause Set A

1. A canister surface cleaning apparatus comprising:
   (a) a canister body having an upper side and a lower side, the lower side of the canister body having floor travelling members, the upper side is spaced from the lower side in a vertical direction; and,
   (b) an air treatment assembly removably mountable to the canister body, the air treatment assembly comprises a front side, a rear side and right and left laterally opposed sides, wherein a handle having a handle portion is provided facing and spaced from one of the sides and, when the air treatment assembly is mounted on the canister body and the canister body is positioned with the lower end on a floor, the handle portion extends generally vertically.
2. The canister surface cleaning apparatus of clause 1 wherein another of the sides that is opposed to the one of the sides comprises an openable door.
3. The canister surface cleaning apparatus of clause 2 wherein the air treatment assembly comprises a cyclone and a dirt collection chamber external to the cyclone and at least a portion of the dirt collection chamber is positioned between the cyclone and the openable door.
4. The canister surface cleaning apparatus of clause 3 wherein the cyclone has a cyclone axis of rotation that extends generally vertically when the air treatment assembly is mounted on the canister body and the canister body is positioned with the lower end on the floor.

5. The canister surface cleaning apparatus of clause 1 wherein the generally vertically extending handle portion comprises a pistol grip handle portion.
6. The canister surface cleaning apparatus of clause 1 wherein the handle has an upper arm portion extending outwardly from an upper end of the air treatment assembly and a lower arm portion extending outwardly from a lower end of the air treatment assembly and the generally vertically extending handle portion comprises a pistol grip handle portion that is located between the upper and lower arm portions.
7. The canister surface cleaning apparatus of clause 1 wherein the air treatment assembly comprises a cyclone having a cyclone axis of rotation that extends generally vertically when the air treatment assembly is mounted on the canister body and the air treatment assembly has a door that ends generally vertically when the air treatment assembly is mounted on the canister body and the door is in a closed position.
8. The canister surface cleaning apparatus of clause 1 wherein the rear side of the air treatment assembly is positioned facing a front facing wall of the canister body when the air treatment assembly is mounted to the canister body and the generally vertically extending handle portion is positioned facing the front side of the air treatment assembly.
9. The canister surface cleaning apparatus of clause 1 wherein the canister body has an absence of a handle.
10. The canister surface cleaning apparatus of clause 1 wherein, when the air treatment assembly is mounted to the canister body, the air treatment member and the canister body comprise a canister assembly and the handle is the only handle of the canister assembly.

Vac with pistol grip handle on a side of the air treatment assembly opposed to a door on a wall that faces the main body 11. A surface cleaning apparatus comprising:
    (a) a main body having a wall; and,
    (b) an air treatment assembly removably mountable to the main body, the air treatment assembly comprises a front side, a rear side, right and left laterally opposed sides and a handle,
    wherein, when the air treatment assembly is mounted to the main body, the air treatment member and the main body comprise a surface cleaning apparatus assembly and the surface cleaning apparatus assembly has a dirty air inlet provided on a front end thereof,
    wherein the wall faces forwards and, when the air treatment assembly is mounted to the main body, one of the sides faces the wall and the one of the sides comprises an openable door, and
    wherein, when the air treatment assembly is mounted to the main body, the handle has a handle portion that is provided facing and spaced from a side that is opposed to the one of the sides.
12. The surface cleaning apparatus of clause 11 wherein the air treatment assembly comprises a cyclone and a dirt collection chamber external to the cyclone and at least a portion of the dirt collection chamber is positioned between the cyclone and the openable door.
13. The surface cleaning apparatus of clause 12 wherein the cyclone has a cyclone axis of rotation and the handle portion has a handle axis that is generally parallel to the cyclone axis of rotation.
14. The surface cleaning apparatus of clause 11 wherein the handle portion comprises a pistol grip handle portion.
15. The surface cleaning apparatus of clause 11 wherein the air treatment assembly has a first end and a second end, the sides extend between the first and second ends, the air treatment assembly comprises a cyclone, the cyclone has a cyclone axis of rotation and the handle portion has a handle axis that is generally parallel to the cyclone axis of rotation.
16. The surface cleaning apparatus of clause 11 wherein the air treatment assembly has a first end and a second end, the sides extend between the first and second ends, the air treatment assembly comprises an air treatment chamber, the air treatment chamber has an air outlet, and a projection of the air outlet intersects the first end.
17. The surface cleaning apparatus of clause 11 wherein the main body has an absence of a handle.
18. The surface cleaning apparatus of clause 11 wherein the handle is the only handle of the surface cleaning apparatus assembly.
19. A surface cleaning apparatus comprising:
    (a) a main body having a wall; and,
    (b) a cyclone assembly removably mountable to the main body, the cyclone assembly comprises a cyclone having a cyclone axis of rotation, a first side and a second opposed side, each of the first and second sides extend in a direction generally parallel to the cyclone axis of rotation, a handle having a handle portion that is spaced from and faces the first side, the handle portion has a handle axis that is generally parallel to the cyclone axis of rotation and the second side comprises an openable door.
20. The surface cleaning apparatus of clause 19 wherein the main body has a wall and, when the cyclone assembly is mounted to the main body, the air treatment member and the main body comprise a surface cleaning apparatus assembly, the surface cleaning apparatus assembly has a dirty air inlet provided on a front end thereof, the wall faces forwardly and the openable door faces the wall.
21. The surface cleaning apparatus of clause 20 wherein the cyclone assembly further comprises a dirt collection chamber external to the cyclone and at least a portion of the dirt collection chamber is positioned between the cyclone and the openable door.
22. The surface cleaning apparatus of clause 19 wherein the handle portion comprises a pistol grip handle portion.
23. The surface cleaning apparatus of clause 19 wherein the cyclone assembly has a first end and a second end, the first and second sides extend between the first and second ends, the cyclone has an air outlet, and a projection of the air outlet intersects the first end.
24. The surface cleaning apparatus of clause 19 wherein the main body has an absence of a handle.
25. The surface cleaning apparatus of clause 19 wherein the handle is the only handle of the surface cleaning apparatus assembly.

Clause Set B

1. A canister surface cleaning apparatus comprising:
    (a) a canister body having a lower side having floor travelling members and an upper side having a recess, the recess has sidewalls extending upwardly from a platform and an inlet conduit having an outlet port that is recessed inwardly from an outer surface of the sidewalls of the recess; and, (b) an air treatment assembly removably mountable to the canister body, the air treatment assembly seating on the recess when the air treatment assembly is mounted to the canister body.

2. The canister surface cleaning apparatus of clause 1 wherein the outlet port is positioned below an upper end of the sidewalls of the recess.

3. The canister surface cleaning apparatus of clause 2 wherein the inlet conduit extends through the sidewalls of the recess.

4. The canister surface cleaning apparatus of clause 1 wherein the inlet conduit extends through the sidewalls of the recess.

5. The canister surface cleaning apparatus of clause 1 wherein the air treatment assembly has an air inlet having an inlet port and, when the air treatment assembly is mounted to the canister body, the inlet port is positioned in the recess.

6. The canister surface cleaning apparatus of clause 1 wherein the canister body has a front side having the inlet conduit, the platform has a pre-motor filter housing and, when a pre-motor filter is positioned in the pre-motor filter housing, a forward side of the pre-motor filter is positioned rearward of the inlet conduit.

7. The canister surface cleaning apparatus of clause 6 wherein when a pre-motor filter is positioned in the pre-motor filter housing, at least 50% of a perimeter of the pre-motor filter is recessed inwardly from the sidewalls of the recess whereby, when a pre-motor filter is positioned in the pre-motor filter housing, a portion of the platform is visible between the perimeter of the pre-motor filter and the sidewalls of the recess.

8. The canister surface cleaning apparatus of clause 7 wherein the air treatment assembly has an air inlet having an inlet port and, when the air treatment assembly is mounted to the canister body, the inlet port is positioned in the recess.

9. The canister surface cleaning apparatus of clause 8 wherein the inlet port is positioned inwardly of an outer wall of the air treatment assembly.

10. The canister surface cleaning apparatus of clause 8 wherein the air treatment assembly further comprises a dirt collection chamber and an air treatment chamber that is nested in the dirt collection chamber and the inlet port is positioned inwardly of an outer wall of the dirt collection chamber.

11. The canister surface cleaning apparatus of clause 1 wherein the air treatment assembly comprises a dirt collection chamber and an air treatment chamber that is nested in the dirt collection chamber, the inlet conduit is provided on a front side of the canister body, and, when the air treatment assembly is mounted to the canister body, the dirt collection chamber has a front wall and the air treatment chamber has a front wall, and the inlet conduit extends rearward of the front wall of the dirt collection chamber.

12. The canister surface cleaning apparatus of clause 11 wherein the air treatment assembly has an air inlet and, when the air treatment assembly is mounted to the canister body, the air inlet and the inlet conduit define an air flow passage that extends under the dirt collection chamber.

13. A surface cleaning apparatus comprising:

(a) a main body having an inlet conduit having an outlet port; and, (b) an air treatment assembly removably mountable to the main body, the air treatment assembly comprises a dirt collection chamber and an air treatment chamber that is nested in the dirt collection chamber, the air treatment assembly having an air inlet, the dirt collection chamber having an outer wall and the air treatment member having an outer wall that is positioned inward of the outer wall of the dirt collection chamber, wherein when the air treatment assembly is mounted to the main body, the air inlet and the inlet conduit define an air flow passage that extends under the dirt collection chamber.

14. The surface cleaning apparatus of clause 13 wherein the air treatment assembly has first and second opposed ends, the air treatment member comprises a cyclone having a cyclone axis of rotation that extends through the first and second opposed ends and the air flow passage is provided at one of the first and second ends.

15. The surface cleaning apparatus of clause 14 wherein the air flow passage extends along the one of the first and second ends.

16. The surface cleaning apparatus of clause 13 wherein when the air treatment assembly is mounted to the main body, an end of the air treatment assembly is positioned in a recess of the main body and the outlet port is positioned within the recess.

17. The surface cleaning apparatus of clause 13 wherein when the air treatment assembly is mounted to the main body, an end of the air treatment assembly is positioned in a recess of the main body and the air flow passage is positioned within the recess.

18. The surface cleaning apparatus of clause 16 wherein an end of the air treatment member is mountable to the main body and the air treatment assembly has an air outlet that is provided in the end of the main body.

19. The surface cleaning apparatus of clause 18 wherein a pre-motor filter housing is provided in the recess and when the air treatment assembly is mounted to the main body and a pre-motor filter is provided in the pre-motor filter housing, the air treatment assembly seals an upper end of the pre-motor filter housing and the air outlet faces the pre-motor filter.

Clause Set C

1. A canister surface cleaning apparatus comprising:

(a) a canister body comprising a lower side having floor travelling members and a first recess, the first recess comprising a wall and sidewalls that extend away from the wall to define a volume that comprises the first recess; and, (b) an air treatment assembly removably mountable to the canister body, the air treatment assembly comprises a front side, a rear side and right and left laterally opposed sides, wherein, when the air treatment assembly is mounted to the canister body, the air treatment assembly and the canister body comprise a canister surface cleaning apparatus assembly and the canister surface cleaning apparatus assembly has a dirty air inlet provided on a front end thereof, wherein, when the air treatment assembly is mounted to the canister body and the canister body is positioned with the floor travelling members on a floor, the wall extends generally vertically and one of the sides of the air treatment assembly faces the wall and is positioned in the recess.

2. The canister surface cleaning apparatus of clause 1 wherein, when the air treatment assembly is mounted to the canister body and the canister body is positioned with the floor travelling members on a floor, the wall faces forwards and the one of the sides of the air treatment assembly is the rear side.
3. The canister surface cleaning apparatus of clause 2 wherein the air treatment assembly has a handle comprising a pistol grip portion and the pistol grip portion is spaced from and faces the front side of the air treatment assembly.
4. The canister surface cleaning apparatus of clause 2 wherein the rear side comprises an openable door.
5. The canister surface cleaning apparatus of clause 2 wherein the wall has an absence of an air flow passage therethrough.
6. The canister surface cleaning apparatus of clause 2 further comprising a lock releasable securing the air treatment assembly to the canister body and the lock is provided at a front side of the canister surface cleaning apparatus assembly.
7. The canister surface cleaning apparatus of clause 6 wherein the air treatment assembly has a handle, the lock comprises a lock actuator and the lock actuator is provided on the handle.
8. The canister surface cleaning apparatus of clause 1 wherein the canister body further comprises a second recess and a portion of the air treatment assembly is received in the second recess when the air treatment assembly is mounted to the canister body.
9. The canister surface cleaning apparatus of clause 8 wherein an opening of the first recess extends in a first plane, an opening of the second recess extends in a second plane and the second plane is generally transverse to the first plane.
10. The canister surface cleaning apparatus of clause 9 wherein the second recess has at least one of an outlet port of an inlet conduit that is positioned upstream of an air inlet of the air treatment assembly and an inlet port of an air flow passage that is downstream of an air outlet of the air treatment assembly.
11. A surface cleaning apparatus comprising:
    (a) a main body comprising a first recess and a platform, the first recess comprises a wall and sidewalls that extend away from the wall to define a volume that comprises the first recess;
    (b) an air treatment assembly removably mountable to the main body, the air treatment assembly comprises a front side, a rear side and right and left laterally opposed sides; and,
    (c) a pre-motor filter removably mountable in the platform,
    wherein an opening of the first recess extends in a first plane, the platform extends in a second plane and the second plane is generally transverse to the first plane.
12. The surface cleaning apparatus of clause 11 wherein, when the air treatment assembly is mounted to the main body, the air treatment assembly and the main body comprise a surface cleaning apparatus assembly which has a dirty air inlet provided on a front end thereof, the wall faces forwards and the air treatment assembly comprises part of an exterior surface of the surface cleaning apparatus.
13. The surface cleaning apparatus of clause 11 wherein the wall has an absence of an air flow passage therethrough.
14. The surface cleaning apparatus of clause 12 further comprising a lock releasable securing the air treatment assembly to the main body, wherein the lock is provided at a front side of the surface cleaning apparatus assembly, the air treatment assembly has a handle, the lock comprises a lock actuator and the lock actuator is provided on the handle.
15. The surface cleaning apparatus of clause 11 wherein the main body further comprises a second recess, the platform is provided in the second recess and a portion of the air treatment assembly is received in the second recess when the air treatment assembly is mounted to the main body.
16. The surface cleaning apparatus of clause 15 wherein the second recess has at least one of an outlet port of an inlet conduit that is positioned upstream of an air inlet of the air treatment assembly and an inlet port of an air flow passage that is downstream of an air outlet of the air treatment assembly.
17. A surface cleaning apparatus comprising:
    (a) a main body comprising a first recess, the first recess comprises a wall and sidewalls that extend away from the wall to define a volume that comprises the first recess; and,
    (b) an air treatment assembly removably mountable to the main body, the air treatment assembly comprises a front side, a rear side and right and left laterally opposed sides,
    wherein, when the air treatment assembly is mounted to the main body, one of the sides facing the wall is positioned in the recess and the one of the sides comprises an openable door.
18. The surface cleaning apparatus of clause 17 wherein the wall has an absence of an air flow passage therethrough.
19. The surface cleaning apparatus of clause 17 wherein the main body further comprises a platform, the first recess has an opening that extends in a first plane and the platform extends in a second plane that is generally transverse to the first plane.
20. The surface cleaning apparatus of clause 19 wherein the main body further comprises a second recess, the platform is provided in the second recess and a portion of the air treatment assembly is received in the second recess when the air treatment assembly is mounted to the main body.
21. The surface cleaning apparatus of clause 20 wherein the second recess has at least one of an outlet port of an inlet conduit that is positioned upstream of an air inlet of the air treatment assembly and an inlet port of an air flow passage that is downstream of an air outlet of the air treatment assembly.

Clause Set D

1. A surface cleaning apparatus comprises a cyclone assembly, the cyclone assembly comprises a cyclone and a dirt collection chamber exterior to the cyclone, the cyclone having a cyclone axis of rotation, the cyclone assembly having first and second opposed ends and sides extending between the first and second ends, wherein the cyclone axis of rotation extends axially through the first and second ends and one of the sides is openable.
2. The surface cleaning apparatus of clause 1 wherein the one of the sides comprises a wall of the dirt collection chamber.

3. The surface cleaning apparatus of clause 2 wherein the cyclone has a dirt outlet, and the dirt outlet faces the one of the sides.
4. The surface cleaning apparatus of clause 3 wherein the cyclone has a sidewall, and the dirt outlet is provided between the sidewall and an end wall of the cyclone.
5. The surface cleaning apparatus of clause 1 wherein the first end has a cyclone assembly air outlet, the cyclone assembly has a door that is moveably mounted by a mount between a closed position and an open position in which the one of the sides is open, and the mount is provided at the second end.
6. The surface cleaning apparatus of clause 5 wherein the door is generally planar
7. The surface cleaning apparatus of clause 5 wherein the door extends in a plane that is generally parallel to the cyclone axis of rotation.
8. The surface cleaning apparatus of clause 1 wherein the cyclone assembly further comprises a handle, the handle having a hand grip portion that faces and is spaced from a side of the cyclone assembly that is opposed to the one of the sides that is openable.
9. The surface cleaning apparatus of clause 8 wherein the handle portion has a handle axis that is generally parallel to the cyclone axis of rotation.
10. The surface cleaning apparatus of clause 9 wherein the handle portion comprises a pistol grip handle.
11. The surface cleaning apparatus of clause 1 wherein the cyclone is removable from the cyclone assembly.
12. The surface cleaning apparatus of clause 11 wherein the cyclone is axially removable.
13. The surface cleaning apparatus of clause 11 wherein the cyclone is removable mountable in one of the first and second ends of the cyclone assembly.
14. The surface cleaning apparatus of clause 11 wherein the cyclone is removably mountable in the first end of the cyclone assembly, the cyclone has a cyclone air inlet having an inlet port and the inlet port is located axially from the first end of the cyclone assembly and exterior to the cyclone assembly.
15. The surface cleaning apparatus of clause 14 further comprising a cyclone lock, the cyclone lock comprises a cyclone release actuator and the cyclone release actuator is located at the first end of the cyclone assembly.
16. The surface cleaning apparatus of clause 15 wherein the cyclone release actuator is located axially from the first end of the cyclone assembly.

Clause Set E

1. A surface cleaning apparatus comprises an air treatment assembly, the air treatment assembly comprises an air treatment member and a dirt collection chamber exterior to the air treatment member, the air treatment assembly having first and second opposed ends and a sidewall that extends between the first and second ends, wherein the sidewall has an openable door whereby the dirt collection chamber is opened when the door is opened, and the air treatment member is removably mounted in the first end of the air treatment assembly.
2. The surface cleaning apparatus of clause 1 wherein, when the door is opened, the dirt collection chamber has an opening that faces a first direction, and the air treatment member is removable in a direction that is generally transverse to the first direction.
3. The surface cleaning apparatus of clause 2 wherein, when the door is opened, the dirt collection chamber has an opening that generally extends in a plane, and the air treatment member is removable in a direction that is generally parallel to the plane.
4. The surface cleaning apparatus of clause 3 wherein the air treatment member is removably mountable in the first end of the air treatment assembly, the air treatment member has an air treatment member air inlet having an inlet port and the inlet port is located axially from the first end of the air treatment member assembly and exterior to the air treatment member assembly.
5. The surface cleaning apparatus of clause 1 wherein the air treatment member is removably mountable in the first end of the air treatment assembly, the air treatment member has an air treatment member air inlet having an inlet port and the inlet port is located axially from the first end of the air treatment member assembly and exterior to the air treatment member assembly.
6. The surface cleaning apparatus of clause 1 further comprising an air treatment member lock, the air treatment member lock comprises an air treatment member release actuator and the air treatment member release actuator is located at the first end of the air treatment member assembly.
7. The surface cleaning apparatus of clause 6 wherein the air treatment member release actuator is located axially from the first end of the air treatment member assembly.
8. The surface cleaning apparatus of clause 1 wherein the air treatment member has a dirt outlet, and the dirt outlet faces the openable door.
9. The surface cleaning apparatus of clause 8 wherein the air treatment member has a sidewall, and the dirt outlet is provided between the sidewall and an end wall of the air treatment member.
10. The surface cleaning apparatus of clause 1 wherein the first end has an air treatment assembly air outlet, the door is moveably mounted by a mount between a closed position and an open position in which the dirt collection chamber is opened, and the mount is provided at the second end.
11. The surface cleaning apparatus of clause 10 wherein the door is generally planar
12. The surface cleaning apparatus of clause 5 wherein an air treatment member axis extends between the first and second ends of the air treatment assembly and the door extends in a plane that is generally parallel to the air treatment member axis.
13. The surface cleaning apparatus of clause 1 wherein the air treatment assembly further comprises a handle, the handle having a hand grip portion that faces and is spaced from a side of the air treatment assembly that is opposed to the door.
14. The surface cleaning apparatus of clause 13 wherein an air treatment member axis extends between the first and second ends of the air treatment assembly and the handle portion has a handle axis that is generally parallel to the air treatment member axis.
15. The surface cleaning apparatus of clause 13 wherein the handle portion comprises a pistol grip handle.
16. The surface cleaning apparatus of clause 1 wherein the air treatment member is removably mountable in the first end of the air treatment assembly, the air treatment member has an air treatment member air inlet and an air treatment member air outlet, and the air treatment member air inlet and the air treatment member air outlet are each located at the first end of the air treatment assembly.

17. The surface cleaning apparatus of clause 1 wherein the air treatment member comprises a cyclone having a cyclone axis of rotation and the cyclone axis of rotation extends axially between the first and second ends of the air treatment assembly.

18. The surface cleaning apparatus of clause 17 wherein the cyclone is axially removable from the air treatment assembly.

19. The surface cleaning apparatus of clause 18 wherein the cyclone is removable mountable in the first end of the air treatment assembly, the cyclone has a cyclone air inlet and a cyclone air outlet, and the cyclone air inlet and the cyclone air outlet are each located at the first end of the air treatment assembly.

The invention claimed is:

1. A canister surface cleaning apparatus comprising:

(a) a canister body comprising a lower side having floor travelling members and a first recess, the first recess comprising a wall and sidewalls that extend away from the wall to define a volume that comprises the first recess; and, (b) an air treatment assembly removably mountable to the canister body, the air treatment assembly comprises a front side, a rear side and right and left laterally opposed sides, wherein, when the air treatment assembly is mounted to the canister body, the air treatment assembly and the canister body comprise a canister surface cleaning apparatus assembly and the canister surface cleaning apparatus assembly has a dirty air inlet provided on a front end thereof, and wherein, when the air treatment assembly is mounted to the canister body and the canister body is positioned with the floor travelling members on a floor, the wall extends generally vertically and one of the sides of the air treatment assembly faces the wall and is positioned in the recess, and wherein the air treatment assembly has a handle comprising a pistol grip portion and, when the air treatment assembly is mounted to the canister body and the canister body is positioned with the floor travelling members on a floor, the pistol grip portion is spaced from and faces the front side of the air treatment assembly.

2. The canister surface cleaning apparatus of claim 1 wherein, when the air treatment assembly is mounted to the canister body and the canister body is positioned with the floor travelling members on a floor, the wall faces forwards and the one of the sides of the air treatment assembly is the rear side.

3. The canister surface cleaning apparatus of claim 2 wherein the rear side comprises an openable door.

4. A canister surface cleaning apparatus comprising:

(a) a canister body comprising a lower side having floor travelling members and a first recess, the first recess comprising a wall and sidewalls that extend away from the wall to define a volume that comprises the first recess; and, (b) an air treatment assembly removably mountable to the canister body, the air treatment assembly comprises a front side, a rear side and right and left laterally opposed sides, wherein, when the air treatment assembly is mounted to the canister body, the air treatment assembly and the canister body comprise a canister surface cleaning apparatus assembly and the canister surface cleaning apparatus assembly has a dirty air inlet provided on a front end thereof, and wherein, when the air treatment assembly is mounted to the canister body and the canister body is positioned with the floor travelling members on a floor, the wall extends generally vertically and one of the sides of the air treatment assembly faces the wall and is positioned in the recess, and wherein the wall has an absence of an air flow passage therethrough.

5. A canister surface cleaning apparatus of claim 2 comprising:

(a) a canister body comprising a lower side having floor travelling members and a first recess, the first recess comprising a wall and sidewalls that extend away from the wall to define a volume that comprises the first recess; and, (b) an air treatment assembly removably mountable to the canister body, the air treatment assembly comprises a front side, a rear side and right and left laterally opposed sides, wherein, when the air treatment assembly is mounted to the canister body, the air treatment assembly and the canister body comprise a canister surface cleaning apparatus assembly and the canister surface cleaning apparatus assembly has a dirty air inlet provided on a front end thereof, and wherein, when the air treatment assembly is mounted to the canister body and the canister body is positioned with the floor travelling members on a floor, the wall extends generally vertically and one of the sides of the air treatment assembly faces the wall and is positioned in the recess, and wherein the canister surface cleaning apparatus further comprises a lock releasably securing the air treatment assembly to the canister body and the lock is provided at the front end of the canister surface cleaning apparatus assembly.

6. The canister surface cleaning apparatus of claim 5 wherein the air treatment assembly has a handle, the lock comprises a lock actuator and the lock actuator is provided on the handle.

7. The canister surface cleaning apparatus of claim 1 wherein the canister body further comprises a second recess and a portion of the air treatment assembly is received in the second recess when the air treatment assembly is mounted to the canister body.

8. The canister surface cleaning apparatus of claim 7 wherein an opening of the first recess extends in a first plane, an opening of the second recess extends in a second plane and the second plane is generally transverse to the first plane.

9. The canister surface cleaning apparatus of claim 8 wherein the second recess has at least one of an outlet port of an inlet conduit that is positioned upstream of an air inlet of the air treatment assembly and an inlet port of an air flow passage that is downstream of an air outlet of the air treatment assembly.

10. A surface cleaning apparatus comprising:

(a) a main body comprising a first recess and a platform, the first recess comprises a wall and sidewalls that extend away from the wall to define a volume that comprises the first recess;

(b) an air treatment assembly removably mountable to the main body, the air treatment assembly comprises a front side, a rear side and right and left laterally opposed sides; and, (c) a pre-motor filter removably mountable in the platform, wherein, when the air treatment assembly is mounted to the canister body and the canister body is positioned with the floor travelling members on a floor, the pre-motor filter is positioned below the air treatment member assembly and an opening of the first recess is rearward of the air treatment member assembly.

11. A surface cleaning apparatus comprising:

(a) a main body comprising a first recess and a platform, the first recess comprises a wall and sidewalls that extend away from the wall to define a volume that comprises the first recess; and, (b) an air treatment assembly removably mountable to the main body, the air treatment assembly comprises a front side, a rear side and right and left laterally opposed sides;

wherein, when the air treatment assembly is mounted to the main body, the air treatment assembly and the main body comprise a surface cleaning apparatus assembly which has a dirty air inlet provided on a front end thereof, the wall faces forwards and the air treatment assembly comprises part of an exterior surface of the surface cleaning apparatus.

12. The surface cleaning apparatus of claim 10 wherein the wall has an absence of an air flow passage therethrough.

13. The surface cleaning apparatus of claim 11 further comprising a lock releasable securing the air treatment assembly to the main body, wherein the lock is provided at the front end of the surface cleaning apparatus assembly, the air treatment assembly has a handle, the lock comprises a lock actuator and the lock actuator is provided on the handle.

14. The surface cleaning apparatus of claim 10 wherein the main body further comprises a second recess, the platform is provided in the second recess and a portion of the air treatment assembly is received in the second recess when the air treatment assembly is mounted to the main body.

15. The surface cleaning apparatus of claim 14 wherein the second recess has at least one of an outlet port of an inlet conduit that is positioned upstream of an air inlet of the air treatment assembly and an inlet port of an air flow passage that is downstream of an air outlet of the air treatment assembly.

16. The surface cleaning apparatus of claim 1 wherein, when the air treatment assembly is mounted to the main body, the air treatment assembly and the main body comprise a surface cleaning apparatus assembly and the air treatment assembly comprises part of an exterior surface of the surface cleaning apparatus.

17. The surface cleaning apparatus of claim 4 wherein, when the air treatment assembly is mounted to the main body, the air treatment assembly and the main body comprise a surface cleaning apparatus assembly and the air treatment assembly comprises part of an exterior surface of the surface cleaning apparatus.

18. The surface cleaning apparatus of claim 5 wherein, when the air treatment assembly is mounted to the main body, the air treatment assembly and the main body comprise a surface cleaning apparatus assembly and the air treatment assembly comprises part of an exterior surface of the surface cleaning apparatus.

19. The surface cleaning apparatus of claim 10 wherein, when the air treatment assembly is mounted to the main body, the air treatment assembly and the main body comprise a surface cleaning apparatus assembly and the air treatment assembly comprises part of an exterior surface of the surface cleaning apparatus.

20. The surface cleaning apparatus of claim 10 wherein the opening of the first recess extends in a first plane, the platform extends in a second plane and the second plane is generally transverse to the first plane.

* * * * *